US006637359B1

(12) United States Patent
Hagner

(10) Patent No.: US 6,637,359 B1
(45) Date of Patent: Oct. 28, 2003

(54) SYSTEM AND METHOD FOR INTERNALLY FITTING A NEW INNER HULL TO AN EXISTING OUTER HULL TO FORM A REBUILT DOUBLE HULL VESSEL

(75) Inventor: Thomas Hagner, Riverview, FL (US)

(73) Assignee: Maritrans Inc., Tampa, FL (US)

( * ) Notice: Subject to any disclaimer, the term of this patent is extended or adjusted under 35 U.S.C. 154(b) by 0 days.

(21) Appl. No.: 09/989,846

(22) Filed: Nov. 21, 2001

Related U.S. Application Data

(63) Continuation-in-part of application No. 09/689,420, filed on Oct. 12, 2000, now Pat. No. 6,357,373, which is a continuation of application No. 09/289,031, filed on Apr. 9, 1999, now Pat. No. 6,170,420.

(60) Provisional application No. 60/112,394, filed on Dec. 15, 1998.

(51) Int. Cl.[7] ..... B63B 3/62

(52) U.S. Cl. ..... 114/65 R; 114/74 A

(58) Field of Search ..... 114/74 A, 65 R

(56) References Cited

U.S. PATENT DOCUMENTS

| | | | | |
|---|---|---|---|---|
| 3,399,645 A | * | 9/1968 | Dahan | 114/74 A |
| 3,574,921 A | | 4/1971 | Fiegel et al. | 29/457 |
| 3,590,466 A | | 7/1971 | Moshammer et al. | 29/471.3 |
| 3,742,889 A | | 7/1973 | Weise et al. | 114/65 R |
| 3,797,099 A | | 3/1974 | Myers | 29/471.3 |
| 3,811,593 A | | 5/1974 | Bridges et al. | 220/9 LG |
| 4,111,146 A | * | 9/1978 | Babcock et al. | 114/74 A |
| 4,230,061 A | * | 10/1980 | Roberts et al. | 114/74 A |
| 4,267,789 A | | 5/1981 | Ivanov et al. | 114/65 R |
| 4,548,154 A | | 10/1985 | Murata et al. | 114/335 |
| 4,573,422 A | | 3/1986 | Murata et al. | 114/65 R |
| 4,660,491 A | | 4/1987 | Murata et al. | 114/65 R |
| 4,674,430 A | | 6/1987 | Murata et al. | 114/355 |
| 4,743,450 A | * | 5/1988 | Harris et al. | 424/440 |
| 4,907,524 A | | 3/1990 | Hart et al. | 114/356 |
| 5,090,351 A | | 2/1992 | Goldbach et al. | 114/65 R |
| 5,189,975 A | | 3/1993 | Zednik et al. | 114/74 A |
| 5,218,919 A | | 6/1993 | Krulikowski, III et al. | 114/74 A |

(List continued on next page.)

FOREIGN PATENT DOCUMENTS

| | | |
|---|---|---|
| FR | 2 719 545 | 10/1995 |
| JP | 61-24685 | 2/1986 |
| JP | 61-24686 | 2/1986 |

OTHER PUBLICATIONS

Maritrans Inc. Annual Report, 1997.

Company Press Release, Sep. 8, 1997: "Maritrans Inc. Will Seek Shipyard Bids For Pilot Double–Hull Retrofit Project," Internet: http://biz.yahoo.com.

(List continued on next page.)

*Primary Examiner*—Sherman Basinger

(74) *Attorney, Agent, or Firm*—Woodcock Washburn LLP

(57) ABSTRACT

A system and method for fitting a new inner hull internally over an existing single hull to form a rebuilt double hull vessel. The topside decking and internal vessel structure of the existing single hull vessel is cut and removed and the inner hull structure is inserted within a volume defined by the original hull. The original hull defines an exterior (outer hull) of the rebuilt double hull vessel and the inner hull defines an interior cargo carrying volume and forms a secondary boundary in the event that the outer hull is penetrated. A face bar and filler plate combination is used to connect the new inner hull to the existing outer hull and accounts for dimensional tolerances between the two structures. In addition, detailed ship surveys are conducted to measure the vessel structure and advanced, computerized drafting techniques are employed to improve the fit-up of the new inner hull structure with the existing outer hull structure.

19 Claims, 39 Drawing Sheets

U.S. PATENT DOCUMENTS

| | | | | | |
|---|---|---|---|---|---|
| 5,350,582 | A | * | 9/1994 | Mereslavic et al. | 424/464 |
| 5,542,365 | A | | 8/1996 | Jurisich et al. | 114/65 R |
| 5,562,921 | A | * | 10/1996 | Sherman | 424/465 |
| 5,573,780 | A | * | 11/1996 | Sherman | 424/464 |
| 5,690,962 | A | * | 11/1997 | Sherman | 424/489 |
| 6,170,420 | B1 | * | 1/2001 | Hagner et al. | 114/65 R |

OTHER PUBLICATIONS

Maritrans Signal, "A View From The Top: We'd Like to Thank 536 of the Most Environmentally Caring People in the World," by Stephen van Dyck, Fall 1998, pp. 1, 12, and 13.

"Firm Rebuids Shipping Barge," Business and Finance Section of *The Tampa Tribune*, Nov. 7, 1998.

"Maritrans Completes First Double–Hull Barge Retrofit," *News Log*, Nov. 1998, pp. 19, 20, 22.

"Maritrans Is Making Waves," Great Ships of 1998, *Maritime Reporter/ Engineering News*, pp. 26, 28, 44.

Letter from D. Jones to Penn Maritime re "Internal Double Hulling of the Morania No. 460," dated Dec. 6, 1996.

Drawing, "Midbody Scantling Details," Schuller & Allan, Inc., Oct. 12, 1996.

Drawing, "Scantling Arrangment" Schuller & Allan, Inc., undated.

Drawing, "Revised & New Ballast Piping System" Schuller & Allan, Inc., Oct. 13, 1996.

Drawing, "Cargo Piping Modifications" Schuller & Allan, Inc., Oct. 26, 1996.

* cited by examiner

| | | | | | | | |
|---|---|---|---|---|---|---|---|
| Fig. 10H | Fig. 10G | Fig. 10F | Fig. 10E | Fig. 10D | Fig. 10C | Fig. 10B | Fig. 10A |

80

#2 CARGO TANK
12
Cargo Piping
Electrical Piping
Fuel Oil Piping
Hydraulic Piping
Pneumatic Piping
Vapor Recovery Piping

80

#4 CARGO TANK
12
Cargo Piping
Electrical Piping
Fuel Oil Piping
Hydraulic Piping
Pneumatic Piping
Vapor Recovery Piping

SYSTEM AND METHOD FOR INTERNALLY FITTING A NEW INNER HULL TO AN EXISTING OUTER HULL TO FORM A REBUILT DOUBLE HULL VESSEL

This application is a Continuation-In-Part of Ser. No. 09/689,420, filed Oct. 12, 2000 (now U.S. Pat. No. 6,357,373), which is a Continuation of Ser. No. 09/289,031, filed Apr. 9, 1999 (now U.S. Pat. No. 6,170,420), which claims §119(e) priority based on provisional application 60/112,394, filed Dec. 15, 1998.

FIELD OF THE INVENTION

The present invention relates to shipbuilding and vessel repair, and more particularly, the present invention relates to a rebuilt double hull vessel and improved systems and methods for internally rebuilding a vessel having an existing single hull into a vessel having a double hull. Even more particularly, the present invention relates to improved systems and methods of internally fitting and attaching the new inner hull structure to the existing outer hull structure to form the rebuilt double hull vessel.

BACKGROUND OF THE INVENTION

The shipping and cargo moving industry is continually faced with customer demands for new and improved vessel designs and for new and improved methods of modifying the design of existing vessels. Substantial cost savings can be realized by a vessel owner in modifying or rebuilding existing vessels to incorporate improvements in vessel designs or otherwise extend the life of the vessel rather than paying the cost of building a new vessel.

In addition, new governmental and environmental regulations place certain restrictions and requirements on vessel owners and operators. These new or required designs must be capable of securely holding a cargo and also of being seaworthy. At the same time, a vessel must comply with shipping and environmental requirements and regulations.

A typical vessel comprises a vessel having a single hull design. This type of hull construction provides a single outer hull or skin that provides structural integrity and acts as a boundary between the operating environment of the vessel (e.g., the sea) and the cargo and internal structure of the vessel. The single hull typically includes a shell having a bottom, a port side, a starboard side, a bow, a stem, a plurality of transverse and longitudinal bulkheads, and internal frames that support and strengthen the shell of the hull. This internal framing typically includes a combination of transverse and longitudinal members.

As a result of the recent heightened environmental awareness and several shipping mishaps, new governmental regulations have been implemented requiring the use of double hulls on designated vessels in U.S. waters out to the 200 mile economic zone limit. These double hull requirements are contained in the Oil Pollution Act of 1990 (OPA-90) and have been incorporated in U.S. Coast Guard regulations. In part, OPA-90 requires that all new tank vessels constructed under contracts awarded after 1990 must have double hulls and that all existing single hull vessels engaged in the marine transport of oil and petroleum products be rebuilt with double hulls or be retired between the years 1995 and 2015, depending on the size and age of the vessel.

This has created a great burden on carriers having existing single hull vessels. These single hull vessels will either have to be rebuilt to incorporate a double hull design at great cost to the carrier, or the vessel will have to be retired, in many cases years before the end of its economically useful life.

Double hull designs have been used in the construction of newer vessels in an effort to comply with the requirements of the OPA-90. These new construction, double hull vessels typically have an outer hull and an inner hull. The outer hull and the inner hull each have shell plating that forms the structural integrity of the hull. A combination of transverse and longitudinal framing is provided between the inner and the outer hull to help strengthen the shell plating. The idea behind a double hull is that the structural integrity of the outer hull may be breached without breaching the inner hull. Therefore, the outer hull may be breached, i.e., opened to the sea, while the cargo would remain securely contained within the inner hull. Thereby, a potential cargo spill will have been avoided. Typical cargos that have spilled in the past to cause environmental mishaps include cargos such as an oil, a petroleum, a chemical, or other hazardous materials. Of course the provision of a double hull adds to the complexity and cost of new construction.

Due to deviations in dimensions and equipment lay-out between the existing in-service vessel and the as-built vessel when it was new, difficulties exist with internally fitting the new inner hull over the existing outer hull to form the double hull vessel. Therefore a need exists for improved fit-up techniques for fitting the new inner hull to the existing outer hull in order to form the rebuilt vessel having a double hull.

SUMMARY OF THE INVENTION

The present invention is directed to a double hull vessel (particularly a sea going vessel) and improved systems and methods of internally rebuilding an existing vessel having a single hull design into a vessel having a double hull design. The present invention accomplishes the installation of the new double hull using an internal rebuild concept. The present invention reuses the existing vessel structure to the maximum extent possible, while also maintaining, as much as possible, the cargo carrying and hull operational characteristics of the original vessel. The shape and dimensions of the outer hull of the vessel and the hull performance characteristics of the vessel remain substantially the same, and the existing internal ship structure, including the longitudinal bulkheads, the transverse bulkheads, and top side decking are removed, modified, and reused to the maximum extent possible.

The outer hull of the existing single hull vessel and a new inner hull, which is disposed within a volume defined by the outer hull, define the double hull of the rebuilt vessel. A plurality of framing members are disposed between the inner hull structure and the outer hull and maintain the inner hull in a spaced apart relationship with the outer hull. The new inner hull defines an interior cargo carrying volume and the outer hull defines an exterior of the rebuilt vessel, such that the inner hull provides a boundary in the event that the outer hull is penetrated.

Preferably, the new inner hull structure which forms the new inner hull of the double hull vessel is prefabricated as a plurality of modular sections, and the prefabricated modules are fitted over the top of the existing bottom framing members and joined to the existing framing members at the sides. The prefabricated modules comprise portions of the inner hull plating including the inner bottom plating, port side plating, and starboard side plating, and a plurality of framing members. The framing members include stiffening members and connecting members. In one preferred embodiment, the connecting members include a plurality of transverse framing members and the stiffening members include a plurality of longitudinal framing members.

Alternatively, the connecting members may include a plurality of longitudinal framing members and the stiffening members may include a plurality of transverse framing members. The connecting members are connected at one end to an exterior surface of the inner hull structure and extending therefrom and are connected at the other end to the outer hull structure.

The new portions of the primary framing members of the modular sections extend from the inner bottom plating a shorter distance than the new portions of the connecting members, thereby forming a gap when the module is installed over the existing framing. This gap helps facilitate fitting up and welding of each modular section to the existing outer hull structure. The removed internal ship structure and topside deck is modified and then reinstalled over the new inner hull after the inner hull has been installed. Thus, the cargo is primarily contained by new steel (the inner hull), and the exterior structure and coating of the original vessel's hull define the outer hull of the vessel.

Accordingly, a single hull vessel is rebuilt to have a double hull over at least the entire side and bottom within the length of the cargo carrying volume, while substantially maintaining the major outer hull exterior dimensions and hull hydrodynamic characteristics of the original single hull vessel.

In accordance with a further aspect of the present invention, an improved connecting member and the use of advanced, computerized drafting and design techniques to improve the fit-up and connection of the new inner hull structure to the existing outer hull structure. More specifically, the improvements include: (a) using a face bar and filler plate combination to account for deviations in the hull structure thereby providing improved fit-up of the new inner hull structure to the existing outer hull structure; (b) performing a detailed vessel survey including measurement of various structural dimensions and accounting for deviations between as-built and existing structures including: the longitudinal distance between transverse frames and transverse bulkheads (e.g., the double bottom web of the new inner bottom and the bottom web of the existing structure) and the vertical gap between the new inner hull structure and the existing outer hull structure (e.g., the distance between the bottom of the face bar of the new hull and the top of the flange plate of the existing hull structure); (c) using Automated Computer-Aided Drafting (AUTOCAD) to ensure that the new and the existing structures come together smoothly by using graphical techniques to depict with a very high degree of accuracy the structure of the existing vessel and then tailoring the fabrication of the new inner hull structure to match the existing outer hull structure; and (d) using Finite Element Analysis (FEA) for evaluation of special structural details for best fit of new-to-existing structure ensuring acceptable stresses and long-term trouble-free service.

A double hull vessel rebuilt from an existing single hull vessel using the improved fit-up techniques includes an inner hull disposed within a volume defined by the existing outer hull so as to define a double hull. A plurality of framing members are disposed between the inner hull and the outer hull, including connecting members that maintain the inner hull in a spaced apart relationship with the outer hull. The connecting members include an inner connecting member and an outer connecting member that extend from the new inner hull the existing outer hull, respectively. A face bar and a filler plate are disposed between and connect the inner connecting member and the outer connecting member. The new inner hull defines an interior cargo carrying volume and the outer hull defines an exterior of the rebuilt vessel, such that the inner hull provides a boundary in the event that the outer hull is penetrated.

Preferably, the face bar is connected to a distal end of the inner connecting member on the new inner connecting member and the filler plate is connected to the face bar and a top portion of the outer connecting member.

The improved fit-up technique includes a fit-up tolerances that provides for an improved fit-up of the new inner hull to the existing outer hull by allowing a misalignment between the new inner connecting member and the existing outer hull connecting member. The fit up tolerances include a transverse fit up area defining an acceptable transverse offset between the new inner hull connecting member and the existing outer hull connecting member, and a vertical fit up area defining an acceptable vertical offset between the distal end of the inner connecting member and the top end of the existing outer hull connecting member.

Preferably, the fit up tolerances are determined based on the particular application and factors such as the type and size of the materials used to for the connection. Tolerance angles a are formed between an imaginary line extending from each comer of the distal end of the inner connecting member and help to determine the fit-up tolerances.

In one preferred embodiment, wherein the inner connecting member and the outer connecting member have a plate thickness of about ½ inch, the face bar has a plate thickness of about 1 inch, and the filler plate has a plate thickness of about ½ inch; the tolerance angles preferably include angles of about 45 degrees. This results in a transverse fit up area for the filler plate of about 2 9/16 inch for the transverse offset between the new inner hull connecting member and the existing outer hull connecting member and a vertical fit up area for the filler plate of about 2 3/16 inch for the vertical offset between the new inner hull connecting member and the existing outer hull connecting member.

The present invention is also directed to an improved method of fitting the new structure to the existing structure during the internal double hulling wherein the outer hull of an existing vessel is rebuilt internally using improved fit-up techniques to form a double hull. The method of double hull rebuild includes the steps of cutting an internal structure of the existing single hull vessel proximate an inner perimeter of the outer shell plating and an outer perimeter of the deck plating at least along a length of the cargo section; removing the cut internal structure from the outer shell plating; internally installing a new inner hull structure in a spaced apart relationship within a volume defined by the outer shell plating of the existing single hull vessel to form a double hull; connecting the inner hull structure to the existing outer hull structure using a face bar and a filler plate combination that account for deviations between the inner hull structure and the outer hull structure thereby providing improved fit up of the new inner hull structure to the existing hull structure; adapting the removed internal structure for reinsertion into the double hull; and reinstalling the adapted internal structure over an interior surface of the inner hull.

In accordance with one embodiment, the method further includes the steps of performing a detailed vessel survey including measuring the actual structural dimensions. The actual structural dimensions include, for example, the longitudinal distances between transverse frames and transverse bulkheads and the vertical gaps between the new inner hull structure and the existing outer hull structure.

The method can further includes the steps of using Automated Computer-Aided Drafting (AUTOCAD) to ensure that the new inner hull structure and the existing outer hull structure come together smoothly; using graphical techniques to depict with a very high degree of accuracy the outer hull structure of the existing vessel; and fabricating the new inner hull structure to match the existing outer hull structure. Finite Element Analysis (FEA) may be used for evaluation of special structural details for best fit of new-to-existing structure ensuring acceptable stresses and long-term trouble-free service.

Additional features of the present invention are set forth below.

BRIEF DESCRIPTION OF THE DRAWINGS

The foregoing summary, as well as the following detailed description of the preferred embodiments, is better understood when read in conjunction with the appended drawings. For the purpose of illustrating the invention, there is shown in the drawings an exemplary embodiment that is presently preferred, it being understood, however, that the invention is not limited to the specific methods and instrumentalities disclosed. In the drawings.

DETAILED DESCRIPTION OF THE PREFERRED EMBODIMENTS

Figure 1A:
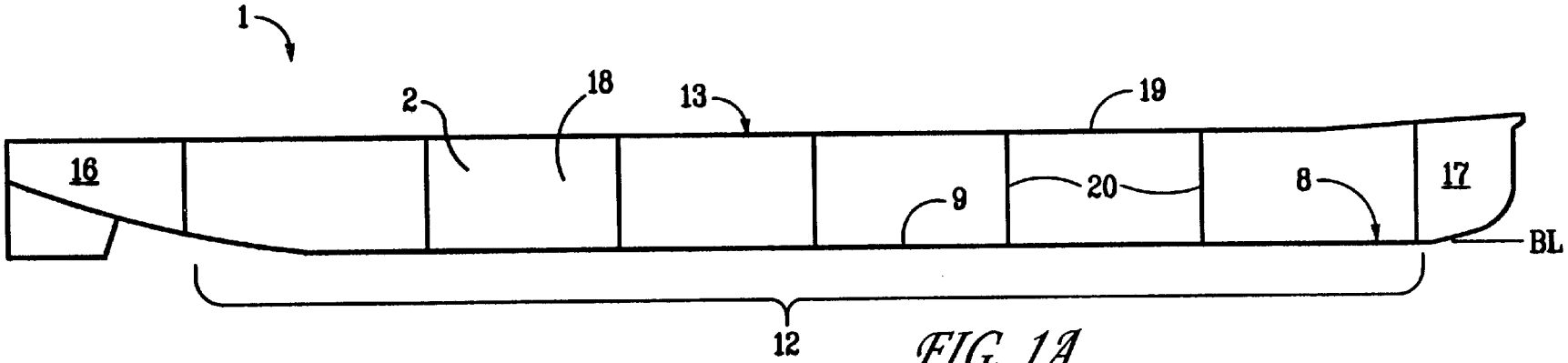
FIGS. 1A and 1B show a side view and a top plan view, respectively, of an exemplary single hull vessel for double hull rebuild in accordance with the present invention.

A system and method for improving the fit-up of a new inner hull to an existing outer hull during an internal double hull rebuild of an existing single hull vessel to form a rebuilt double hull vessel that solve the above-mentioned problems in the prior art and provides other beneficial features in accordance with the presently preferred exemplary embodiment of the invention are described below with reference to FIGS. 1A–27B. An exemplary rebuilt double hull vessel and exemplary method of vessel rebuild are described below with reference to FIGS. 1–9. A system and method for improving the fit-up of the new inner hull to the existing outer hull is described below with reference to FIGS. 10A–27B. The improved fit-up techniques of the present invention provide for the mating of the new inner hull structure with the existing outer hull structure in the most productive manner possible. Those skilled in the art will readily appreciate that the description given herein with respect to those figures is for explanatory purposes only and is not intended in any way to limit the scope of the invention.

Throughout the following detailed description similar reference numbers refer to similar elements in all the figures of the drawings.

The present invention is directed to an improved fit-up system for a rebuilt double hull vessel and an improved method for fitting the new inner hull to the existing outer hull when rebuilding an existing vessel 1 having a single outer hull 2 into a rebuilt vessel 5 having a double hull 4. This rebuilt vessel and method of internal double hulling results in a "ship within a ship" like construction. The rebuilt double hull vessel 5 includes a new inner hull 6 that is adapted to be fitted inside the volume defined by the outer hull 2 and to be coupled to the outer hull 2 of the existing vessel 1 in a spaced apart relationship thereby forming the double hull 4.

Specifically, the present invention is directed to improved connecting member and the use of advanced, computerized drafting and design techniques to improve the fit-up and connection of the new inner hull structure to the existing outer hull structure. More specifically, the improvements include: using a face bar and filler plate combination to account for deviations in the hull structure thereby providing improved fit-up of the new inner hull structure to the existing outer hull structure; performing a detailed vessel survey including measurement of various structural dimensions and accounting for deviations between as-built and existing structures including: the longitudinal distance between transverse frames and transverse bulkheads (e.g., the double bottom web of the new inner bottom and the bottom web of the existing structure) and the vertical gap between the new inner hull structure and the existing outer hull structure (e.g., the distance between the bottom of the face bar of the new hull and the top of the flange plate of the existing hull structure); using Automated Computer-Aided Drafting (AUTOCAD) to ensure that the new and the existing structures come together smoothly by using graphical techniques to depict with a very high degree of accuracy the structure of the existing vessel and then tailoring the fabrication of the new inner hull structure to match the existing outer hull structure; using Finite Element Analysis (FEA) for evaluation of special structural details for best fit of new-to-existing structure ensuring acceptable stresses and long-term trouble-free service; and the like.

The double hull 4 includes an interior or inner hull 6 and an exterior or outer hull 2 defined by the original hull 2 of the existing vessel 1. The inner hull 6 defines an interior cargo carrying volume 12 and the outer hull 2 defines an exterior of the rebuilt vessel 5. The present invention provides for a system for improved fit-up of the new structure (N) to the existing structure (E) during the internal rebuild of an existing single hull vessel 1 into a double hull vessel 5 while at the same time maintaining the original outer or exterior hull material, exterior hull shape, exterior hull dimensions, and exterior hull performance characteristics.

The present invention is also directed to an improved method of fitting the new structure (N) to the existing structure (E) during the internal double hulling wherein the outer hull 2 of an existing vessel 1 is rebuilt internally using improved fit-up techniques to form a double hull 4. The method of double hull rebuild includes the steps of removing substantially all of the existing internal structure 7 proximate the cargo section 12 (herein after also referred to as cargo carrying volume) of the vessel 1, inserting a new inner hull structure 3 within the volume defined by the existing outer hull 2 and connecting the new inner hull structure 3 to the existing outer hull 2, thereby forming an inner hull 6 of a double hull 4, reinstalling the modified existing internal vessel structure 7 over the new inner hull 6, and reconnecting the existing internal vessel structure 7 to the new inner hull 6.

The exemplary rebuilt vessel having an internally fitted double hull and the exemplary method of fitting the new inner hull structure to the existing outer hull structure are described with reference to a rebuild, conversion, and/or retrofit of an existing oil, or petroleum, or chemical carrying vessel, but it is contemplated that the present invention is applicable to other types of vessels as well, and is not limited to the particular vessel embodiments shown. For example, the invention contemplates the use of other vessel types, such as ships and barges for the transportation of liquid, granular, and gaseous cargos, as well as other vessel structures, different methods of coupling various parts of the vessel together, and the use of various materials for the construction/rebuild of the vessel.

By rebuilding the hull from the inside out, the same outer hull shape and dimensions of the original single hull vessel are maintained. This is important for several reasons. By maintaining the same outer hull shape and dimensions, the wind and wave performance characteristics of the vessel are essentially the same after the rebuild as they were prior to the rebuild. The vessel interface with port facilities and tugboats are maintained. Also, the new inner hull 6 having new metal and surface coatings is used to hold the cargo. The existing hull 2, which is already proven to be seaworthy, to have the proper structural stiffness, and the proper corrosion coating required for a seawater environment, is still on the outside or exterior of the new double hull 4. This method of internal double hulling allows the vessel to also maintain essentially the same beam characteristics. This allows the same ports to be accessed by the vessel, and the same customers to be serviced after the rebuild that were serviced prior to the rebuild.

Preferably, the double hull 4 extends over at least the entire outer shell plating 18 (e.g., outer bottom plating 9, outer port side plating 10 and outer starboard side plating 11) within the length of the cargo carrying section 12 of the double hull vessel 5 in order to protect the cargo from spillage in case of penetration of the outer hull 2. The existing internal structure 7 that was removed may be modified such that the topside decking 13 that was removed is adapted to be reconnected to the topside decking 13 that was left in place.

Alternatively, a trunk structure 53 can be added between the topside decking 13*b* that was left in place and the topside decking 13*a* that was removed to maintain the cargo carrying capacity of the double hull vessel 5 substantially the same as that of the single hull vessel 1. Preferably the trunk structure 53 has a height sufficient to prevent a loss in the cargo carrying capacity, although the trunk structure 53 may be designed to increase, decrease, or maintain the cargo carrying capacity.

The present invention allows for the installation of a double hull 4 into an existing vessel 1 having a single hull design and has the advantages of maximizing the amount of existing structure that is reused in the rebuild construction. In addition, the present invention provides for prefabrication of the material and structure of the new inner hull 6. Preferably the inner hull structure 3 is prefabricated into a plurality of modular sections 15 to reduce the repair time. This rebuild or retrofit process saves a substantial amount of time and money due to the fact that the original vessel's hull 2 and internal structure 7 is reused. Also, the present invention provides a level of confidence in the operation and performance of the rebuilt double hull vessel 5 due to the fact that the design and seaworthiness of the outer hull 2 of the rebuilt double hull vessel 5 has already been proven in-service.

Figure 1B:
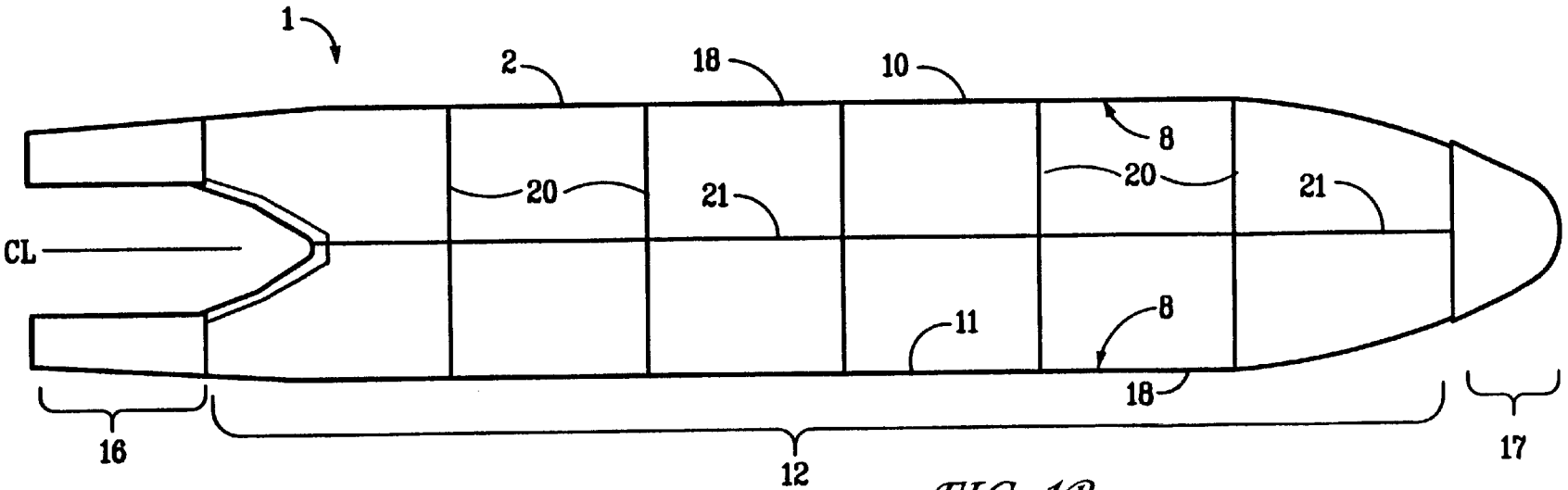

FIGS. 1A and 1B show a typical single hull vessel 1. As shown, the single hull vessel 1 includes a stern section 16, a bow section 17, and a cargo carrying section 12 located midships between the stern section 16 and the bow section 17, as are conventional. The stern section 16 and bow section 17 typically include main propulsion systems, mechanical systems, electrical systems, cargo and ship handling equipment, crew living quarters, and the like as are conventional. A centerline CL extends along a longitudinal length of the vessel and separates the vessel into port and starboard sides. A baseline BL includes an imaginary line which represents a horizontal reference plane for vertical dimensions.

As shown in FIGS. 1A and 1B, a single exterior or outer hull 2 extends the length of the vessel 1 from the stem 16 to the bow 17. The outer hull 2 is formed of outer shell plating 18 including outer bottom plating 9, outer port side plating 10, and outer starboard side plating 11. Top side deck plating 13 extends laterally across the top edges 19 of the side plating 10, 11 from the stem 16 to the bow 17. One or more cargo carrying sections 12 are typically formed midships between the bow section 17 and the stem section 16. The cargo section 12 defines the cargo carrying volume of the vessel and may be divided transversely by one or more transverse bulkheads 20 and/or longitudinally by one or more longitudinal bulkheads 21. These bulkheads 20, 21 are watertight solid structures that divide the cargo section 12 of the vessel 1 into one or more tanks which physically separate the cargo.

FIGS. 2–9 and the following text describing those figures disclose in more detail the process for cutting and removing the existing vessel structure, inserting the new inner hull structure, modifying the removed existing hull structure and reinstalling the modified existing hull structure.

Figure 2A:
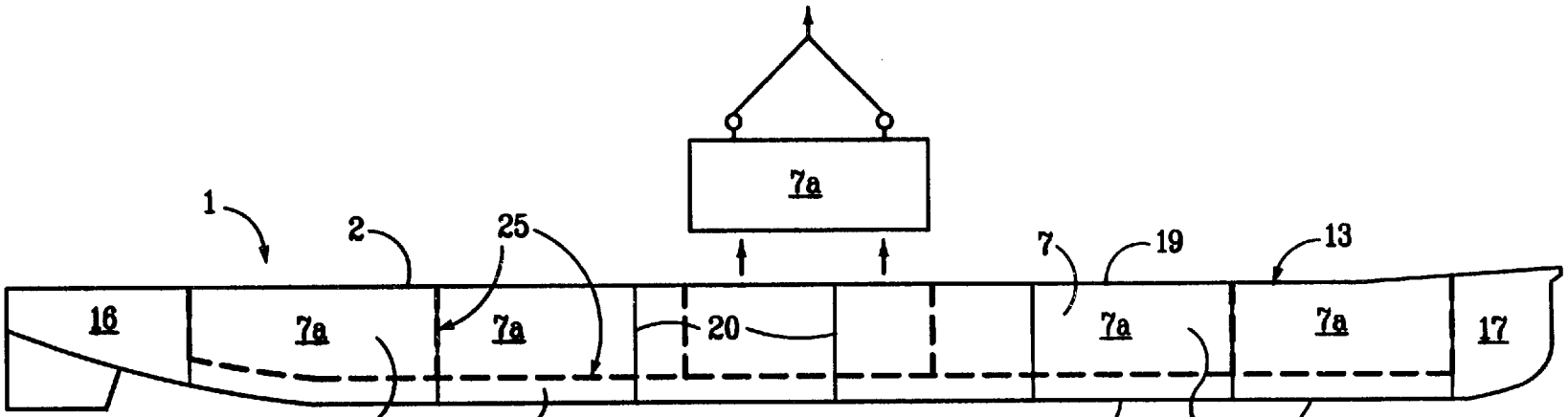
FIG. 2A shows a side view of the vessel of FIG. 1 illustrating with dashed lines the cut lines for removal of the existing internal vessel structure and topside decking.
Figure 2B:
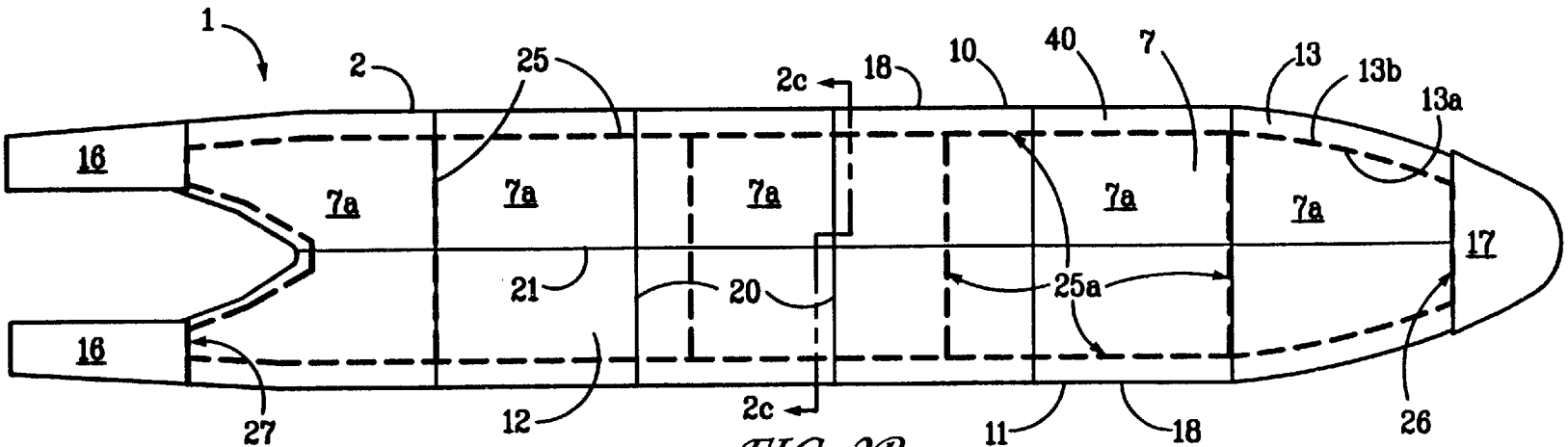
FIG. 2B shows a plan view of the cut lines of FIG. 2A.
Figure 2C:
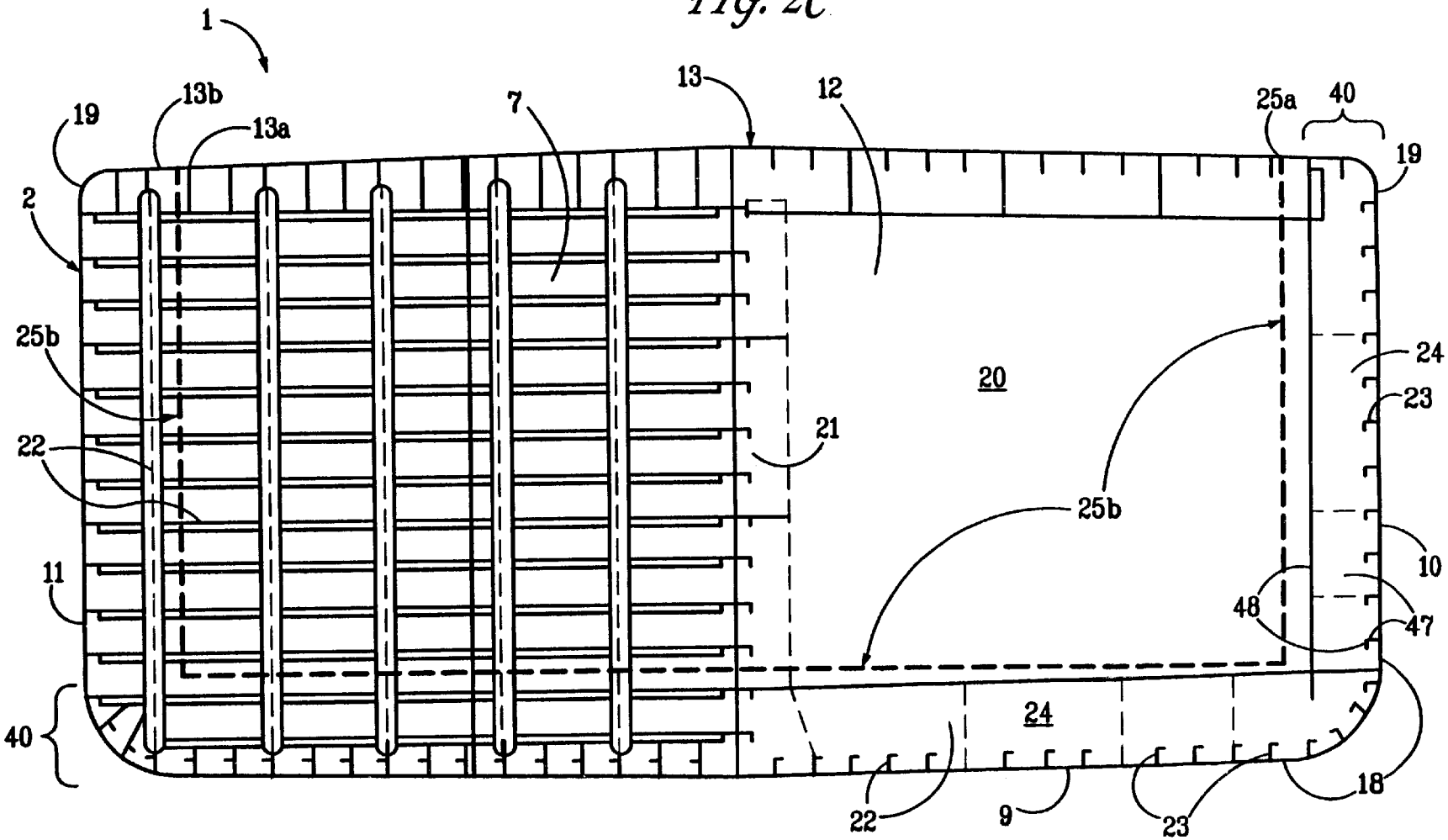
FIG. 2C shows a cross-sectional view taking along line 2C—2C of FIG. 2B showing the cut lines.

As shown in FIG. 2C, the outer hull's 2 shell plating 18 is supported and strengthened by a plurality of outer framing members 22 and bulkheads 20, 21. These outer frames 22 and bulkheads 20, 21 typically include outer longitudinal frames 23 and bulkheads 21 that run generally fore and aft (lengthwise), and outer transverse frames 24 and bulkheads 20 that run generally port to starboard (side to side).

Figure 6A:
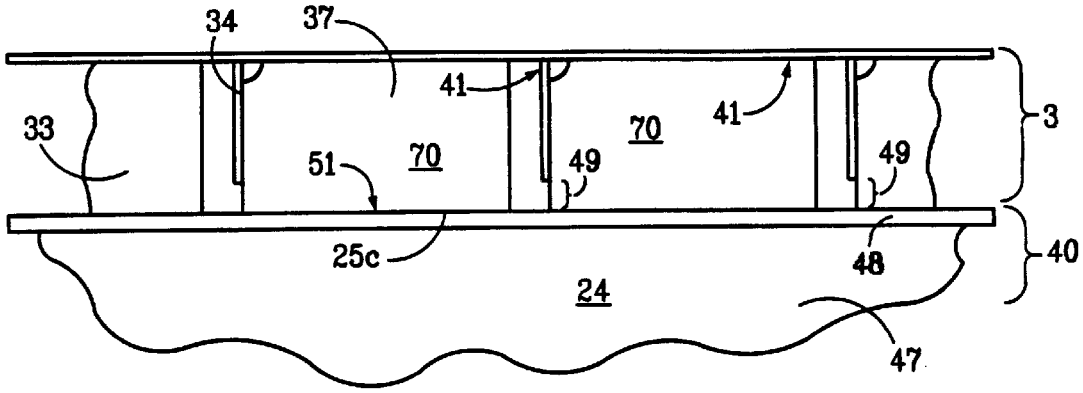
FIG. 6A is a detailed end view of an exemplary connection of the inner hull structure to the outer hull of FIG. 5C and FIG. 5D.
Figure 6B:
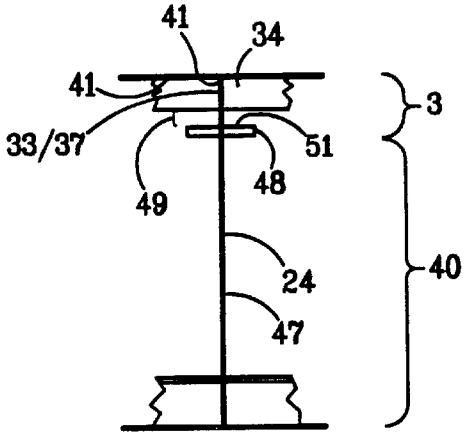
FIG. 6B is a detailed side view of the connection of FIG. 6A.

The outer framing members 22 typically include a first leg 47 and a second leg 48. The first leg 47 extends from the interior planar surface 8 of the outer shell plating 18 in a plane substantially perpendicular to the interior planar surface 8. The second leg 48 extends transversely in relation to the first leg 47 and forms a plane that is substantially parallel to the interior planar surface 8 of the outer shell plating 18. For example, FIGS. 6A and 6B show a typically outer transverse framing 24 that includes I-beam type framing wherein the first leg 47 is a web, and the second leg 48 is a flange. The outer longitudinal framing 23 typically includes angle bar type framing, as is conventional. The outer framing members 22 may comprise web frames which are not solid structures, but rather have passages (not shown) formed therein which allow the cargo or contents of a tank to flow through the web framing member.

FIGS. 2A, 2B, and 2C show dashed lines that illustrate preferred cut lines 25 for an exemplary single hull vessel 1 that will be rebuilt into a double hull vessel 5. The cut lines 25 show a preferred location for cutting and removing the existing internal vessel structure 7 from the existing single hull 1 in preparation for installing the new inner hull 6 inside the original outer hull 2 to form the double hull 4. As shown, a cut 25 is preferably made along the existing hull I around the perimeter of the cargo carrying section 12 (e.g., the top, bottom, sides, and ends of the cargo carrying section). As shown in FIGS. 2B and 2C, a cut 25*a* is preferably made in the topside plating 13 in an area above the cargo section 12 proximate the outer perimeter of the topside deck plating 13 (e.g., longitudinally along the port side 10, transversely along the forward end 26 of the cargo section 12, longitudinally along the starboard side 11, and transversely along the after end 27 of the cargo section 12). An opening is formed in the topside deck plating 13 once the cut out section of the topside deck plating is removed. As shown in FIGS. 2A and 2C, a cut 25*b* is also made proximate the outer port side plating 10, outer starboard side plating 11, and outer bottom plating 9, and along both the transverse 20 and the longitudinal 21 bulkheads. The cut 25*b* preferably follows the contour of the outer hull 2 and is made near the transverse 24 and longitudinal 23 framing of the outer hull 2. The cuts 25 are made using conventional techniques.

As shown in FIG. 2A, the cut internal vessel structure 7 is then removed from the outer hull 2 using conventional lifting techniques. Preferably, the internal vessel structure 7 is cut into a plurality of sections 7*a* to help facilitate removal of the internal vessel structure 7 from the shell of the outer hull 2, as shown in FIGS. 2A, 2B, and 2C. The internal vessel structure 7 may be cut into sections 7*a* in the longitudinal direction, the transverse direction, or both. The number of sections 7*a* that the internal vessel structure 7 is cut into is preferably predetermined taking into account several factors, including the type of vessel, the size of the vessel, a maximum number of sections that helps facilitate removal of the sections from the existing outer hull, the crane capacity for lifting, and a minimum number of sections that helps facilitate reinstallation of the sections back into the new inner hull. After the cut sections 7*a* are lifted out, the sections 7*a* are modified so that they may be reinstalled over and connected to the new inner hull 6. This modification of the removed internal vessel structure 7 is preferably performed off-site.

As shown in FIGS. 2A, 2B, and 2C, most of the topside decking 13 and internal vessel structure 7 of the cargo section 12 is cut and removed from the shell of the outer hull 2. FIG. 2C shows a simplified cross-sectional view of the midship cargo section 12 of the vessel 1, looking aft, and showing the configuration of the vessel prior to being cut apart. The left half is a section forward of a typical web frame while the right half is a section forward of a typical transverse bulkhead. FIG. 2C additionally shows schematically the placement of the external vessel structure 40, including the outer shell plating 18, the outer transverse framing 24, and the outer longitudinal framing 23. The external vessel structure 40 remains in place in the outer hull 2 in the area of the cargo section 12 after the cuts 25 have been completed. In addition, other ship systems (not shown) that run through or are contained in the cargo section 12 of the vessel 1 may be left intact, provided that they do not interfere with the installation of the new inner hull 6. The existing external structure 40 on the topside deck plating 13, outer bottom plating 9, and outer side plating 10, 11 of the vessel 1 that was cut and remains in place is adapted to receive and be connected to the new inner hull 6. This external vessel structure 40 is adapted using conventional techniques.

Figure 3:
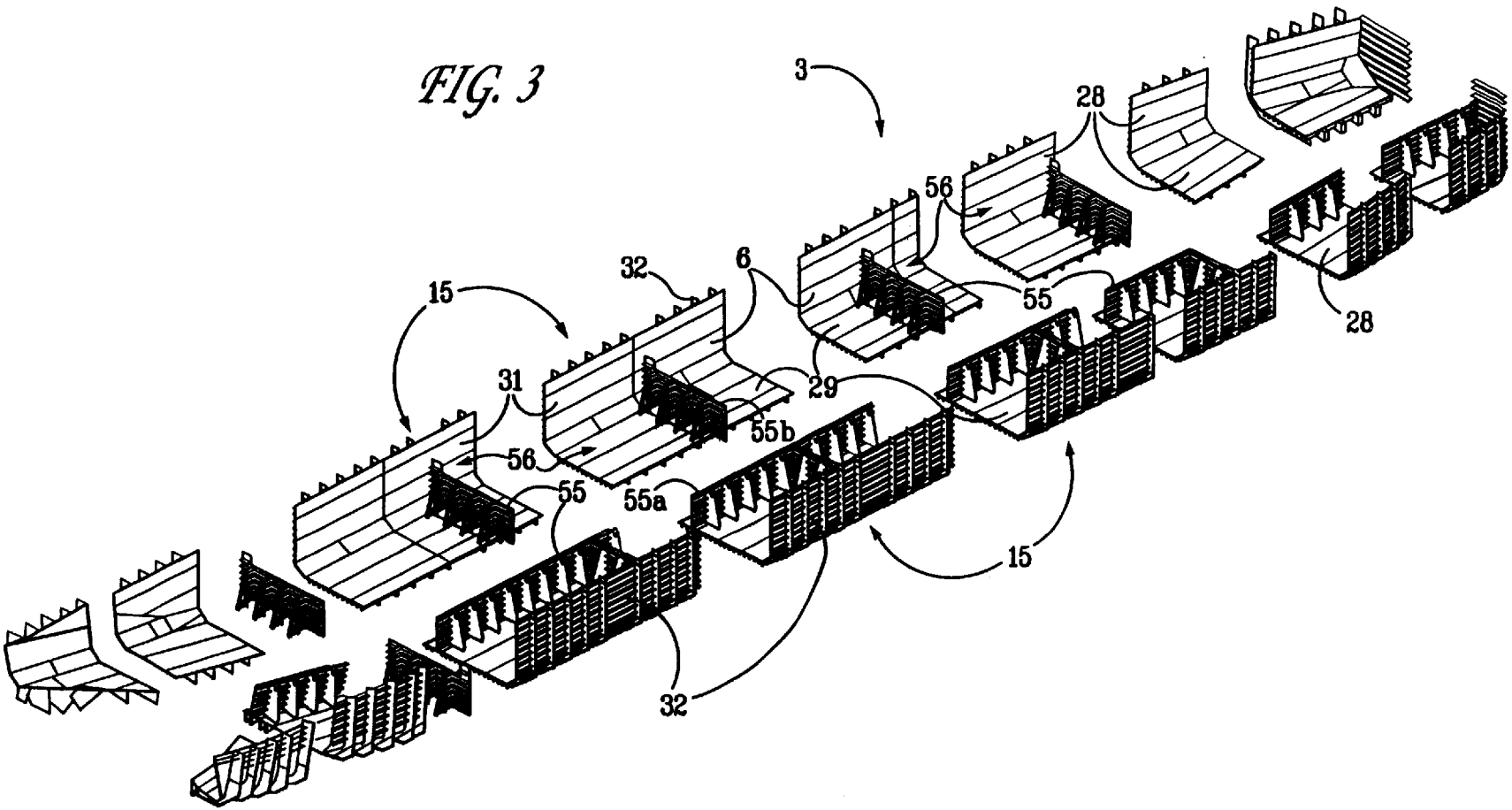
FIG. 3 shows a perspective, exploded view of an exemplary inner hull structure of the present invention.

FIG. 3 shows the new inner hull 6 that will be inserted inside the shell plating 18 of the outer hull 2 to rebuild an existing single hull vessel 1 into a double hull vessel 5. Once installed within the volume defined by the outer hull 2, the inner hull 6 defines an interior cargo carrying volume 12 and the outer hull 2 defines an exterior of the rebuilt vessel 5. The inner hull 6 includes an inner hull structure 3 including inner hull shell plating 28 and inner framing members 32. The inner shell plating 28 including inner bottom plating 29, inner port side plating 30, and inner starboard side plating 31. Preferably, the new inner hull structure 3 also comprises a plurality of inner framing members 32 that include a plurality of inner connecting members 33 and a plurality of inner stiffening members 34 that are disposed between the inner hull structure 3 and the outer hull 2. The inner hull structure 3 may also comprise lower bulkhead portions 55, as will be discussed further below. The new inner hull 6 is adapted to be disposed within and connected to the inside of the outer hull 2, adapted to receive the cut and removed internal vessel structure 7, and also to accommodate and fit up with existing shipboard systems and equipment (not shown). In addition, piping or equipment of various vessel systems (not shown) may be included on the new inner hull structure 3 as required.

The volume defined by the spaced apart area between the outer hull 2 and the inner hull 6 preferably forms a space 38 that may be used as tanks for the rebuilt double hull vessel 5, including ballasting tanks or the like. The new ballast spaces 38 may be used to optimize vessel trim and heel, to provide additional propeller immersion, or to minimize wind and weather sensitivity. Additionally, this feature has importance for single hull vessels 1 that carry segregated ballast. After a single hull vessel 1 having segregated ballast tanks has been rebuilt into a double hull vessel 5, the majority of the segregated ballast tanks may be converted to cargo tanks, thus increasing the cargo volume capacity. This increased cargo volume capacity results from the fact that space 38 created by the formation of the double hull 4 may serve as ballast tanks providing ample volume for ballast, and since the segregated ballast tanks are no longer necessary for the carrying of ballast, they may carry cargo.

Figure 4:
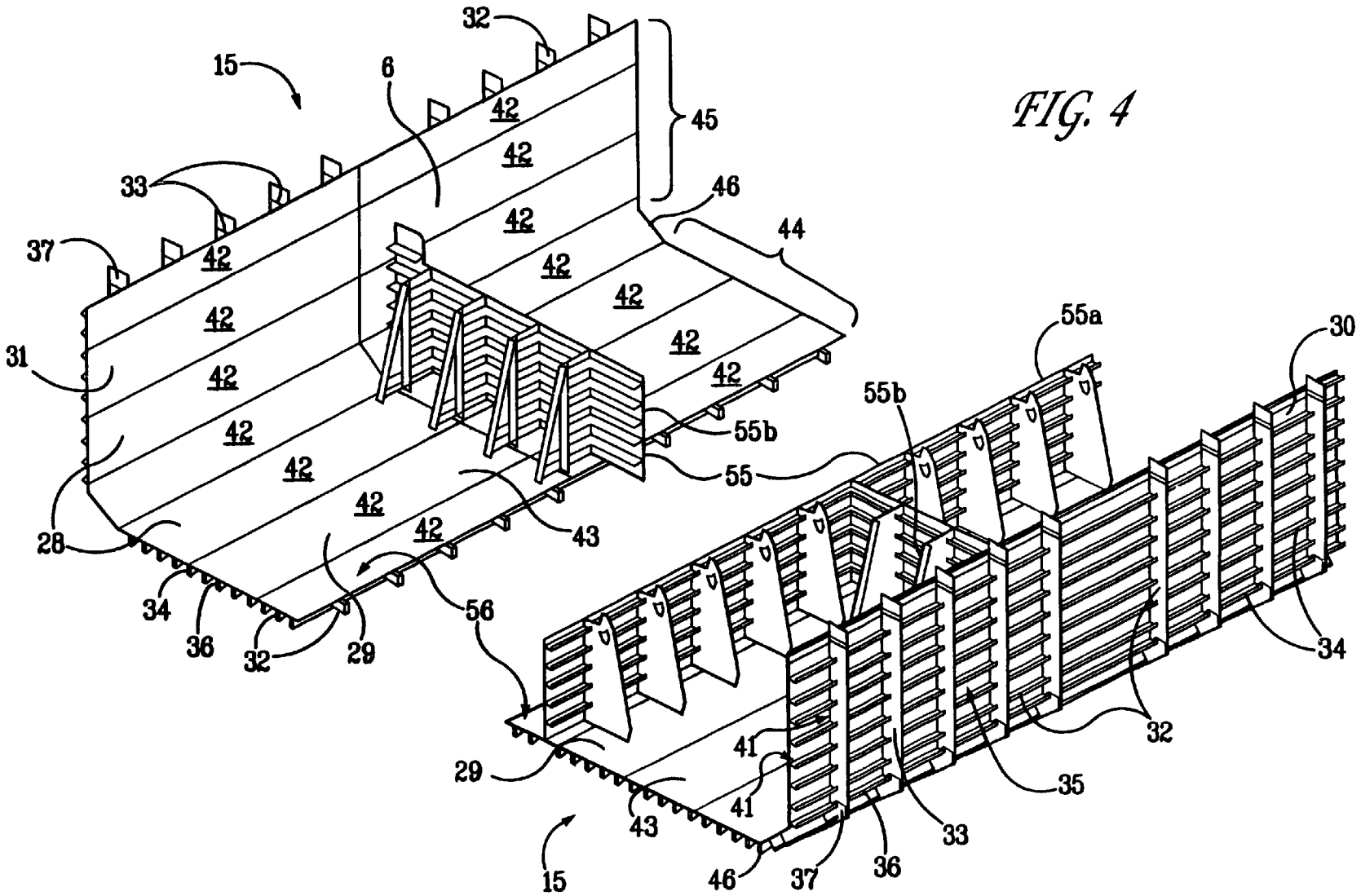
FIG. 4 shows a detail view of an exemplary port modular section and an exemplary starboard modular section of the inner hull structure of FIG. 3.

As shown in FIGS. 3 and 4, the new inner hull 6 is preferably constructed and installed as a plurality of prefabricated modular sections 15. These individual modular sections 15 are constructed at yard level, transported to the vessel 1, lifted into the interior of the outer hull 2, laid on top of the existing external vessel structure 40 that was left in place after the cut, aligned with the external vessel structure 40 that was left in place and adjacent modular sections 15, and integrated with the external vessel structure 40 and adjacent modular sections 15, as shown in FIGS. 5C, 6A, and 6B. The modular sections 15 of the new inner hull structure 3 are connected together and to the external vessel structure 40 by conventional techniques, preferably by welding. Prefabrication of the new inner hull structure 3 allows for a shorter rebuild or repair time and therefore the vessel is out of service for a shorter period of time.

As shown in FIG. 4, each new inner hull modular section 15 preferably includes a portion of inner bottom plating 29 and a portion of inner side plating 30, 31. In addition, each modular section 15 includes a plurality of inner framing members 32 extending from an exterior surface 35 of the inner shell plating 28 (e.g., the inner bottom plating 29, inner port side plating 30, and inner starboard side plating 31). The size of each modular section 15 is predetermined base on several factors, including the type of vessel, the size of the vessel, a maximum number of modules 15 that helps facilitate installation of the modules 15 into the volume of the existing outer hull 2, the crane lifting capacity, and a minimum number of modules 15 that helps facilitate the fitting up and welding of the modules 15 to the outer hull 2.

The inner bottom plating 29 and inner port and starboard side plating 30, 31 generally include a plurality of flat metal plate structures 42 having parallel planar surfaces. These individual flat metal plate structures 42 are coupled together to form a plurality of plate assemblies 43. The plurality of plate assemblies 43 include bottom plating assembly 44 and side plating assembly 45 that are connected together. The comer 46 formed at the connection of the bottom plating assembly 44 and side plating assembly 45 may form a right angle or preferably comprises a joint that is formed such that the bottom and side plating assemblies 44, 45 follow the general contour of the outer hull 2.

Temporary bracket members (not shown) may be used to hold the inner bottom plating 29 and the inner side plating 30, 31 constant in relation to one another during fitting and make-up of the new inner hull 6 to the existing outer hull 2. Once the inner hull structure 3 has been connected inside the outer hull 2, these temporary bracket members are cut off and removed.

Figure 5A:
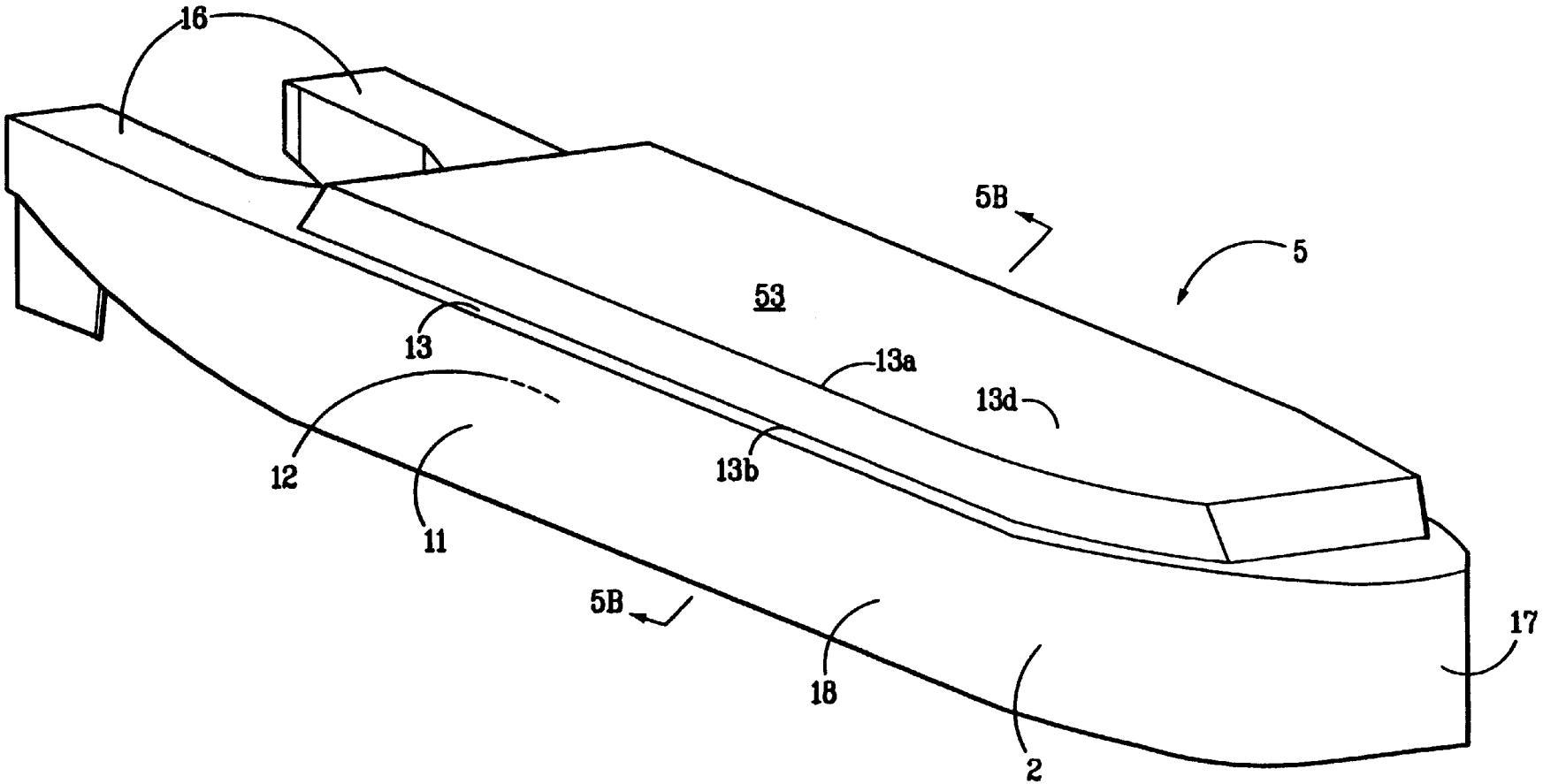
FIG. 5A is a perspective view of a rebuilt vessel having a double hull and a raised trunk structure according to the present invention.
Figure 5B:
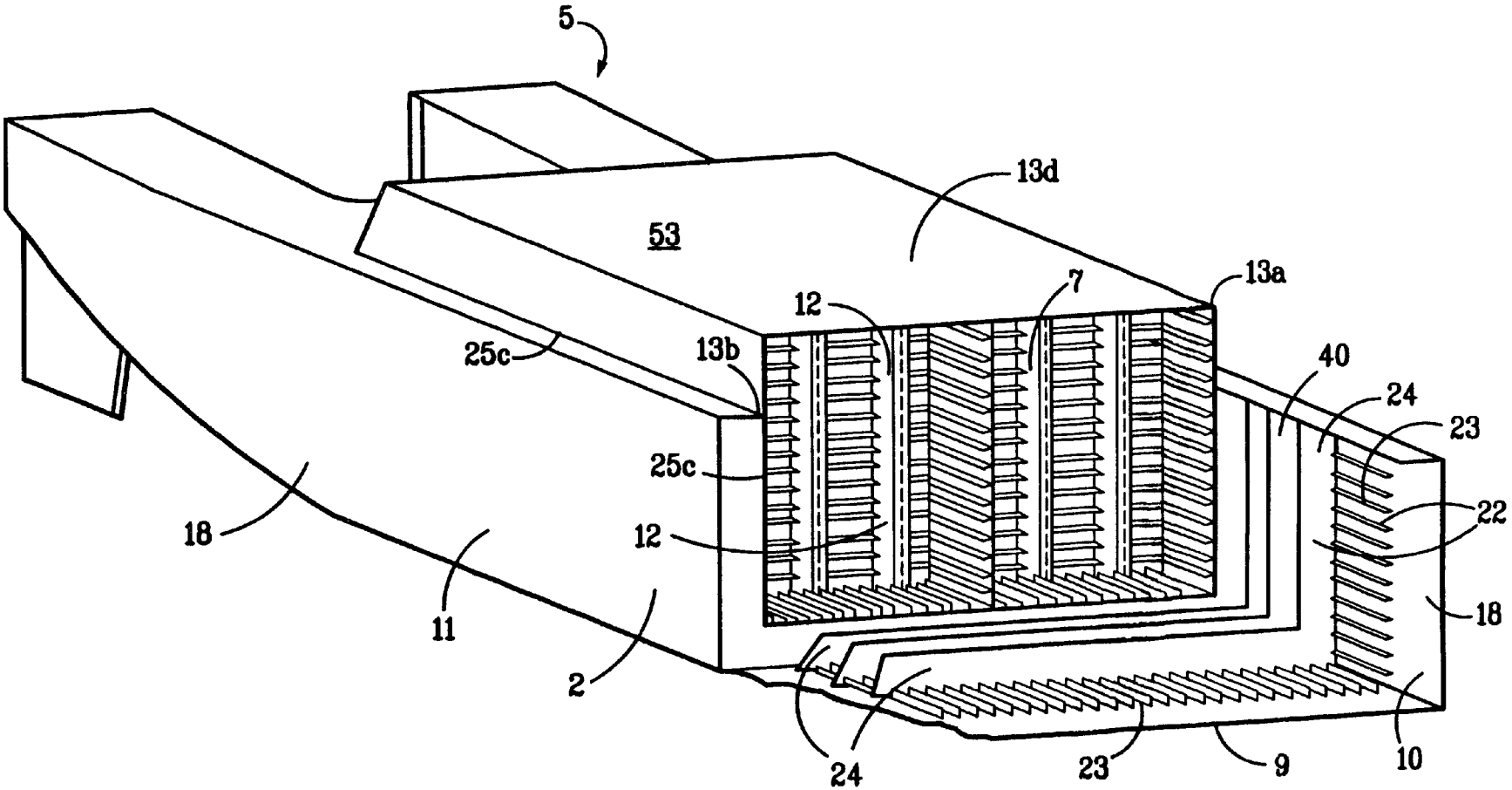
FIG. 5B is a perspective cross-sectional view taken along line 5B—5B of FIG. 5A.
Figure 5C:
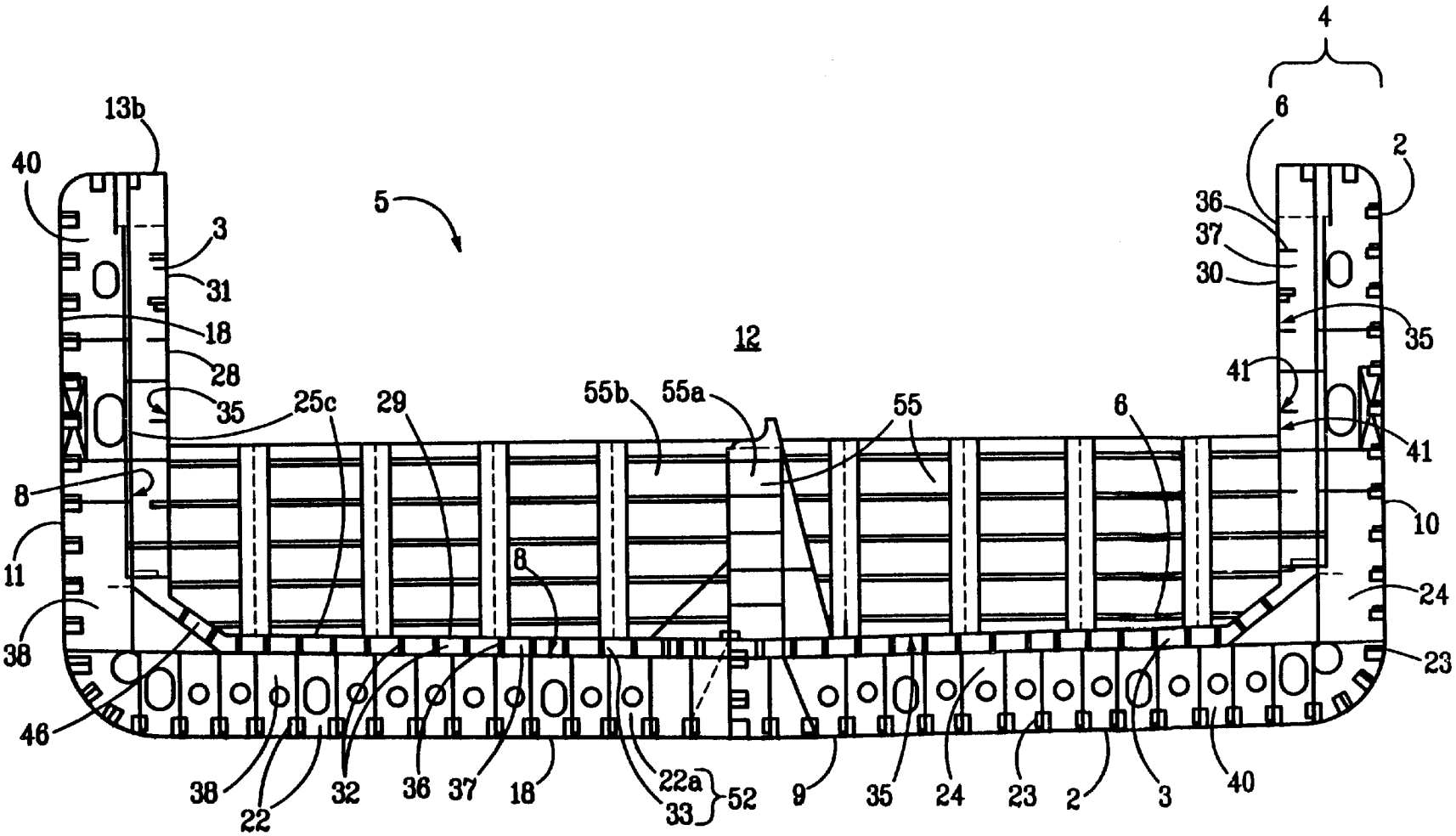
FIG. 5C is a cross-sectional detail view taken along line 5B—5B of FIG. 5A.
Figure 5D:
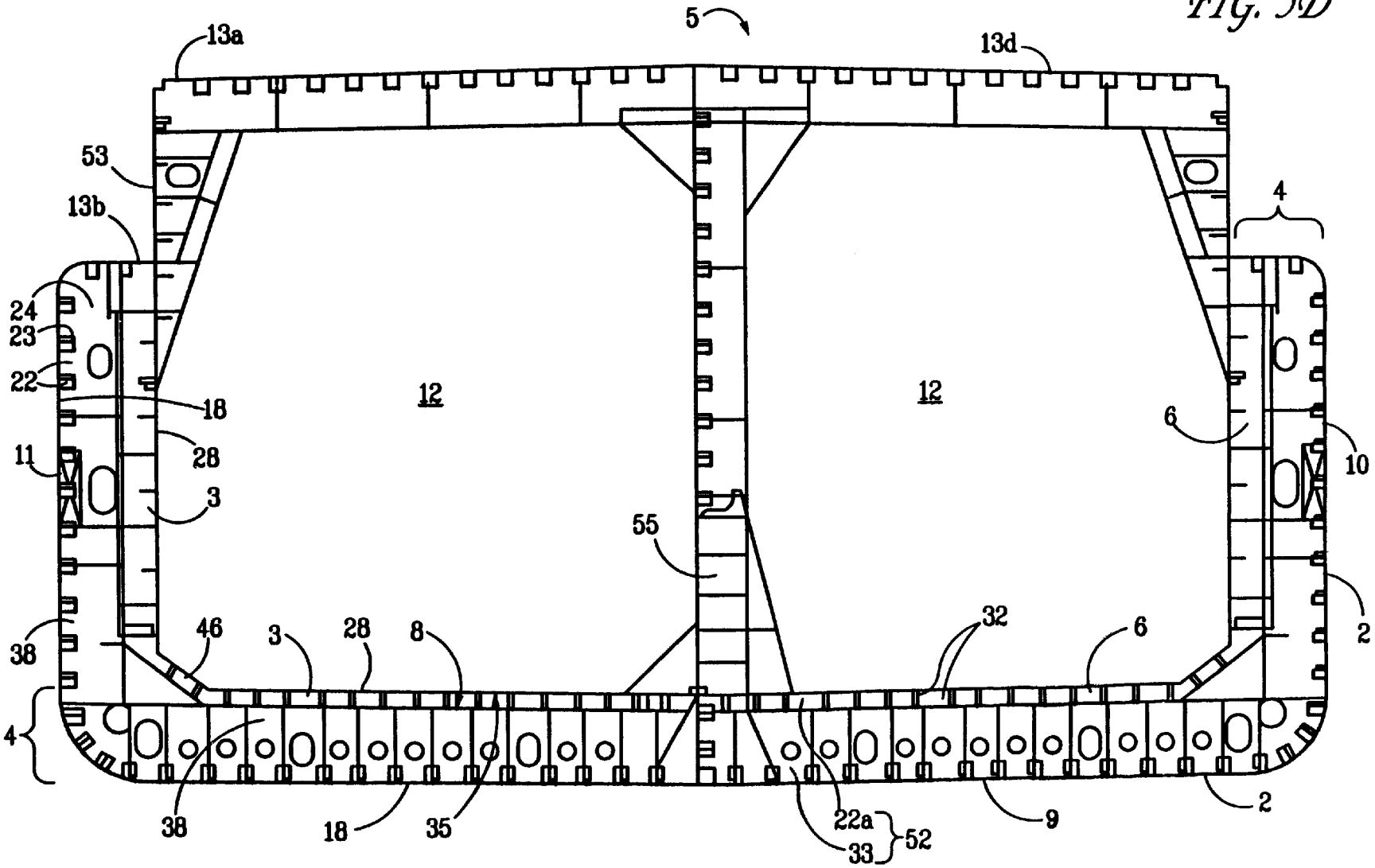
FIG. 5D is a cross-sectional view taken along line 5B—5B of FIG. 5A illustrating the inner hull structure of the new double hull and the raised trunk structure.

As shown in FIGS. 5C and 5D, a plurality of elongated inner framing members 32 are disposed between the spaced apart inner hull 6 and outer hull 2. As shown in FIGS. 3 and 4, the inner framing members 32 are preferably attached to the exterior surface 35 of the inner shell plating 28 in a parallel spaced relation to each other. Preferably, the framing members 32 are connected to and extend outward in a plane substantially perpendicular to a plane defined by the exterior surface 35 of the inner shell plating 28 (e.g., inner bottom plating 29, inner port side plating 30, and inner starboard side plating 31). Alternatively, the framing members 32 may be installed at a predetermined angle or comprise an energy absorbing type design.

As shown, the inner framing members 32 includes inner connecting members 33 that function to hold the inner hull 6 spaced apart from the outer hull 2, and inner stiffening members 34 that function to stiffen the planar surfaces of the inner bottom plating assembly 44 and the inner side plating assembly 45. Preferably, the inner framing members 32 include inner longitudinal frames 36 that run generally fore and aft, and inner transverse frames 37 that run generally port to starboard thereby forming a crisscross structure. An inner end 41 of each inner framing member 32 is coupled to the inner shell plating 28 using conventional techniques, such as welding.

In a preferred embodiment shown in FIGS. 6A and 6B, the inner longitudinal frames 36 are formed as continuous members and functions as the primary stiffener of the new inner shell plating 28. In this preferred embodiment, the inner transverse frames 37 includes a plurality of chocks 70 disposed between the longitudinal frames 36. The inner transverse frames 37 are laid onto and fitted to the outer transverse frames 24 of the outer hull 2. The distal ends 51 of the inner connecting members 33 are coupled to the outer transverse framing 24 by conventional welding techniques.

As shown in FIGS. 6A and 6B, a gap 49 is preferably formed at the location between where the distal ends 51 of the inner connecting members 33 (inner transverse framing 37) land on the second legs 48 of the outer transverse framing 24 and the distal end 50 of the inner stiffening members 34 (inner longitudinal framing 36) of the new inner hull 6. This gap 49 assists the fitting up and welding of the new inner hull structure 3 to the existing external hull structure 40 with improved efficiencies. For example, the gap 49 allows for the use of automated processes for connecting the inner hull structure 3 to the outer hull 2. Preferably, the gap 49 is formed by the inner transverse frames 37 of the new inner hull 6 extending a greater distance from the exterior side 35 of the inner shell plating 28 than the inner longitudinal frames 36 extend therefrom. The distal ends 51 of the inner transverse frames 37 are coupled to the second legs 48 of the outer transverse frames 24 of the existing outer hull 2 using conventional techniques.

The cut out section of topside deck plating 13*a* and internal vessel structure 7 that was cut and removed is adapted to be re-installed and connected to the new inner hull 6 and the cut portion of the topside deck plating 13*b* that was left in place defining an opening in the topside decking. The topside deck plating 13*a* and internal vessel structure 7 that was cut and removed may be adapted such that the topside deck plating 13*a* that was cut and removed is reconnected to the cut topside deck plating 13*b* that was left in place, forming a rebuilt topside deck that is substantially the same as the topside deck 13 of the original single hull vessel 1, or preferably, a new trunk structure 53 is added extending between the cut 25*a* in the topside deck plating 13*b* that was left in place and the topside deck plating 13*a* that was removed, resulting in a raised deck 57, as shown in FIGS. 5A, 5B, and 5D.

As shown in FIG. 5A the new double hull 4 extends at least the length of the cargo carrying section 12. FIG. 5B shows a cut-away perspective view of the new double hull 4 at the midship cargo section 12. FIG. 5B and 5C illustrate how the new inner hull 6 is inserted within the volume defined by the outer shell plating 18 of outer hull 2, and also shows the outer framing members 22, the inner framing members 32, and the connection of the inner hull structure 3 to the outer hull 2. The inner hull 6 defines an interior cargo carrying volume 12 and provides a secondary boundary in the event that the outer hull 2 is penetrated.

As shown in FIG. 5C, the inner hull structure 3 is inserted within a volume defined by the outer shell plating 18 of the outer hull 2, spaced apart from the outer hull 2 to form a double hull 4. Connecting members 52 connect the inner hull 6 to the outer hull 2 in a spaced apart relationship. Preferably, connecting members 52 include outer connecting members 22*a* and inner connecting members 33. In a preferred embodiment, outer connecting members 22*a* comprise the outer transverse framing 24 of the outer hull 2 and the inner connecting members 33 comprise the inner transverse framing 37 of the inner hull 6. The new inner hull structure 3 is inserted internally within the existing outer framing 22 of the outer hull 2. As shown, the inner transverse framing 37 extending from the exterior surface 35 of the inner hull 6 is coupled to the outer transverse framing 24 extending from an interior surface 8 of the outer hull 2. Preferably, the framing members on the bottom are laid together and the framing members on the sides are lapped or butted together. The connecting members 52 are designed to hold the inner hull 6 in a spaced apart relationship with the outer hull 2 and to withstand normal hydrostatic loads (e.g., the pressures of the cargo inside the double hull 4 and the pressures of an operating environment, such as the sea, on the exterior of the double hull 4).

Alternatively, the inner hull structure 3 and connecting members 52 may also comprise a curved plate design, a transversely framed design, transverseless framed design, an energy absorbing design, or any other suitable hull design as known in the art.

FIGS. 5A and 5B show an exemplary double hull vessel 5 rebuilt in accordance with the present invention. The removed internal vessel structure 7 and topside deck plating 13 is reinserted and coupled to the new inner hull 6 and the remaining external vessel structure 40 by conventional techniques, preferably by welding. Weld joints 25*c* join the inner hull 2 to the outer hull 2. The weld joints 25*c* illustrate where the inner hull structure 3, the removed internal vessel structure 7 and topside deck plating 13 are reconnected to the remaining external vessel structure 40. The location of the weld joints 25*c* essentially coincide with the cut lines 25*a* and 25*b*.

As illustrated in the embodiment shown in FIGS. 5A and 5B, the new double hull vessel 5 may include a new trunk structure 53 and raised deck 13*d*. FIG. 5D shows a cross-section taken amidship in the cargo carrying section 12 of the double hull vessel 5. In this preferred embodiment, a trunk structure 53 is added to the internal vessel structure 7 and topside deck plating 13*a* that is removed from the vessel 1. Preferably, the trunk structure 53 is connected to the peripheral edge of the cut out section of topside deck plating 13*a* that was removed. The trunk structure 53 is employed to minimize any loss in the cargo carrying capacity of the vessel. The trunk structure 53 is connected along and extends between the cut line 25*a* around the outer peripheral of the cut out section of topside deck plating 13*a* that was removed and the outer peripheral edge of the opening defined by the topside deck plating 13*b* that was left in place. The trunk structure 53 and raised deck 13*d* define an additional volume of the cargo carrying volume 12. The height of the trunk structure 53 is determined by the desired cargo carrying capacity for the vessel 5. Preferably, the trunk structure 53 is sized to compensate for the height of the new inner hull 6 so that no loss in cargo carrying capacity results. In this way, the cargo carrying capacity of the double hull vessel 5 remains substantially the same as it was when the vessel was a single hull vessel 1.

Figure 7:
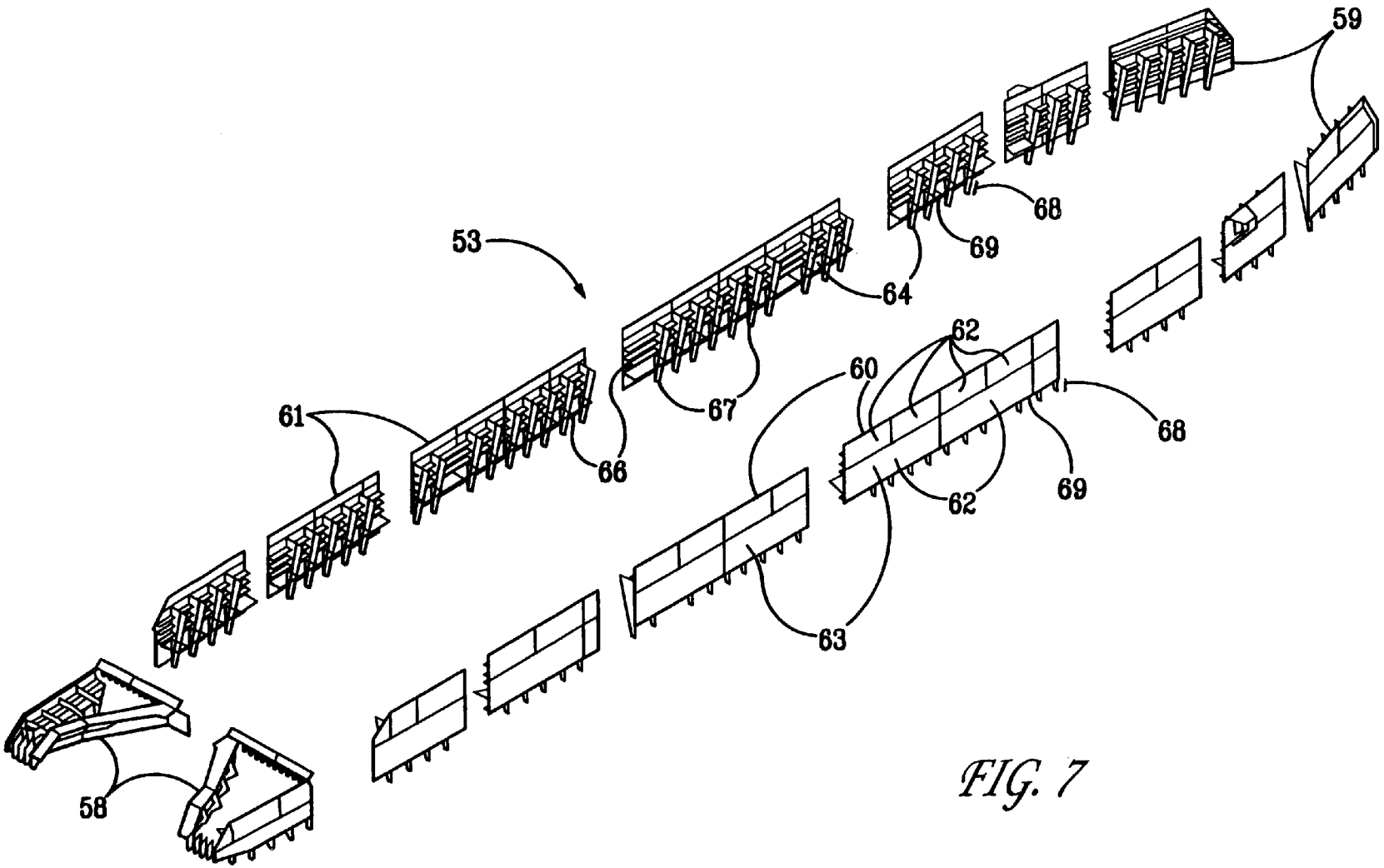
FIG. 7 is a perspective, exploded view of the bulkheads that form the trunk structure.

As shown in FIG. 7, the trunk structure 53 includes a forward trunk bulkhead 58, an after trunk bulkhead 59, a port trunk bulkhead 60, and a starboard trunk bulkhead 61. The trunk bulkheads 58, 59, 60, 61 generally include a plurality of flat metal plate structures 62 having parallel planar surfaces. These individual flat metal plate structures 62 are coupled together to form a plurality of plate assemblies 63. These plate assemblies are coupled together to form each bulkhead 58, 59, 60, 61.

Figure 8:
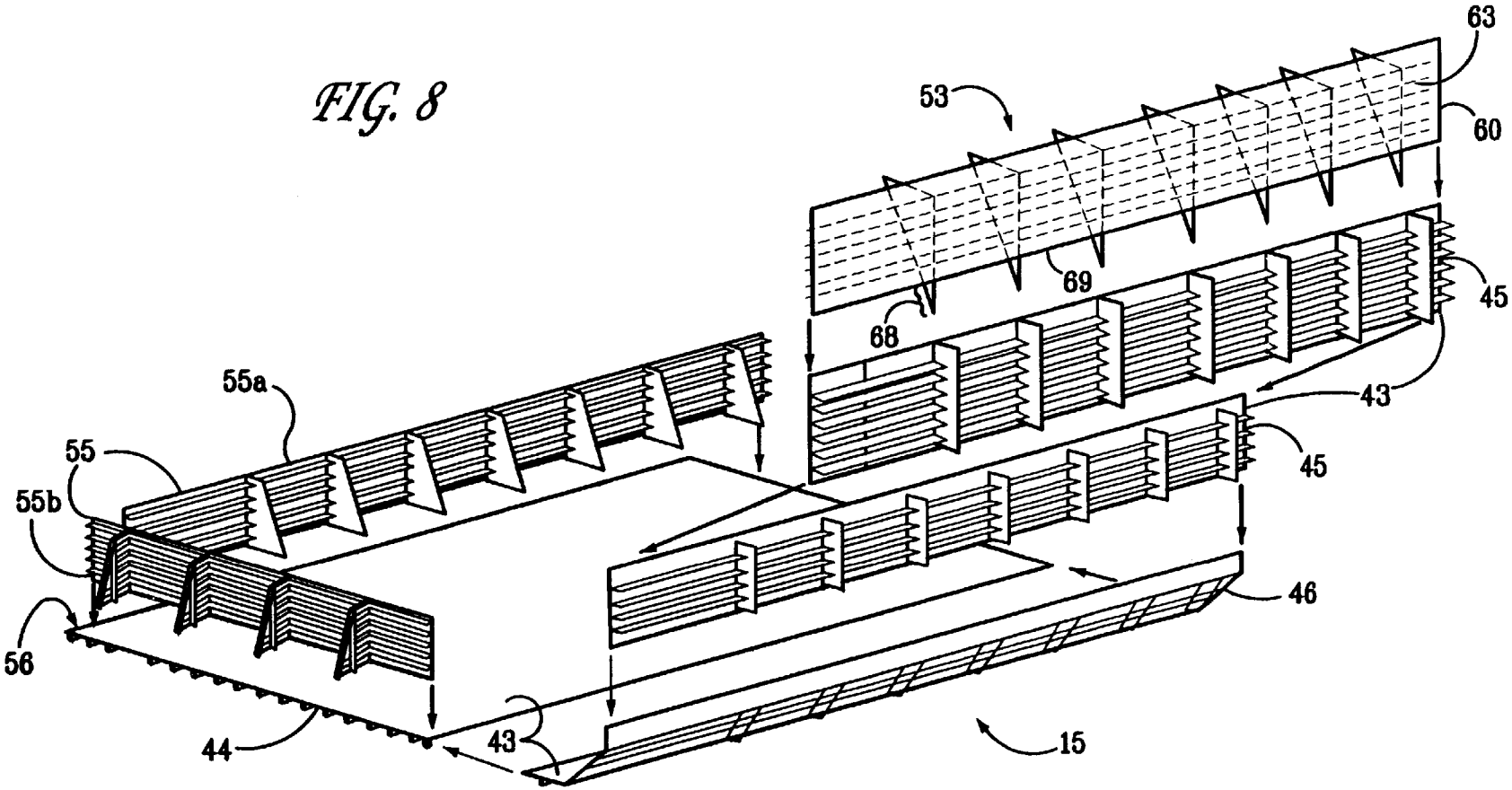
FIG. 8 is an exploded view showing the various plate assemblies.

Trunk framing members 64 are disposed along an inside surface 65 of each trunk bulkhead 58, 59, 60, 61. The trunk framing members include trunk stiffening members 66 and trunk connecting members 67. Preferably the trunk stiffening members 66 comprise longitudinal framing and the trunk connecting members 67 comprise transverse framing. The trunk connecting members 67 are preferably constructed such that at least a portion 68 of each trunk connecting members 67 extends beyond a bottom edge 69 of the trunk structure 53. This provides a stronger connection of the trunk structure 53 to the topside deck plating 13 and new inner hull 6 because the connection extends across the weld line 35*c*, as shown in FIGS. 7 and 8. The bulkheads of the trunk structure 53 are constructed using conventional bulkhead construction techniques.

The trunk structure 53 and raised deck 13*d* may be prefabricated as a single unit, or as a plurality of sections. Preferably, the existing topside deck plating 13*a* that was cut away and removed is used to form the raised deck 13*d* portion of the new trunk structure 53. The existing topside deck plating 13*a* that was cut and removed may be set into an erection building or the like and temporary supports used to elevate the deck plating 13*a* while the trunk structure 53 is connected to the outer peripheral of the deck plating 13*a*. The trunk structure 53 is then installed over the inner hull 6 and topside deck plating 13*b* that was left in place.

Referring back to FIGS. 3 and 4, where a new trunk structure 53 is employed, the inner hull structure 3 also includes new bulkhead portions 55. These new bulkhead portions 55 compensate for the added height resulting from the raised deck 13*d* and trunk structure 53. The new bulkhead portions 55 may be formed separate from and then coupled to the inner hull 6, or preferably the new bulkhead portions 55 are formed integral with the inner hull structure 3.

Preferably, the bulkhead portions 55 are disposed on the interior surface 56 of the inner hull structure 3 as lower bulkhead portions and extend upward to form lower portions of the rebuilt bulkheads 20, 21. This is advantageous because these lower bulkhead portions 55 may be constructed to be more robust than the existing bulkhead 20, 21 structure thereby providing additional strength to support the extra loads due to the trunk structure 53 and the higher level of the raised deck 13*d*. Accordingly, the existing longitudinal and transverse bulkheads 23, 24 are removed with the topside deck plating 13*a* as part of the internal vessel structure 7 so that the stronger, lower portions 55 may be added with the new inner hull structure 3. Alternatively, it is possible to modify the existing bulkhead structure 20, 21 to make it stronger to support the new raised deck and trunk structure 53, or to add the new bulkhead portions at the top of the existing bulkheads to form upper bulkhead portions of the rebuilt bulkheads 20, 21.

Bulkhead portions 55 may comprise one or more longitudinal bulkhead portions 55*a* and/or one or more transverse bulkhead portions 55*b* depending on the design of the existing single hull vessel 1 being rebuilt. The height of that the lower bulkhead portions 55 is preferably substantially the same as the height of the raised deck and trunk structure 53. The bulkhead portions 55 are constructed using conventional techniques for bulkhead designs.

Figure 9:
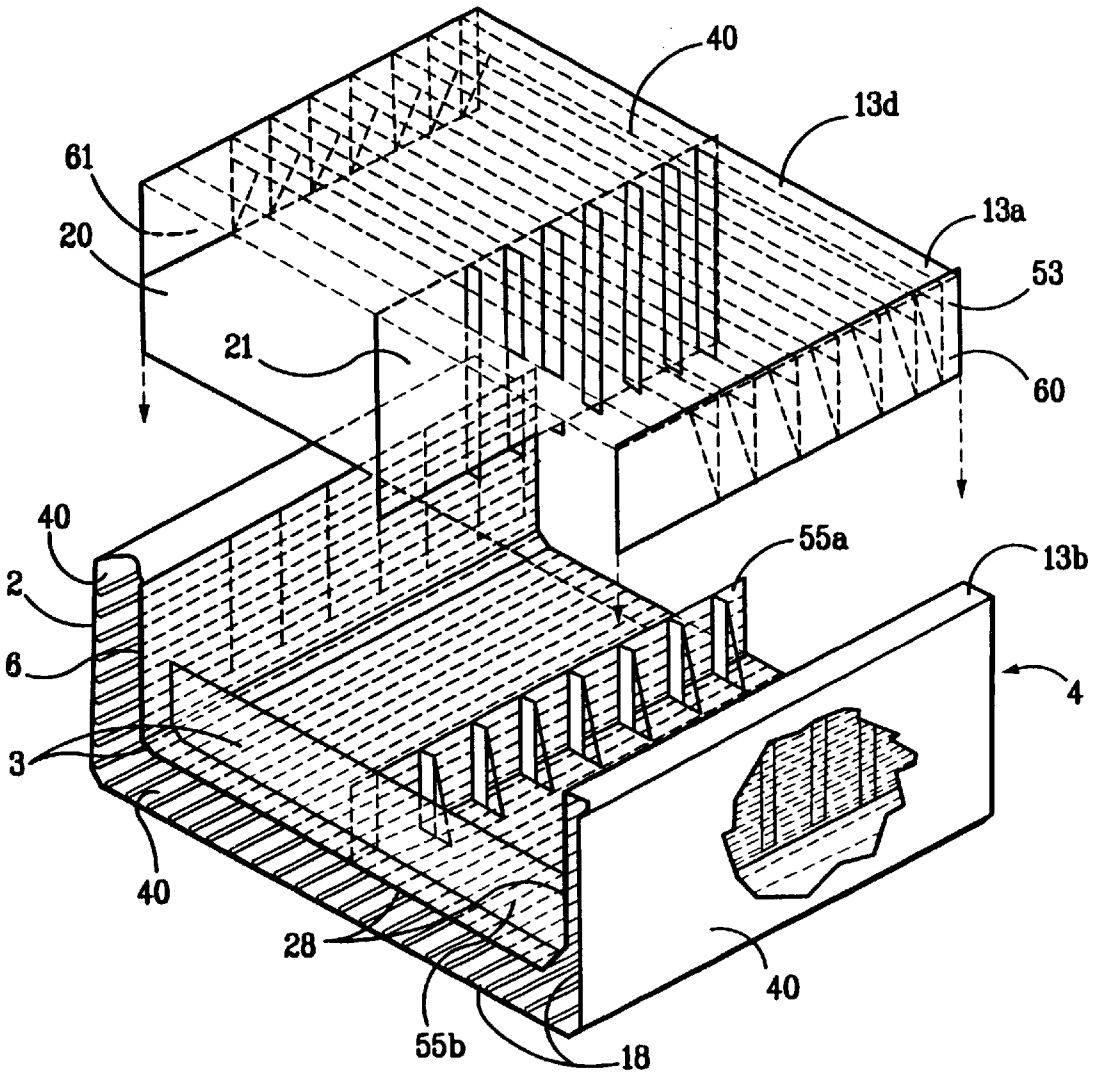
FIG. 9 is an exploded, midship sectional view showing the new double hull, trunk structure and raised deck.
Figure 10:
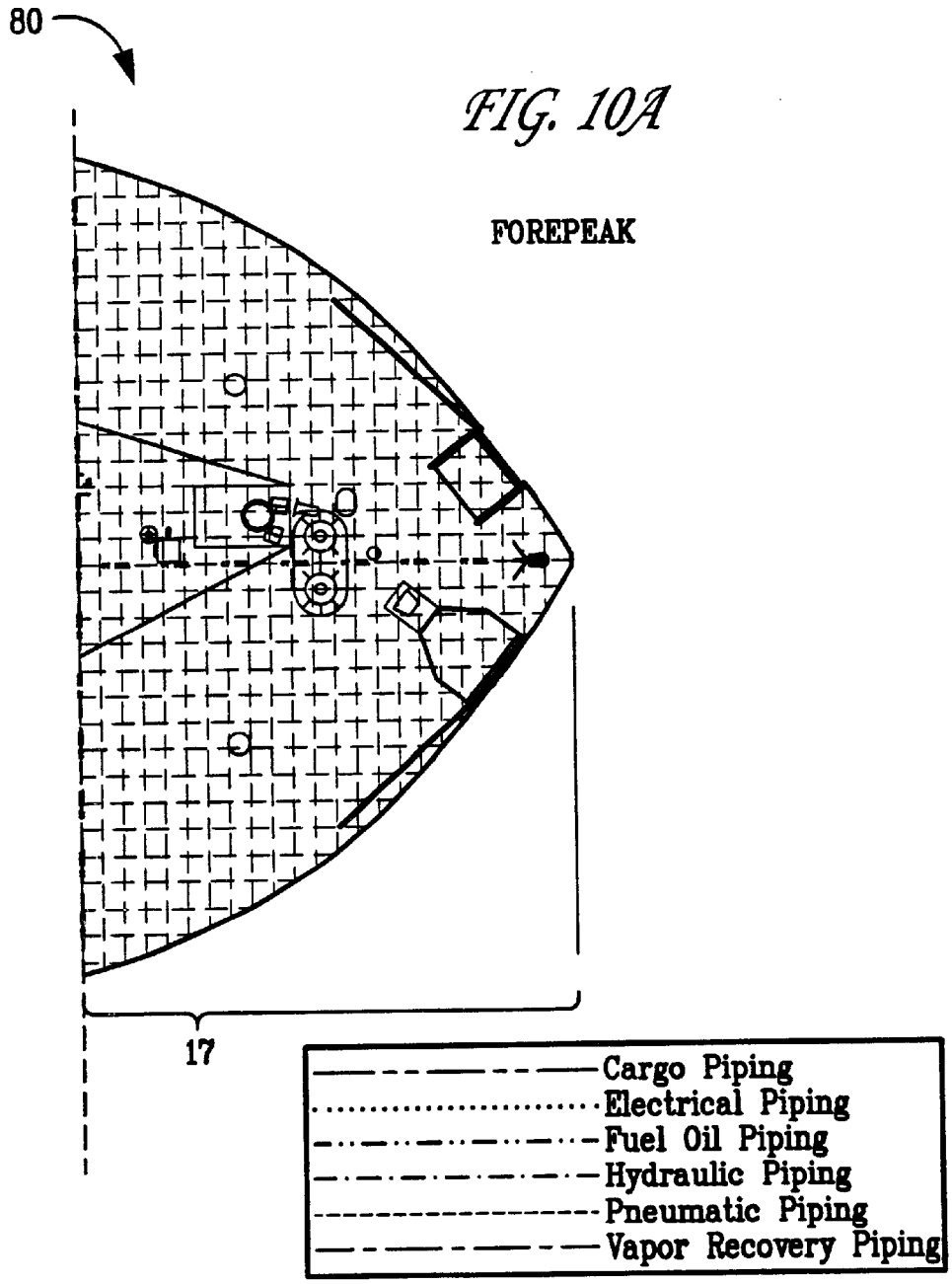
FIGS. 10A–10H show an exemplary deck arrangement and equipment layout for an exemplary existing single hull vessel which is a candidate for the internal double hull rebuild using the improved fit-up techniques of the present invention.
Figure 10B:
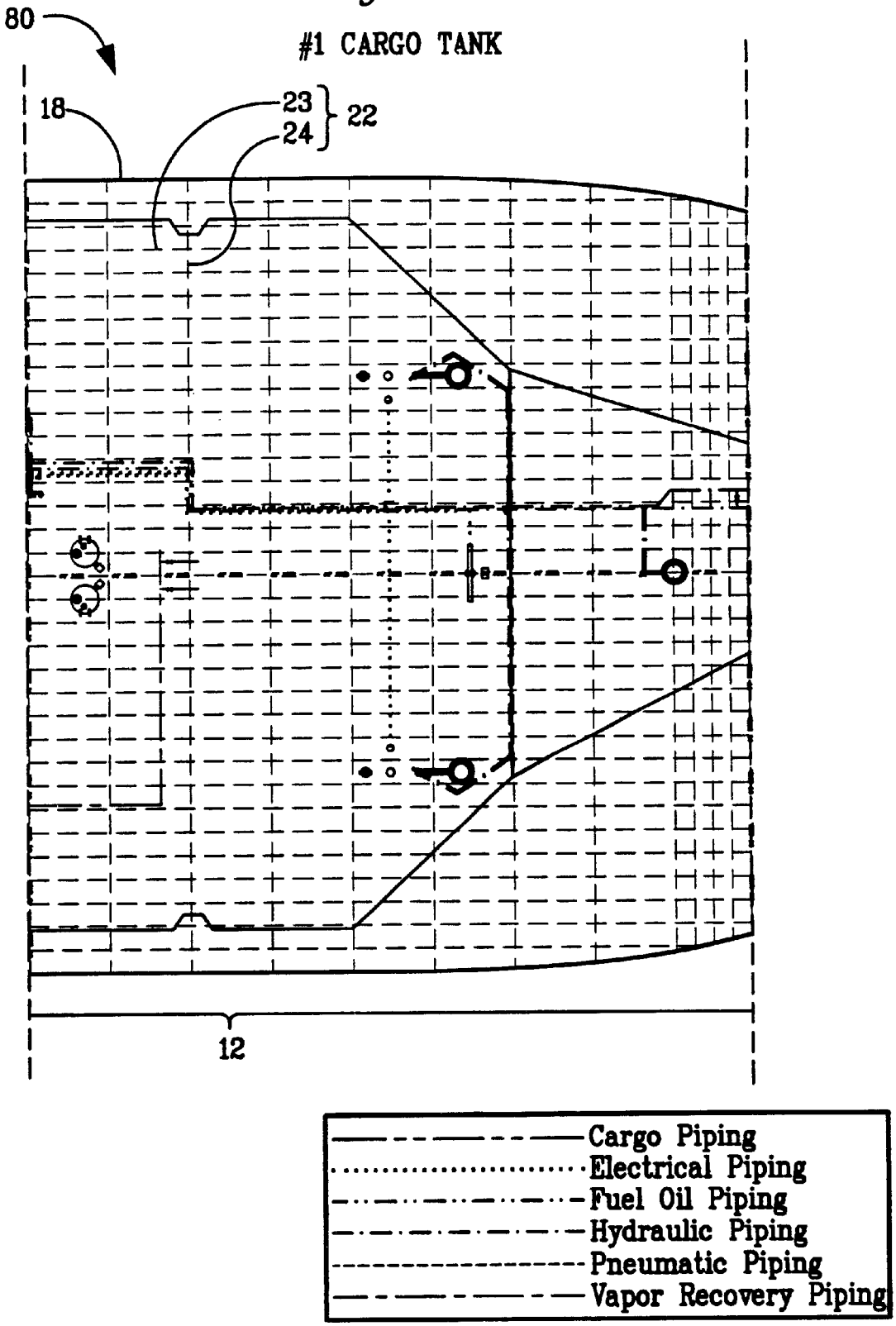
Figure 10C:
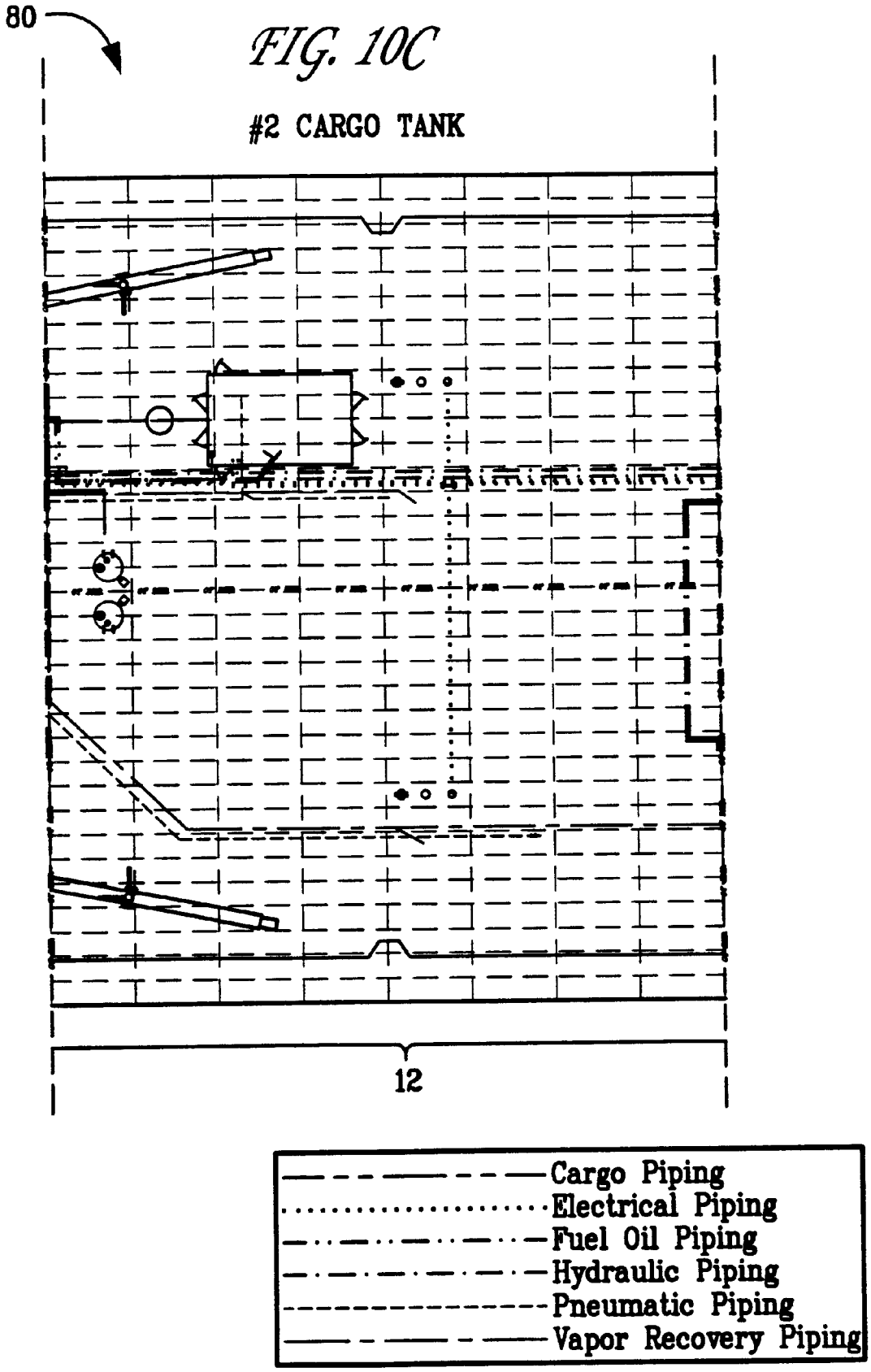
Figure 10D:
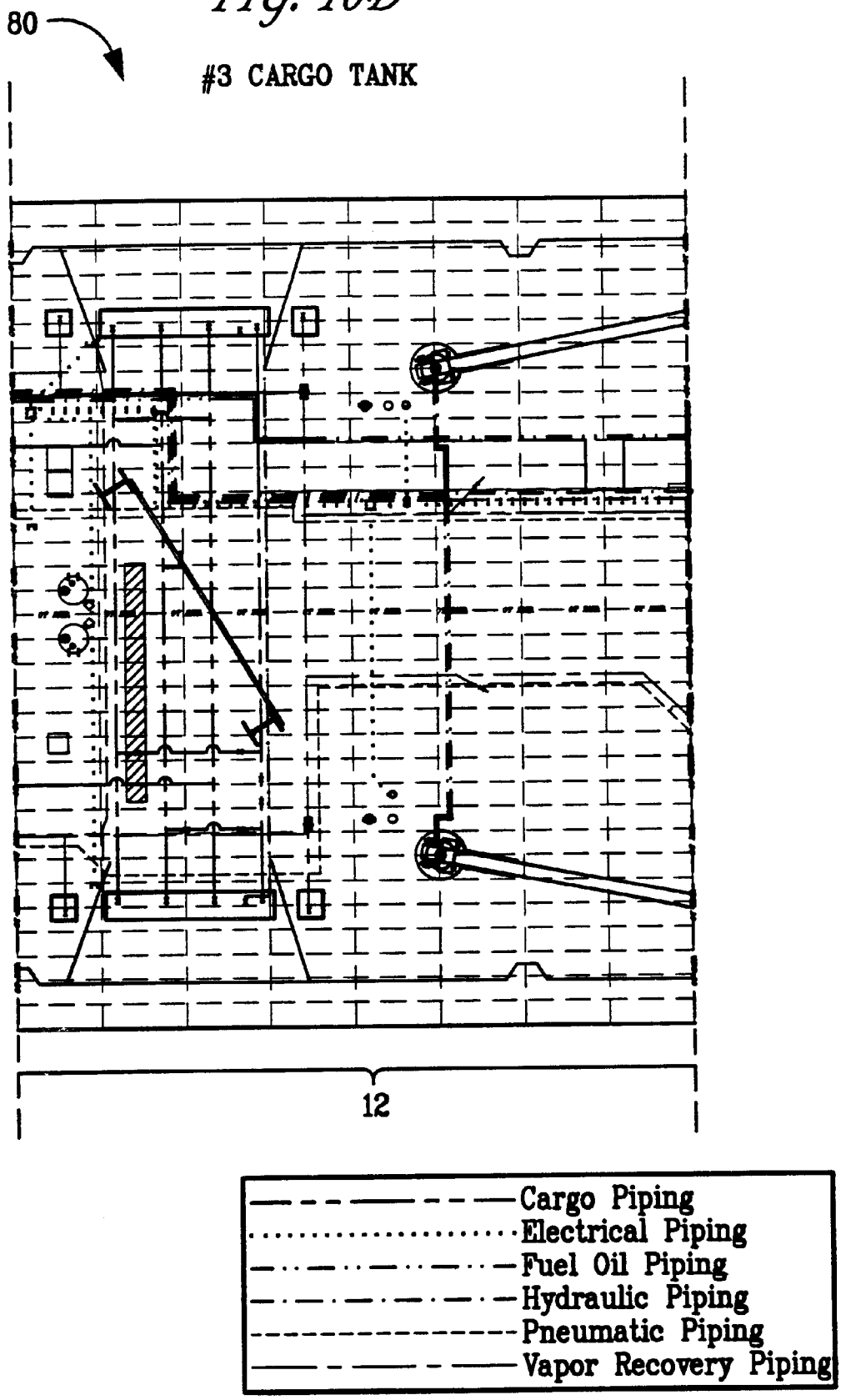
Figure 10E:
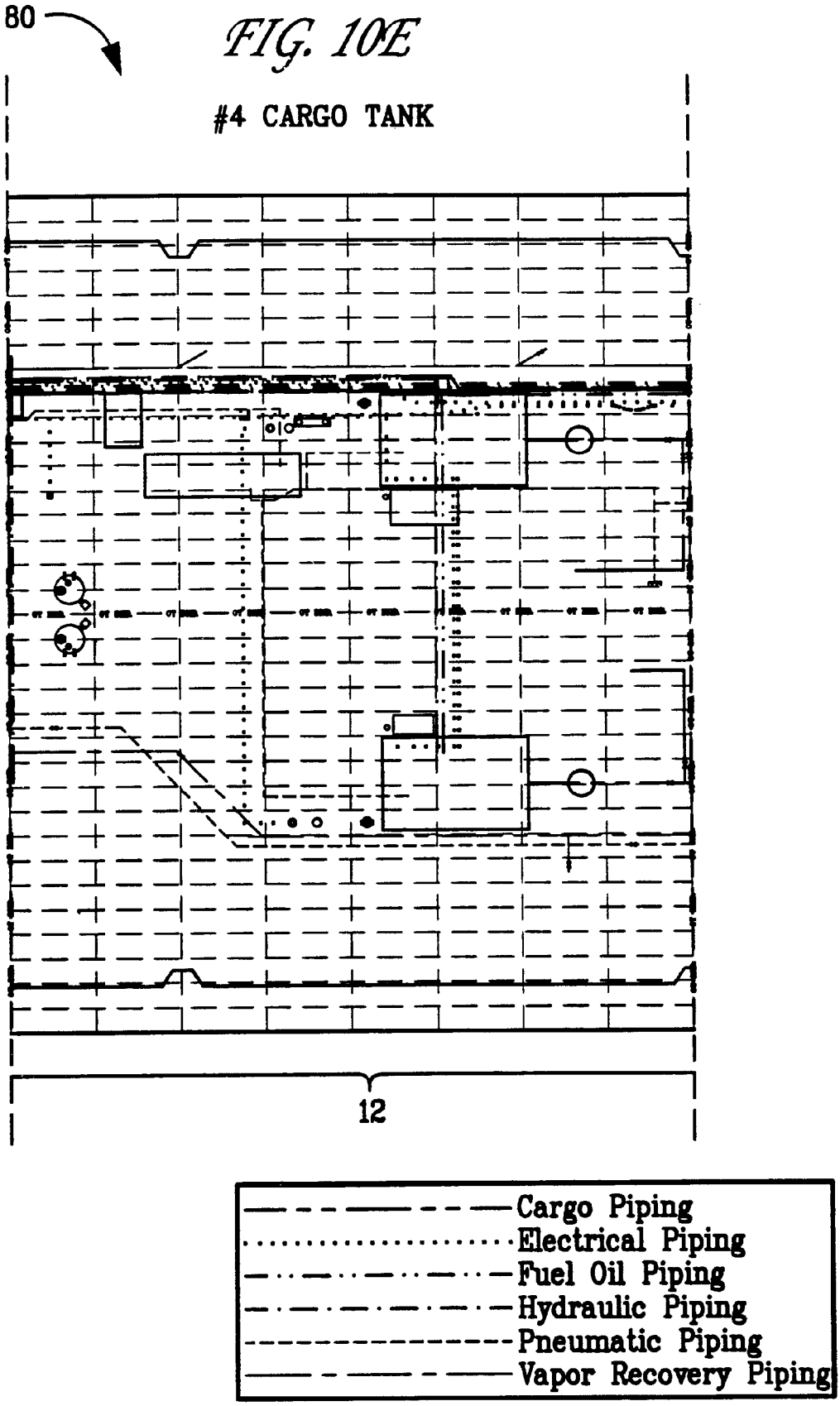
Figure 10F:
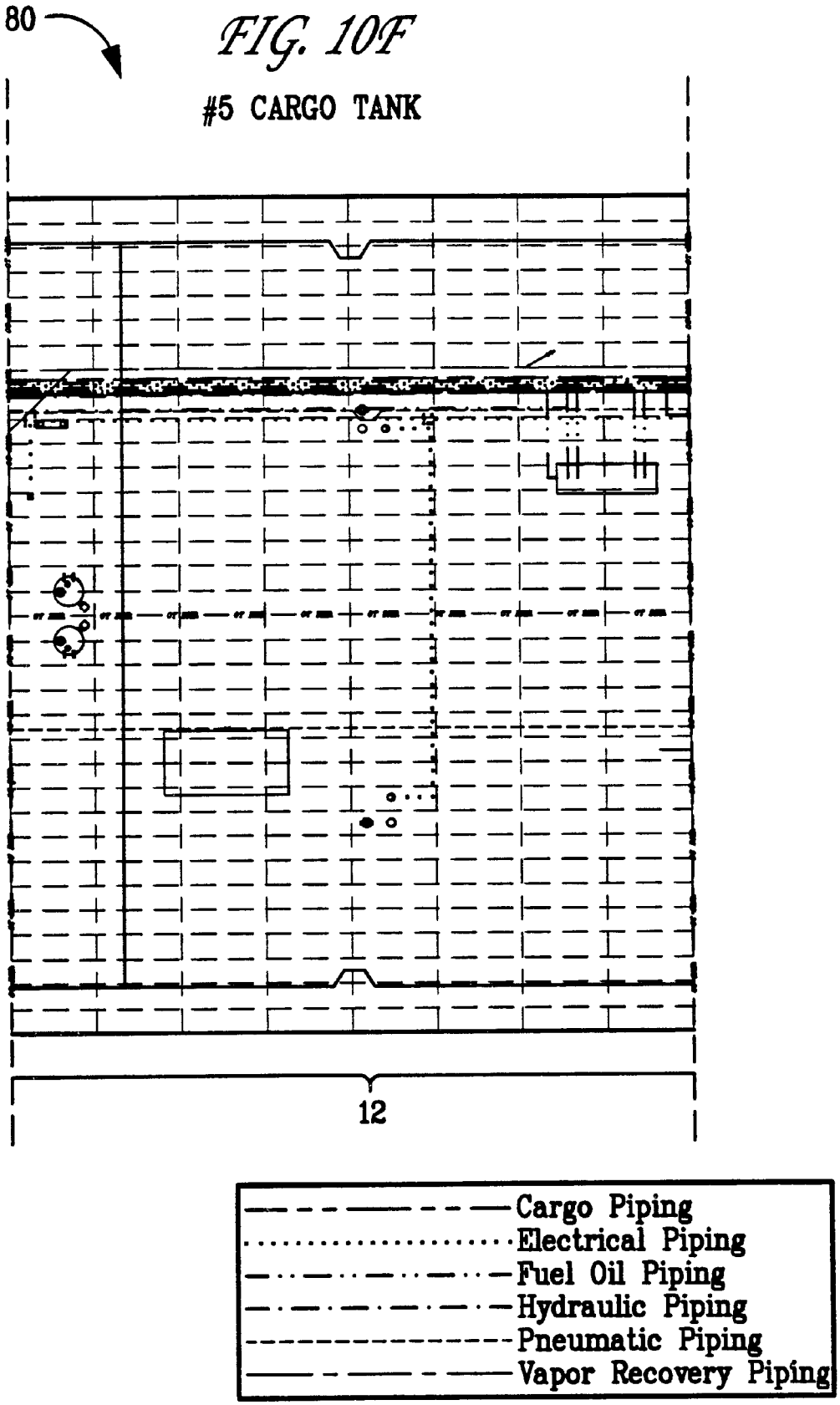
Figure 10G:
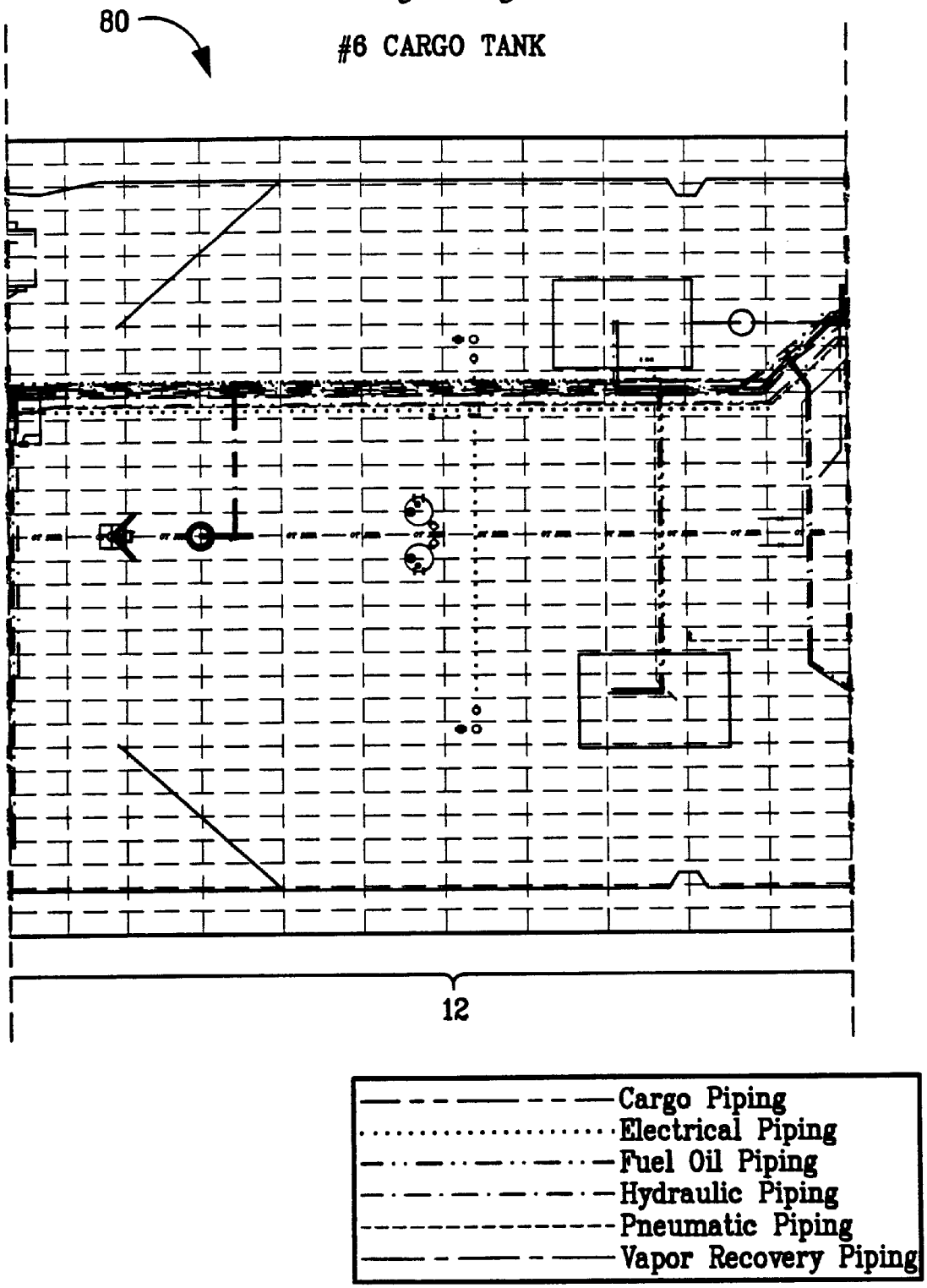
Figure 10H:
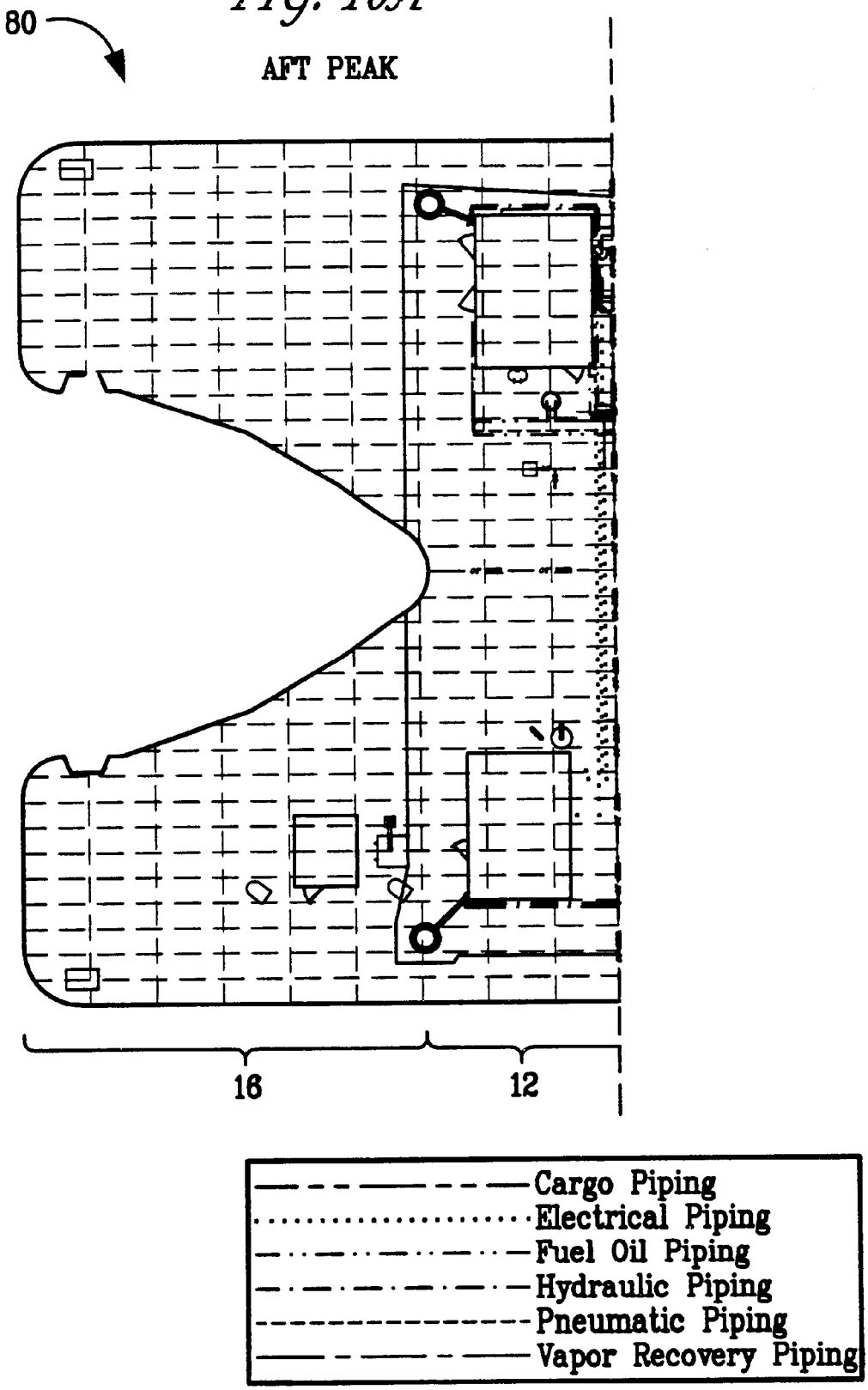

FIG. 8 illustrates an exemplary process of how the various plate assemblies are connected together. The corner 46 plate assembly is coupled to the bottom plate assembly 44. One or more side plate assemblies 45 is coupled to the comer 46 plate assembly, and the trunk side plate assembly 60 is coupled to the upper side plate assembly 45. Lower bulkhead portions 55, including longitudinal bulkhead portions 55*a* and transverse bulkhead portions 55*b*, are coupled to an interior surface 56 of the inner hull 6. FIG. 9 shows a midship sectional of how the trunk structure 53 and raised deck 13*d* fit over the completed double hull 4.

The present invention also provides a method of vessel construction, and particularly, a method of internal double hulling of an existing single hull vessel. The method of the present invention, generally comprises the steps of:

1. Cutting the existing internal structure 7 of the existing single hull vessel 1 proximate the outer bottom 9, outer port side 10, and outer starboard side 11 of the outer hull 2 up to and including the main or topside deck plating 13 along the port 10 and starboard 11 sides and along the stern 16 and bow 17 areas of the vessel 1 (e.g., around the perimeter of the cargo carrying section 12). Preferably the internal structure 7 is cut into one or more sections 7*a* to facilitate the removal of each the sections 7*a* of internal structure 7. Also, the cut lines 25 are preferably made so that the existing hull outer longitudinal framing 23 and outer transverse framing 24 is left in place on the outer bottom 9 and outer sides 10, 11 of the existing outer hull 2.
2. Lifting the cut sections 7*a* out of the shell plating 18 of the existing outer hull 2. Preferably these cut sections 7*a* are lifted from a point of attachment proximate the main deck 13 area and are lifted up and out of the existing hull outer shell 18 or skin. After these cut sections 7*a* of existing internal structure 7 have been removed, they may either be repaired and/or refurbished in place or preferably at a separate repair facility.
3. Prefabricating the new inner hull structure 3. The shape of the new inner hull 6 generally conforms to the shape of the existing outer hull 2 and the inner hull 6 is adapted for connection to the existing external hull structure 40 that was left in place after the cuts.

Preferably, the new inner hull structure 3 is prefabricated in a plurality of modular sections 15 to help facilitate lifting, installation, and fitting of the new inner hull 6 to the existing outer hull 2 structure. Preferably, the new inner hull modules 15 are fabricated from a plurality of flat metal structures 42 or steel plates that are cut and welded to form a plurality of plate or panel assemblies 43. The plurality of panel assemblies 43 are then connected to form bottom plate assemblies 44 and side plate assemblies 45 of the modules 15. The new modules preferably comprise a plurality of flat sheets of metal 42 that are integrated and coupled together to form the new inner hull shell plating 28. Inner transverse 37 and inner longitudinal 36 framing members are coupled to the exterior surface 35 of the flat metal plate assemblies 43 of the inner shell plating 28 and are preferably fabricated to conform to and match up with the existing framing members 22 of the existing outer hull 2. In addition, a plurality of bulkhead portions 55 may be formed on the interior surface 56 extending outward therefrom.

4. Installing and coupling the modular sections 15 of the inner hull structure 3 into place on the existing outer hull structure 40 to form a double hull 4. This step of installing the inner hull structure 3 inside the outer hull 2 includes the additional steps of laying the inner hull structure 3 inside the outer hull 2 and then coupling the inner hull 6 to the outer hull 2.

Preferably the new inner hull structure 3 is coupled to the existing outer hull 2 by welding. The inner connecting framing members 33 extending outward from the exterior surface 35 of the inner bottom plating 29 of the new inner hull 6 are laid on the outer framing 22 extending outward from the interior surface 8 of the outer hull 2 and then the connecting framing members are welded together. The inner connecting framing members 33 extending outward from the exterior surface 35 of the inner port side plating 30 and inner starboard side plating 31 of the inner hull 6 are lapped onto the outer connecting framing 22 extending outward from the interior surface 8 of the port and starboard sides of the outer hull 2 and the connecting framing members are welded together.

5. Modifying the existing internal vessel structure 7 and decking 13 of the vessel 1 that was cut and removed to conform to the new double hull 4. This comprises adapting the sections 7*a* that were cut and removed for re-connection with the inner hull 6.

In a preferred embodiment, a trunk structure 53 is added between the cut 25 in the topside deck plating 13*a* that was removed and the topside deck plating 13*b* that was left in place. Preferably, this trunk structure 53 includes a bulkhead that is prefabricated and extends substantially downward from the outer peripheral edge of the main deck plating 13*b* that was cut away and removed. When the internal structure 7 and topside deck plating 13*b* having the trunk structure 53 is re-installed into the inner hull 6, the trunk structure 53 forms a raised bulkhead on the main deck between the cut lines 25. The height of the new bulkhead section of the trunk structure 53 is predetermined based on the desired cargo carrying capacity of the completed double hull vessel 5.

Alternatively, the existing internal vessel structure may be re-installed without a trunk structure 53 such that the topside deck plating 13*a* that was removed and the topside deck plating 13*b* that was left in place are re-connected at the cut line 25.

6. Installing the modified/adapted internal ship structure 7 and the original main deck plating 13*b* that was cut and removed into the inner hull 6 of the double hull 4.
7. Coupling the modified internal ship structure 7 and the original main deck plating 13*b* that was cut and removed to the shell plating 28 of the inner hull 6 of the double hull 4 and the external structure 40 of the original hull 1 that was left in place.
8. Modifying the vessel's mechanical, electrical, cargo, and structural systems as required to allow for operation with the new double hull 4, and for a raised deck in those embodiments having a trunk structure 53.

The following is an example of the practice of the present invention on a barge. Application of the invention employed as much of the existing barge as possible to smoothly integrate it with the entirely new inner hull structure 3 and the new trunk structure 53. A detailed inside measurement was performed to detect changes from the design to "as-built." From these measurements, substantial modular 15 pre-assembly of the inner hull structure 3 was completed before the barge arrived in the yard. When the vessel arrived, the topside deck 13 and internal vessel structure 7 were cut into five large sections 7*a*. These sections 7*a*, with their attached transverse and longitudinal bulkheads 20, 21, were removed and stored separately.

The prefabricated modular sections 15 were laid on top of the existing bottom transverse frames 24 and lapped onto the frames 24 at the side. Forward and aft, where the barge has more shape, the plating and modules 15 were installed in smaller increments. Because most of the original main deck 13 and bulkheads 20, 21 were being raised to create a trunk deck structure 53, new lower portions 55 of the transverse and longitudinal bulkheads 20, 21 were fabricated and fitted. The new bulkhead portions 55 were added on the new inner hull structure 3 and formed the bottom portion of the new extended rebuilt bulkheads thereby providing additional strength at the bottom of the bulkhead to support the extra load due to the higher level of the raised deck 13*d*. While the work was going on inside, the new side walls of the raised trunk 53 were fitted to the original deck 13 and bulkheads 20, 21. Finally, the completed deck and upper bulkhead assembly or trunk structure 53 was installed inside the new inner hull 6 of the double hull 4.

The cargo carrying volume of the original barge was maintained approximately the same by raising a trunk structure 53 from the original main deck 13 and using the existing structure to the maximum extent possible. The resulting rebuilt double hull vessel 5 thus resembles newly built double hull vessels, at a substantial cost savings as compared to the cost of new construction.

The art is well aware of procedures for cutting apart pre-existing vessels and inserting new hull sections and equipment. Essentially similar techniques of cutting and welding may be employed to carry out the invention. Similarly, methods of revising the vessel's cargo and ballast piping to allow suitable flow of oil and water into its various tanks, and of its wiring and control systems, are well within the knowledge of those skilled of the art.

According to the present invention, a conventional single hull vessel 1 may be internally rebuilt as a double hull vessel 5 having a double hull 4 extending at least over the length of the cargo carrying section 12 of the vessel. The new inner hull structure 3 spaces the cargo carrying tanks 12 from the outer hull 2 or skin of the vessel, thereby protecting against cargo spillage in the event of penetration of the sides and/or bottom of the outer hull 2 due to collision or grounding damage. The existing outer shell plating 18 of the vessel forms the skin of the outer hull 2 of the double hull 4 and the inner shell plating 28 of the new inner hull 6 forms the skin of the inner hull 6 of the double hull 4.

Preferably, the relative exterior proportions of the vessel prior to and after rebuild are relatively the same. In a first embodiment, the exterior shape and outer hull dimensions of the hull and topside decking remain relatively the same and the cargo carrying capacity is reduced by the addition of the new inner hull structure 3, while in the preferred embodiment, the exterior shape and outer hull dimensions remain relatively the same, but the topside decking is rebuilt with a trunk structure 53 (e.g., the main deck and superstructure of the vessel are modified), which allows the cargo carrying capacity to remain relatively the same.

The present invention provides a double hull vessel from an existing single hull vessel at a fraction of the cost of construction of a new vessel. The cost of the rebuild is estimated to be attractive with respect to the cost of construction of a new double-hulled vessel of comparable capacity. Obviously the economics of internally rebuilding any particular vessel will vary, particularly in dependence on the anticipated economic useful life of the rebuilt vessel.

FIGS. 10A–27B and the following text describing those figures disclose in more detail the improved system and method for fitting the new inner hull (N) to the existing outer hull (E).

FIGS. 10A–10H show an exemplary deck arrangement of an exemplary existing single hull vessel 80 that is a typical candidate vessel for internal double hulling using the improved fit-up techniques of the present invention. As shown in FIGS. 10A–10H, the existing deck layout can include cargo handling equipment, ship navigational equipment, line handling equipment, anchoring equipment, hotel services, life rafts/boats, machinery space, and the like. The cargo handling equipment can include cargo pumps, piping, and valves. The ship navigational equipment can include lights steering systems, thrusters, etc. The line handling equipment can include mooring winches, cleats, chocks etc. The anchoring equipment can include capstans or windlasses, anchor, anchor billboard, etc. The hotel services can include offices, grating, stairways, ladders, etc.

As shown in FIGS. 10A–10H, a detailed vessel survey is preferably conducted to determine and record the actual location of the hull structure (e.g., bulkheads 20,21, framing 22, shell plating 18, etc.) and various equipment (e.g., machinery, piping, valves, etc.) for the existing single hull vessel. Preferably, computer aided design tools and computer aided drafting techniques (e.g., AUTOCAD) are used to show the existing hull structure and existing equipment in full detail. The use of computer aided drafting techniques helps to improve the internal double hull rebuild process by allowing the actual in-service condition of the existing single hull vessel to be captured and accurately depicted in a drawing for use by a designer in the design and prefabrication of the new inner hull structure. By using the actual dimensions and layout of the existing vessel, the fit-up of the new inner hull to the existing outer hull is improved.

Figure 11:
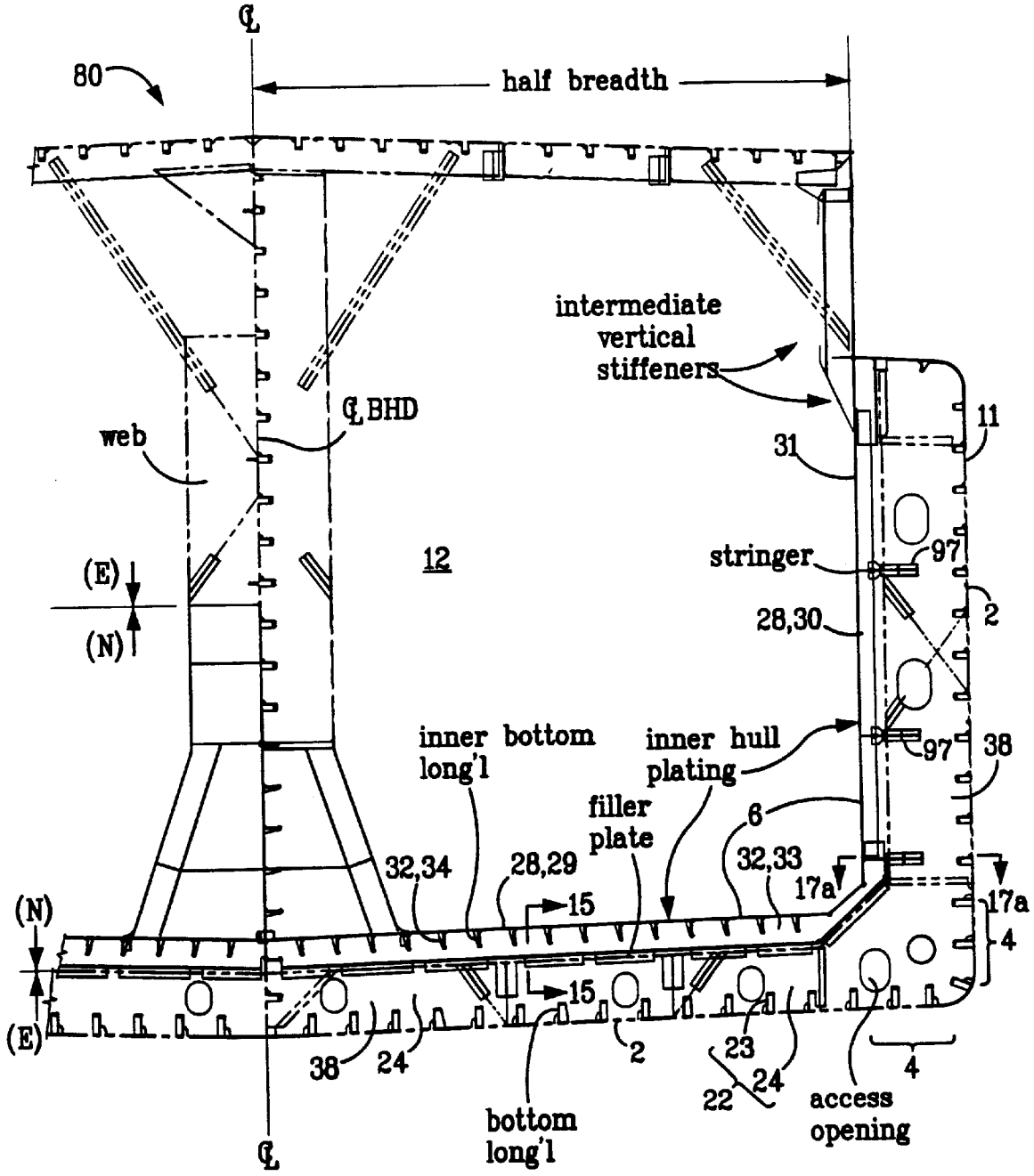
FIG. 11 shows an exemplary cross sectional view of the vessel of FIG. 10 at a typical transverse web frame, port side looking aft.

FIG. 11 shows an exemplary cross sectional view of the vessel 80 of FIGS. 10A–10H at a typical transverse web frame 24, port side looking aft. As shown in FIG. 11, the rebuilt double hull 4 includes a new inner hull 6 disposed internally over the existing outer hull 2. FIG. 11 shows frames 32–34, 37–42, 45–50, 53, 54, 57, 58, and 61–66 of the exemplary vessel 80.

Figure 12:
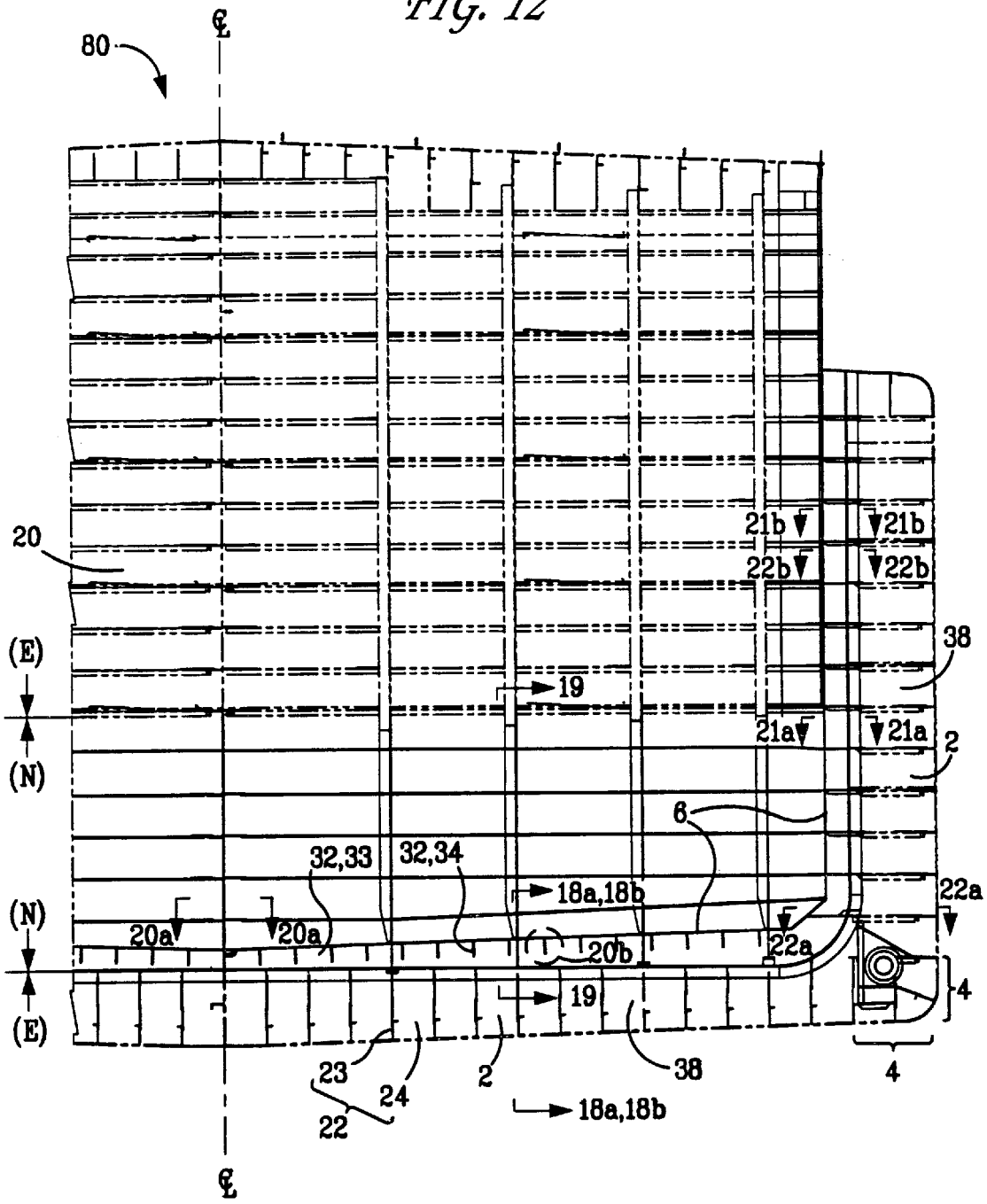
FIG. 12 shows an exemplary cross sectional view of a vessel at a typical transverse bulkhead, starboard side looking forward.

FIG. 12 shows an exemplary cross sectional view of the vessel 80 at a typical transverse bulkhead 20, starboard side looking forward. FIG. 12 also shows the rebuilt double hull 4 including the new inner hull 6 disposed internally over the existing outer hull 2. FIG. 12 shows frames 35, 43, 51, 59, and 67 of the exemplary vessel of FIGS. 10A–10H.

As shown in FIGS. 11 and 12, the new inner hull 6 and the existing outer hull 2 are held in a spaced apart relationship defining a space or cavity 38 therebetween. This space or cavity 38 may be used as a tank such as, for example, a ballast tank. The inner hull 6 defines an interior cargo carrying volume 12 for carrying a cargo and the outer hull 2 defines an exterior barrier with the operating environment of the vessel (e.g., the sea). This rebuilt double hull 4 allows the structural integrity of the outer hull 2 to be breached without breaching the inner hull 6. Therefore, the outer hull 2 may be breached, i.e., opened to the sea, while the cargo remains securely contained within the inner hull 6, thereby avoiding a potential cargo spill.

The new inner hull 6 includes inner hull shell plating 28 and inner hull framing members 32. The inner hull inner plating 28 includes inner hull bottom plating 29 and inner hull side (e.g., port 30 and starboard 31) plating. The framing members 32 include inner connecting members 33 and inner stiffening members 34.

The existing outer hull 2 includes the existing outer hull shell plating 18 and at lease a portion of the existing hull framing members 22. The outer hull shell plating 18 includes outer hull bottom plating 9 and outer hull side (e.g., port 10 and starboard 11) plating. The existing hull framing members 22 include at least a portion of the existing or outer connecting members 24 and the existing or outer stiffening members 23. As shown in FIGS. 11 and 12, the outer connecting members 24 can include transverse framing members and the outer stiffening members 23 can include longitudinal framing members.

Alternatively, the inner and outer connecting members can include longitudinal framing members and the inner and outer stiffening members can include transverse framing members (not shown).

When a vessel is constructed, the shape and structural dimensions of the as-built vessel typically do not match that shown in the vessel design drawings. This may be due to sloppy construction and design changes made during construction due to various factors such as, for example, interferences encountered during the vessel building process. Furthermore, once a vessel has been in-service for a period of time, the shape and structural dimensions of the existing in-service vessel typically do not match that of the as-built vessel. For example, due to movement and distortion of the existing hull during operation, the existing structure may not be true and is typically not dimensionally accurate as compared to either the as-built drawings and/or the design drawings. This leads to problems during the internal double hull rebuild process associated with fitting the new structure (W) to the existing structure (E).

Figure 13A:
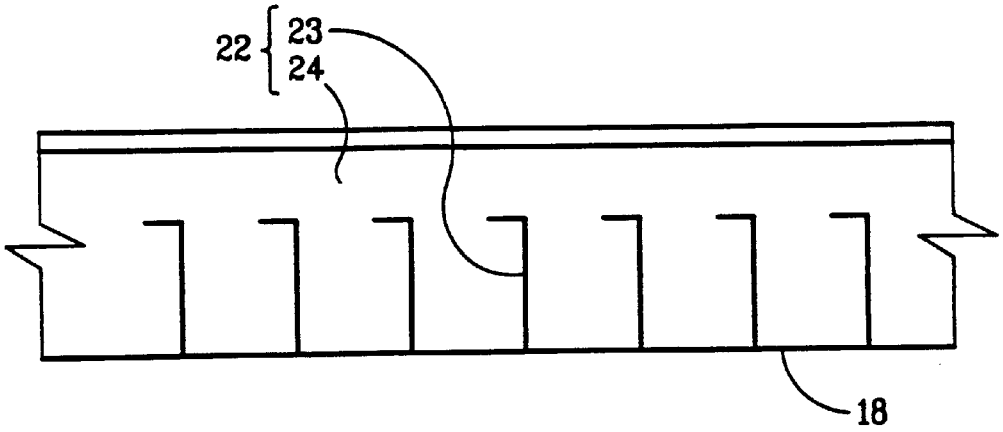
FIG. 13A show exemplary shell plating and stiffener members that is uniform and smooth.
Figure 13B:
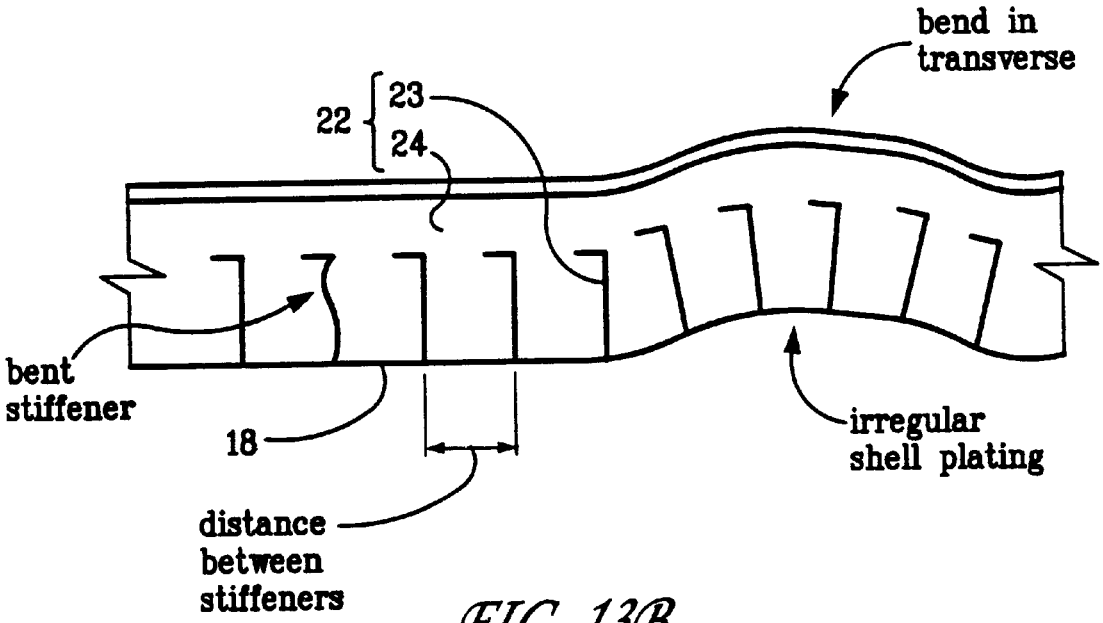
FIG. 13B show exemplary shell plating and stiffener members that is distorted and non-uniform.

FIGS. 13A and 13B show exemplary shell plating 18 and framing members 22. As shown in FIG. 13A, for a newly constructed vessel one would expect that the shell plating 18 would be uniform and smooth and that the framing members 22 would have a true shape and be a known distance apart.

FIG. 13B shows what the shell plating 18 and framing members 22 may look like after the vessel has been in-service for a period of time. As shown in FIG. 13B, the shell plating 18 may become distorted and non-uniform thereby causing the framing members 22 be also become distorted. In addition, as the shell plating 18 distorts, it causes the framing members 22 to move and the distance between the framing members 22 may become unknown. Also, individual framing members 22 may become curved or bent during operation of the in-service vessel. Although FIG. 13B shows an exemplary embodiment wherein the one transverse web 24 and a plurality of longitudinal stiffeners 23 are depicted, the irregular shape of and/or distances between adjacent transverse webs is also taken into consideration.

During the internal double hull rebuild, the new inner hull 6 is installed within and over the existing hull 2 and then the new inner hull structure is connected to the existing outer hull structure to form the new double hull 4. A filler or connector plate can be used to connect the new inner hull and the existing outer hull together. The filler plate is disposed between the new inner hull structure and the existing outer hull structure and then connected to each thereby forming a connecting member for hold the new inner hull in a spaced apart relation with the existing outer hull. (See FIGS. 6A and 6B).

However, due to the problems discussed above associated with the existing hull structure not matching the as-built or design condition, the filler plates preferably can accommodate a certain range of tolerances in the alignment between the new inner hull structure and the existing outer hull structure. One way of providing for any offset or misalignment between the new inner hull structure (N) and the existing outer hull structure (E) is to bend the filler plate 81, as shown in FIG. 14, to account for any offset between the new inner hull structure and the existing outer hull structure.

Figure 14:
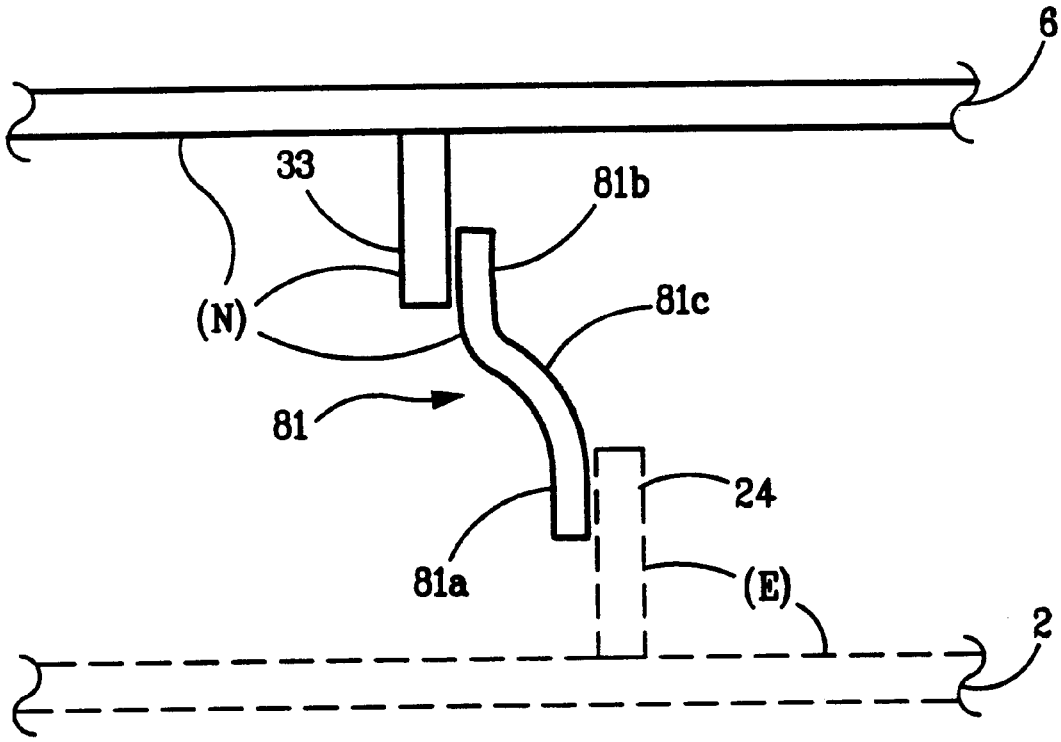
FIG. 14 shows an exemplary filler plate for connecting the new inner hull to the existing outer hull.

FIG. 14 shows a filler plate 81 having a straight lower portion 81*a* for connection to the existing outer hull structure 24, a straight upper portion 81*b* for connection to the new inner hull structure 33, and a bent middle portion 81*c* that is bent so that the straight lower portion 81*a* and the straight upper portion 81*b* align with the existing outer hull structure 24 and the new inner hull structure 33, respectively. The filler plate 81 can be prefabricated having a bend or can be bent onsite to have a predetermined bend based on the design and/or as-built drawings. However, bending the filler plate 81 requires additional labor and adds costs, both of which are undesirable.

Figure 15:
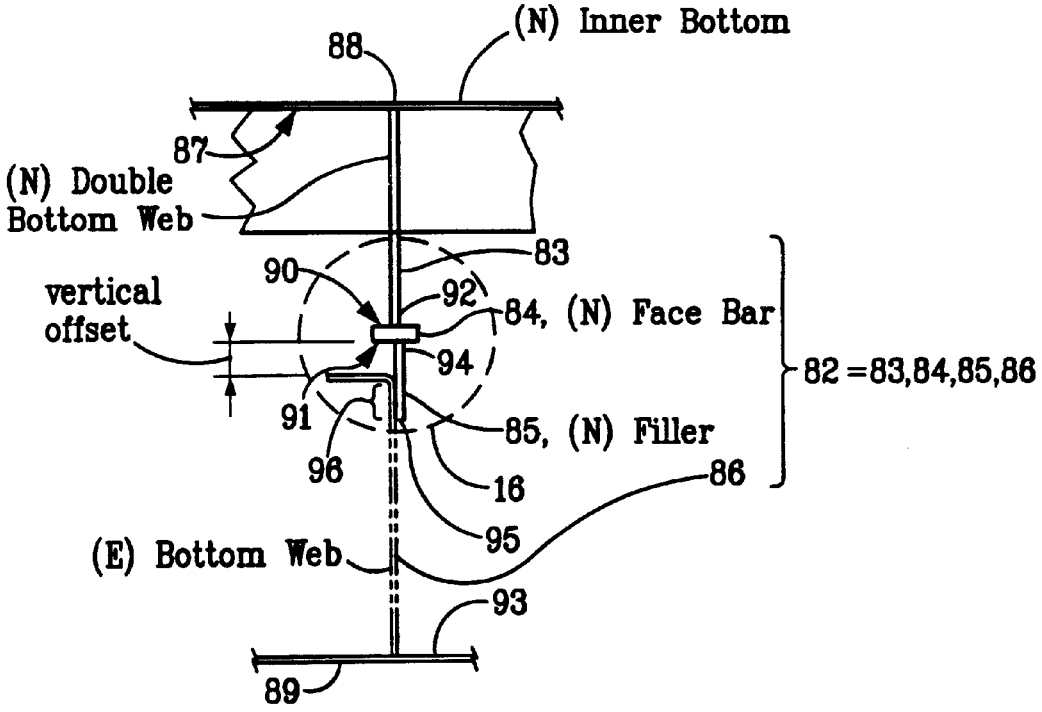
FIG. 15 shows an exemplary connecting member for connecting the new inner hull to the existing outer hull.

FIG. 15 shows an exemplary connecting member 82 for connecting the new inner hull structure (N) to the existing outer hull structure (E). As shown in FIG. 15, the connecting member 82 includes an inner hull connecting member 83, a face bar 84, a filler plate 85, and an outer hull connecting member 86. The inner hull connecting member 83 extends from a exterior surface 87 of the inner hull shell plating 88 toward the outer hull shell plating 89. The face bar 84 includes an upper surface 90 and a lower surface 91 and the upper surface 90 of the face bar 84 is connected to a distal end 92 of the inner hull connecting member 83. The outer hull connecting member 86 extends from an interior surface 93 of the out hull shell plating 89 toward the inner hull shell plating 88. The filler plate 85 having an upper end 94 and a lower end 95 is positioned between the face bar 84 and the outer hull connecting member 86 and is connected at the upper end 94 to the lower surface 91 of the face bar 84 and at the lower end 95 to a top portion 96 of the outer hull connecting member 86.

As shown in FIG. 15, the above connecting structure helps to overcome the problem associated with misalignment between the new inner hull structure (N) and the existing outer hull structure (E) by using a substantially flat face bar 84 and a substantially straight filler plate 85 for connecting the new inner hull 6 to the existing outer hull 2. This new connecting member 82 provides for improved fit-up due to the tolerances allowed in aligning the prescribed portions of the new inner hull structure (N) and the prescribed portions of the existing outer hull structure (E). Preferably, the face bar 84 is connected to the lower distal end 92 of the new double bottom web 83 and the filler plate 85 is disposed between and connected to the bottom surface 91 of the flat bar 84 and one side of the existing bottom web 86. The face bar 84 and filler plate 85 can be connected together and to the other structures using conventional techniques, such as welding.

Preferably, the inner connecting members 83 and the outer connecting members 86 are fabricated and fitted together so that they correspond to one another and are aligned within a predetermined tolerance when the new inner hull 6 in installed over the existing outer hull 2.

Figure 16:
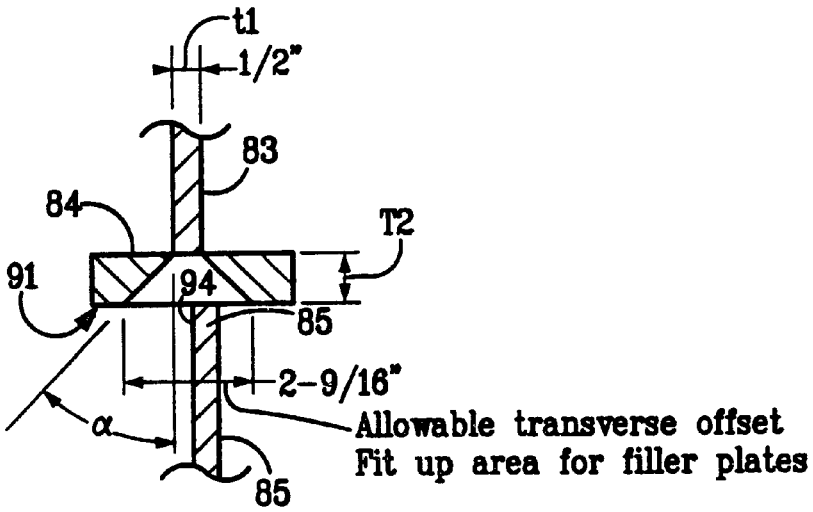
FIG. 16 shows an exemplary application having exemplary dimensions for a better understanding of certain aspects of the invention.

FIG. 16 shows preferred allowable tolerances for the connection of the new inner hull 6 to the existing outer hull 2. Preferably, the fit up of the new inner hull 6 to the existing outer hull 2 includes fit up tolerances for a transverse fit up area defining an acceptable transverse offset between the new inner hull connecting member 83 and the existing outer hull connecting member 86 and a vertical fit up area defining an acceptable vertical offset between the top end of the existing outer hull connecting member 86 and the distal end of the inner connecting member 83.

Preferably, the filler plates 85 moved to provide for the transverse fit up area and the vertical fit up area. The upper end 94 of the filler plate 85 can be located transversely on the bottom surface 91 of the face bar 84 within the transverse fit up area to provide for the transverse fit up and the lower end 95 can be located up or down within the vertical fit up area to provide the vertical fit up of the new inner hull structure to the existing outer hull structure.

Preferably, the fit up tolerances for the transverse fit up area for the filler plates is determined based on the plate thickness of the inner connecting member T1 and the plate thickness of the face bar T2 and tolerance angles $\alpha$. The tolerance angles $\alpha$ are preferably formed between an imaginary line extending from each corner of the lower end of the inner connecting member 83. Preferably, the tolerance angles $\alpha$ are about 45 degree angles, as shown in FIG. 16.

As shown in FIG. 16, for an exemplary application having a double bottom web (e.g., inner hull connecting member 83) including a plate having a thickness T1 of about ½ inch, a face bar 84 including a plate of about 4 inch×1 inch thick T2, a filler plate 85 including a plate having a thickness of about ½ inch, and a bottom web (e.g., outer hull connecting member 86) including a plate of about ½ inch, the transverse fit up area for the filler plates 85 has a transverse tolerance of about 2 9/16 inch for the transverse offset between the new inner hull connecting member 83 and the existing outer hull connecting member 86.

Preferably, the vertical fit up area between the top of the existing outer hull connecting member 86 and the bottom surface of the face bar 84 is dependant upon the particular application. As shown for the embodiment of FIG. 15, the vertical fit up area between the top of the existing outer hull connecting member 86 and the bottom surface of the face loar 84 is about 2 3/16 inch. The tolerances depend on the particular application and are determined based on several factors including, for example, the material, plate thickness, frame spacing, and the like.

Accordingly, the filler plate 85 in the embodiment of FIGS. 15 and 16 does not have to align perfectly with the double bottom webs, as was the case in the previous designs, but rather allows for side to side (e.g., transverse) tolerance which is a tremendous improvement over the previous design.

As can be appreciated, as the size (e.g., thickness) of the fact bar and/or the filler plate increases, the allowable tolerances also increase. The predetermined tolerance is typically determined and approved by the American Bureau of Shipbuilding (ABS) acting to enforce the structure integrity standards set by the Untied States Coast Guard (USCG).

Figure 17A:
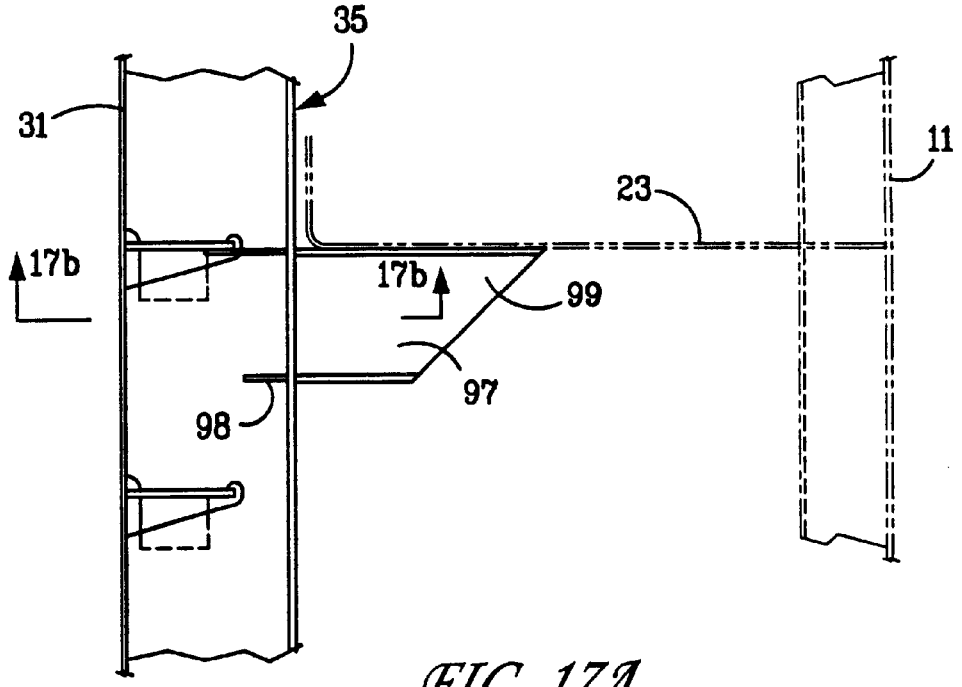
FIG. 17A a cross-sectional view taken along section line 17*a*—17*a* of FIG. 11.
Figure 17B:
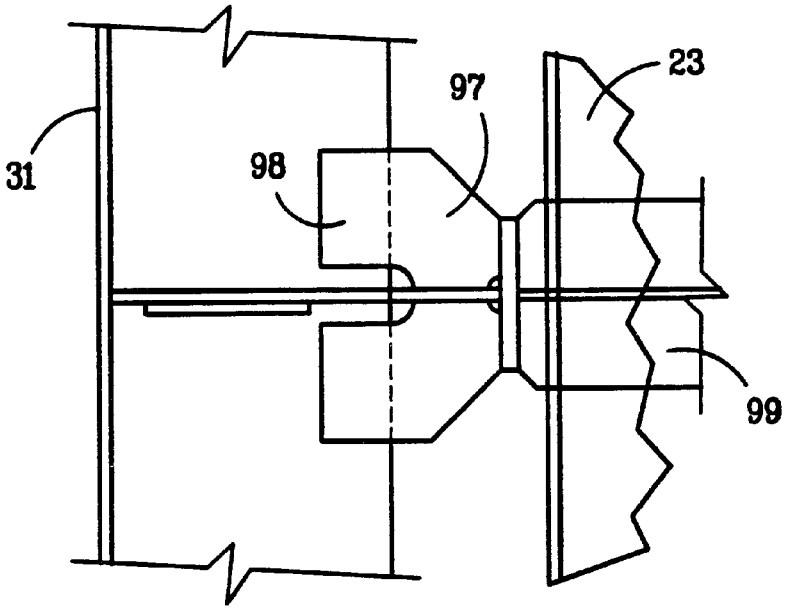
FIG. 17B a cross-sectional view taken along section line 17*b*—17*b* of FIG. 17A.

Referring back to FIG. 11, the new double hull 4 includes a plurality of stringers or connecting members 97 for connecting the new inner hull side plating 30, 31 to the existing outer hull side plating 10, 11. FIGS. 17A and 17B show details of the connection between the new inner hull side plating 30, 31 and the existing outer hull side plating 10, 11. FIG. 17A a cross-sectional view taken along section line 17*a*—17*a* of FIG. 11 and shows the detail of the connection between the new inner hull side plating 30, 31 to the existing outer hull side plating 10, 11. FIG. 17B a cross-sectional view taken along section line 17*b*—17*b* of FIG. 17A and shows another view of the detail of the connection between the new inner hull side plating 30, 31 to the existing outer hull side plating 10,11.

As shown in FIGS. 17A and 17B, a connecting stringer or web 97 having a first end 98 and a second end 99 is disposed between and connects the new inner hull side plate 30, 31 to the existing outer hull side plating 10, 11. As shown, the first end 98 of the connecting stringer 97 is connected to the exterior surface 35 if the inner hull side plating 30, 31 and the stringer 97 extends toward the outer hull plating 10, 11 where the second end 99 is connected to an interior surface 8 of the outer hull side plating 10, 11. As shown, the stringer 97 may include a flanged web and a chock may be provided on an interior surface of the outer hull side plating to help reinforce and stiffen the stringer connection.

Figure 18A:
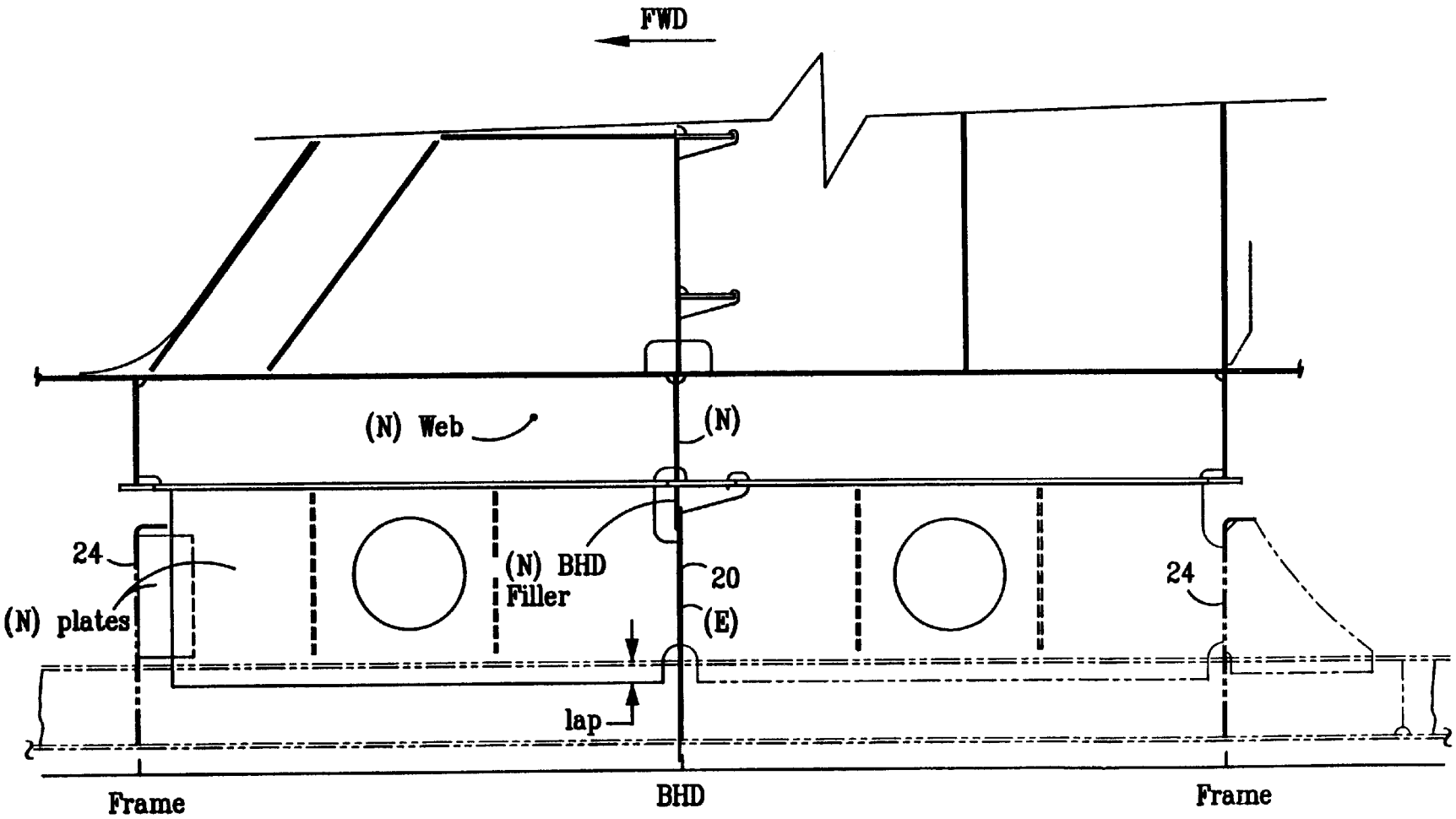
FIG. 18A shows a side elevation taken along section line 18*a*—18*a* of FIG. 12.
Figure 18B:
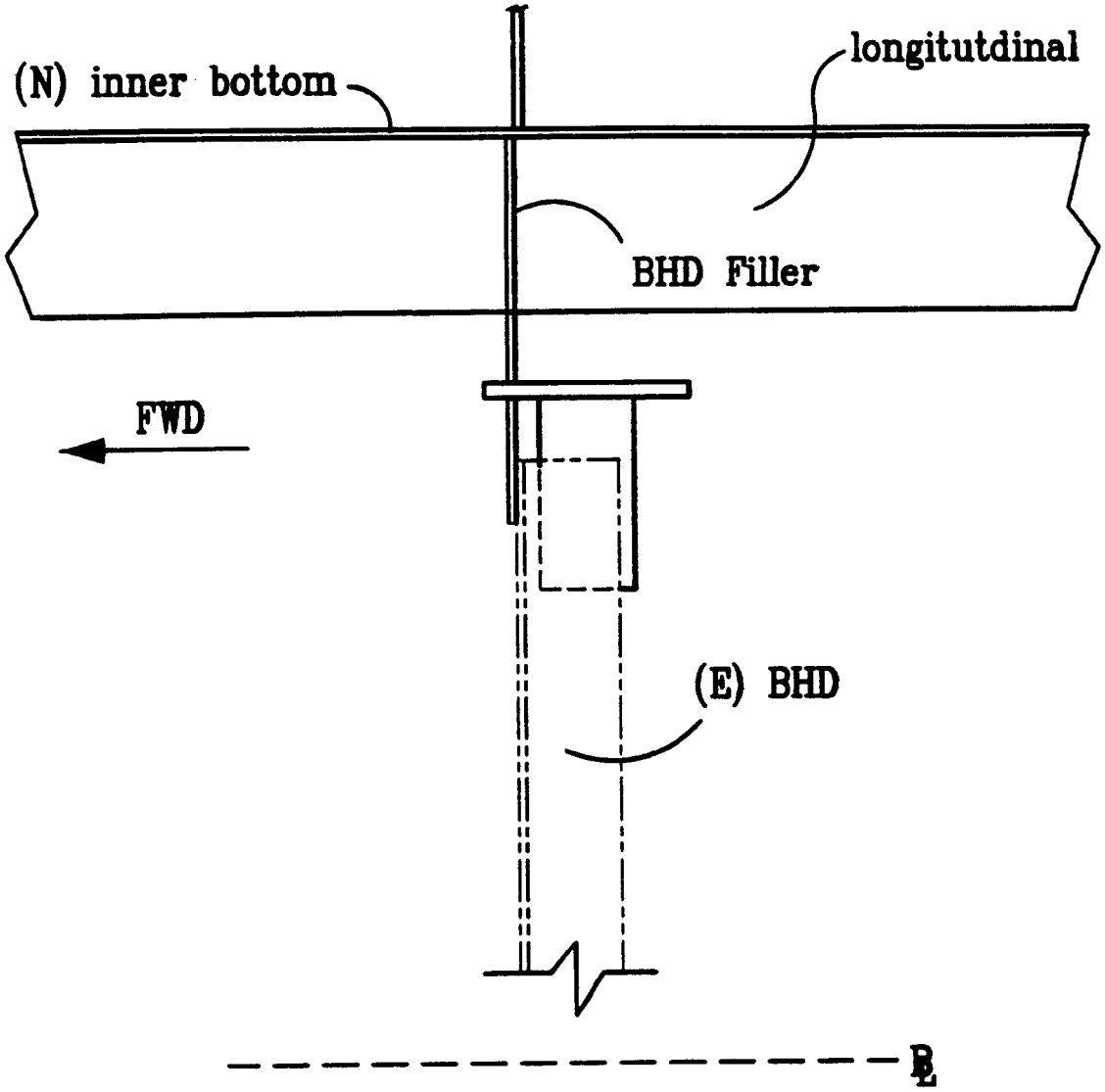
FIG. 18B shows a detail section view of the connection of the new inner hull structure to (the existing outer hull structure taken along section line 18*b*—18*b* of FIG. 12.

FIG. 18A shows a side elevation taken along section line 18*a*—18*a* of FIG. 12 illustrating an elevation at web No. 2 (17'-6" off centerline) starboard side looking outboard. As shown in FIG. 18A, the elevation view includes a transverse bulkhead 20 and one transverse frame 24 forward and one transverse frame 24 aft of the transverse bulkhead 20. FIG. 18B shows a detail section view of the connection of the new inner hull structure (N) to the existing outer hull structure (E) taken along section line 18*b*—18*b* at the transverse bulkhead 20.

Figure 19:
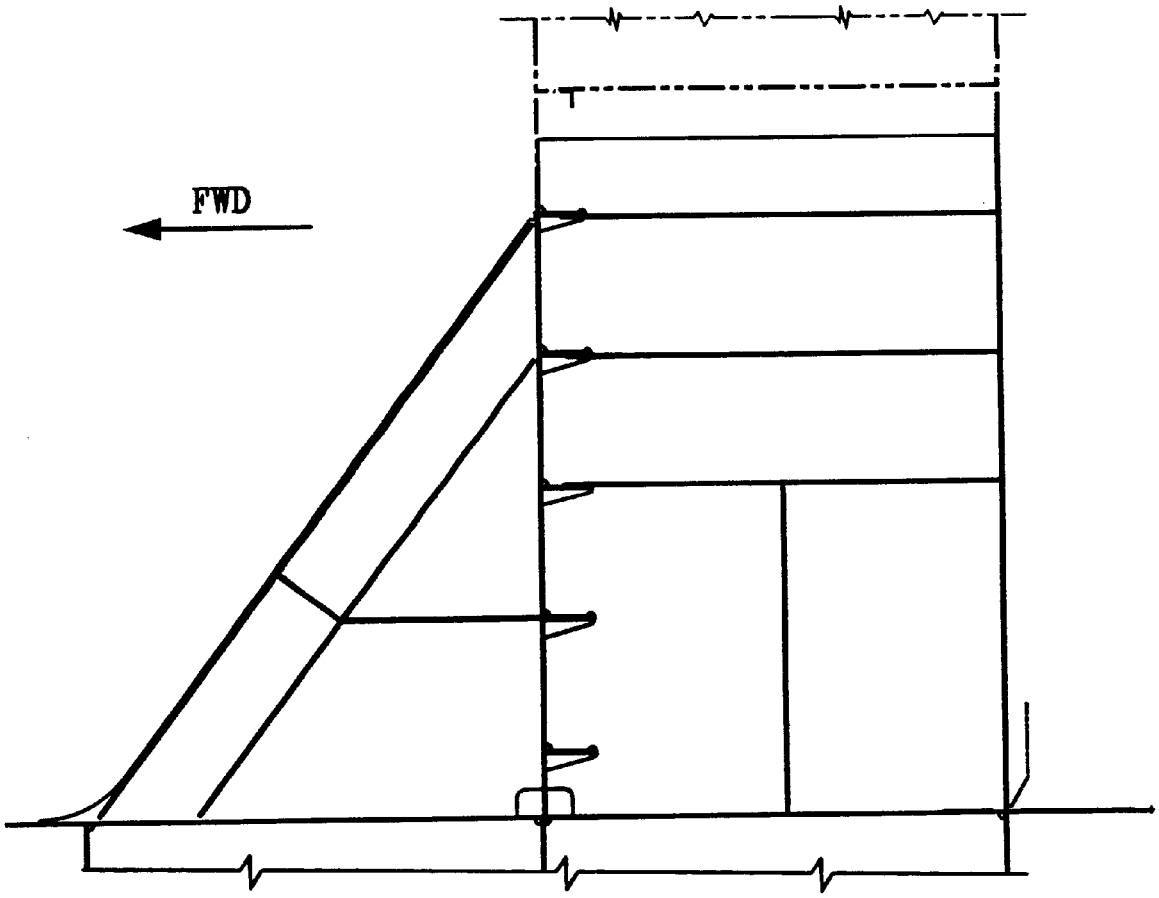
FIG. 19 shows a side elevation taken along section line 19—19 of FIG. 12.

FIG. 19 shows a side elevation taken along section line 19—19 of FIG. 12 illustrating an elevation of the bulkhead web only starboard side looking outboard (see FIGS. 18A and 18B for details of girders below the inner bottom).

Figure 20A:
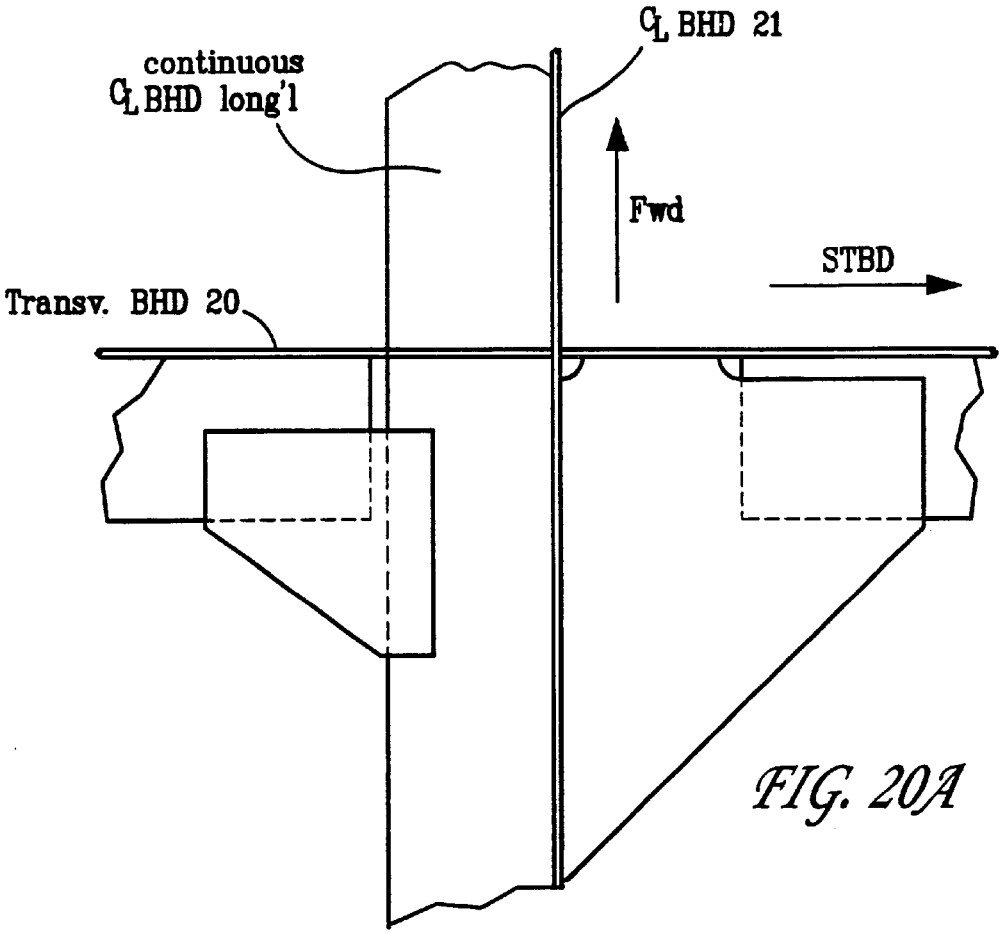
FIG. 20B shows detail 20*b* of FIG. 12.
Figure 20B:
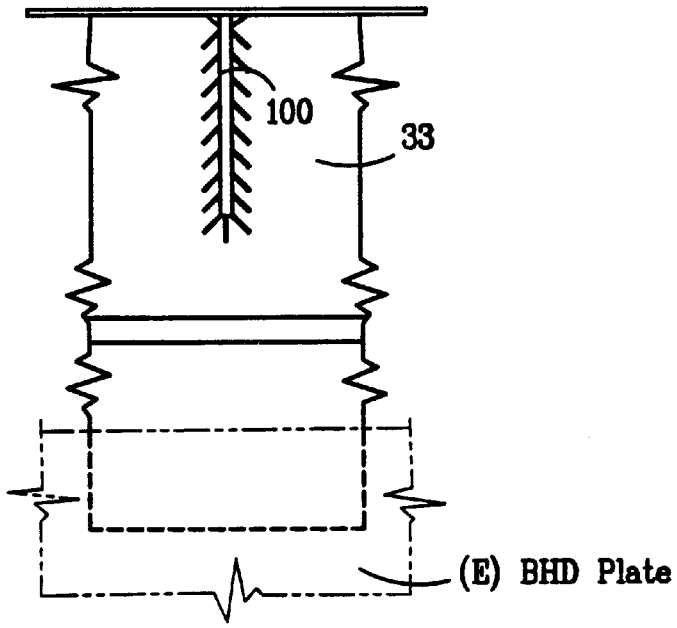

FIG. 20A shows a detail section view taken along section line 20*a*—20*a* of the new inner hull structure showing the intersection of the centerline longitudinal bulkhead 21 and the transverse bulkhead 20 above the new inner hull plating 28 looking down. FIG. 20B shows detail 20*b* of FIG. 12. As shown in FIG. 20B, a slot 100 is preferably cut in the transverse filler plate 33 to accommodate the longitudinal stiffener members 34 extending from the exterior surface 35 of the new inner hull shell plating 28. Preferably, the slot 100 includes a clearance that facilitates the fitting of the filler 33 plate over the longitudinal stiffener members 34 and to the inner hull shell plating 28.

Figure 21A:
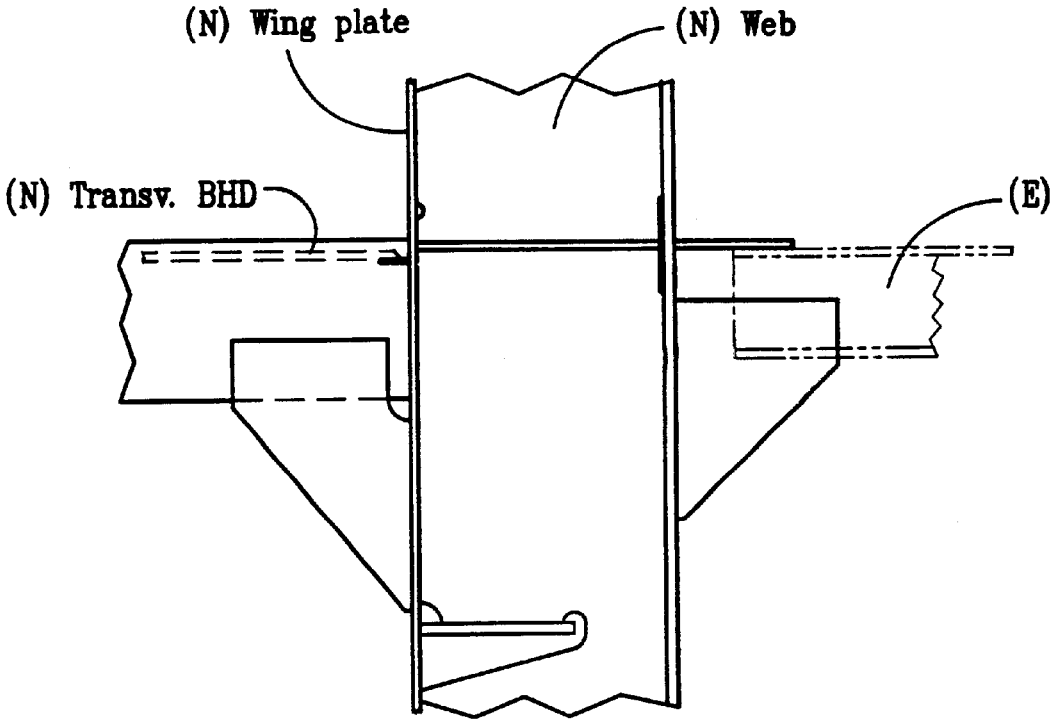
FIGS. 21A and 21B show typical arrangements taken along section line 21*a*—21*a* and section line 21*b*—21*b*, respectively, of FIG. 12.
Figure 21B:
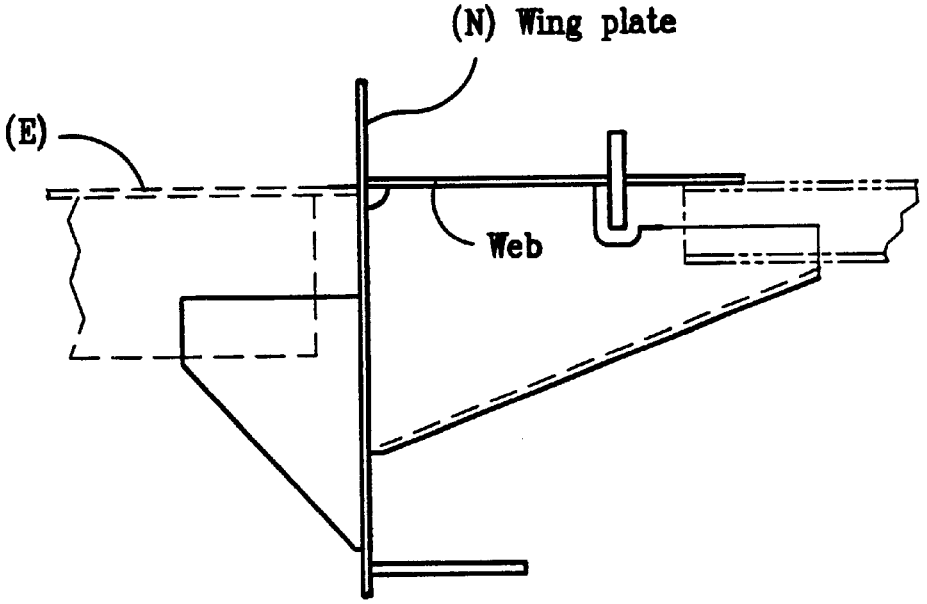

FIGS. 21A and 21B show typical arrangements taken along section line 21*a*—21*a* and section line 21*b*—21*b*, respectively, of FIG. 12. FIG. 21 A shows a typical arrangement from above of the connection of the new inner hull bulkhead portion 55 to the existing outer hull side shell plating 10, 11. FIG. 21B shows a typical arrangement from above of the connection of the existing hull structure 7 that was cut, removed, modified and then reinserted within and over the new inner hull structure to the existing outer hull side plating 10, 11.

Figure 22A:
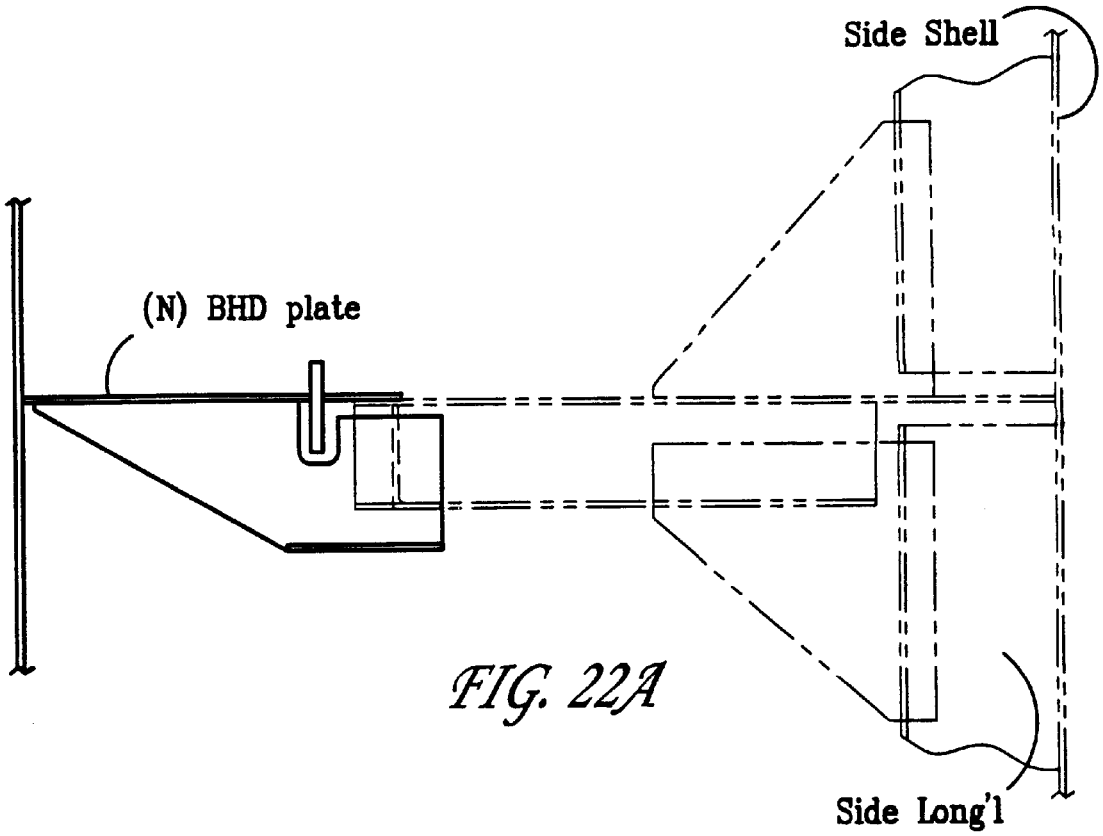
FIGS. 22A and 22B show typical arrangements taken along section line 22*a*—22*a* and section line 22*b*—22*b*, respectively, of FIG. 12.
Figure 22B:
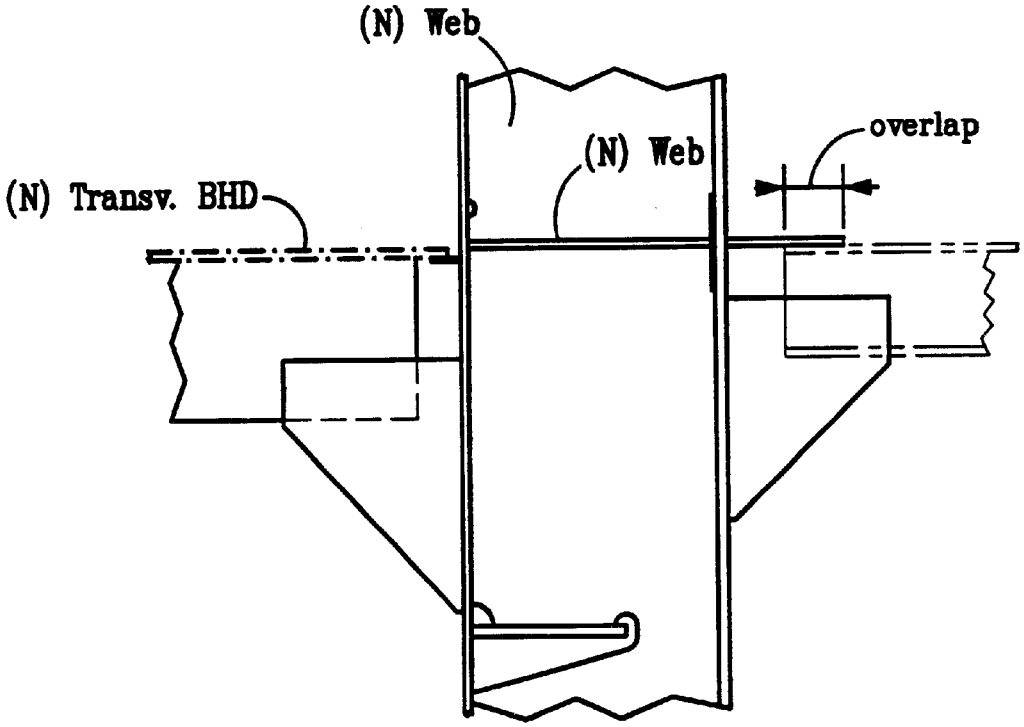

FIGS. 22A and 22B show typical arrangements taken along section line 22*a*—22*a* and section line 22*b*—22*b*, respectively, of FIG. 12. FIG. 22A shows a typical arrangement of the connection of the new inner hull bulkhead portion 55 to the existing outer hull side shell plating 10, 11 from just above the new inner hull bottom plating 29. FIG. 22B shows a typical arrangement from above of the connection of the existing hull structure 7 that was cut, removed, modified and then reinserted within and over the new inner hull structure 3 to the existing outer hull side plating 10,11.

In planning and conducting internal double hull rebuilds on existing vessels, problems can occur because with an existing vessel there is equipment, piping, machinery, and the like, on the existing vessel. This equipment, piping, machinery, etc. must be accounted for in the design and implementation of the new double hulling. In addition, the existing vessel may have been upgrades or improvements that have been installed over the life of the vessel. For example, there is a desired on the part of the vessel owner to upgrade existing/old machinery and equipment so that the same duties can be accomplished with less manpower or greater duties can be performed with the same or less manpower. Automation and design improvements are just a couple of examples of ways that new machinery and equipment may be installed on the vessel. If these upgrades/improvements are not accounted for, than difficulties may arise in the installation of the new inner hull and supporting structure.

Furthermore, the internal double hull process has been further improved through the use of advanced, computerized drafting techniques that improve the fit-up of the new inner hull structure with the existing outer hull structure. In particular, the improvements include:

(a) performing a detailed survey including measurement of various structural dimensions and accounting for deviations between as-built and existing structures. Preferably, the detailed survey includes measuring the longitudinal distance between transverse frames and transverse bulkheads (e.g., the double bottom web of the new inner bottom and the bottom web of the existing structure), and also, measuring the vertical gap between the new inner hull structure and the existing outer hull structure (e.g., the distance between the bottom of the face bar of the new hull and the top of the flange plate of the existing hull structure).

Conducting detailed surveys is important for those applications having critical interfaces, such as, for example, the distance between transverse frames, the height of the transverse frames, and other areas of interface. In ship construction, conversion, and repair, this is important due to the cumulative effect of the potential misalignment of each frame if one or more frames are not dimensional true. Measurements can be taken using conventional measurement techniques.

(b) using Automated Computer-Aided Drafting (AUTOCAD) to ensure that the new and the existing structures come together smoothly by using graphical techniques to depict with a very high degree of accuracy the structure (e.g., hull structure, piping, machinery, etc.) of the existing vessel and then tailoring the fabrication of the new inner hull structure to match the existing outer hull structure. The measurement gather from the detailed survey can be used to very accurately depict the existing hull structure.

(c) using Finite Element Analysis (FEA) for evaluation of special structural details for best fit of new-to-existing structure ensuring acceptable stresses and long-term trouble-free service. The use of FEA improves the internal double hull rebuild process by ensuring that the pieces of the new hull structure and the existing hull structure align and come together smoothly.

Figure 23:
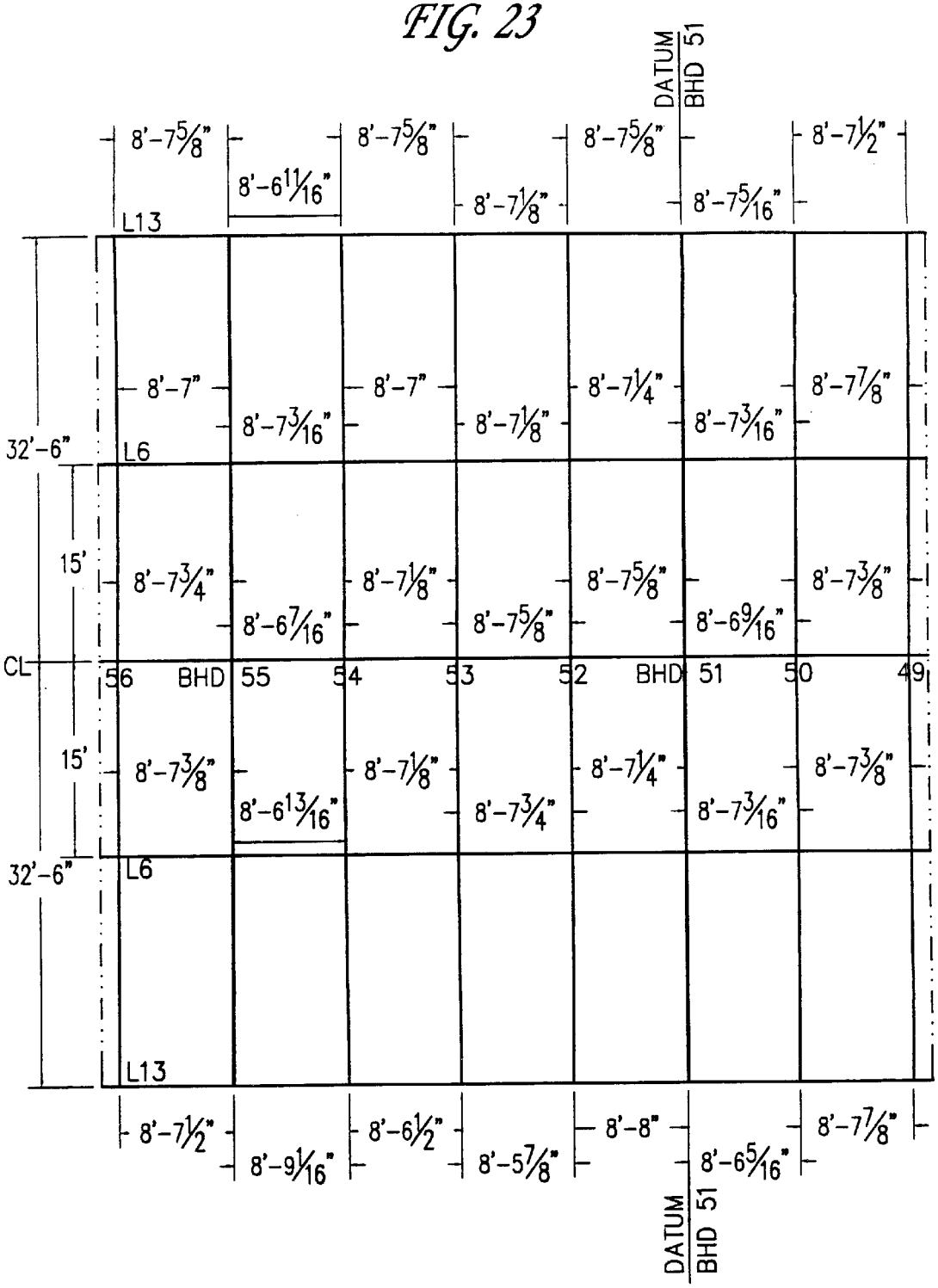
FIG. 23 shows an exemplary dimensional datum plane for the existing single hull vessel that is used to facilitate the fit-up analysis of the new inner hull to the existing outer hull.

FIG. 23 shows an exemplary dimensional datum plane for the existing single hull vessel that is used to facilitate the fit-up analysis of the new inner hull to the existing outer hull. In the example shown, the new structure is connected to the existing structure using a transversely framed design. A transverse bulkhead is chosen as a datum line. As shown in FIG. 23, bulkhead 51 has been chosen as the datum line and dimensions of the measurements of the existing structure between bulkhead 43 and bulkhead 78 are shown. It is assumed that the bulkhead at the datum line is true and the bulkhead is drawn perpendicular to the centerline CL.

A detailed ship survey is conducted and detailed measurements of the actual location of the remaining frame lines are taken and recorded working fore and aft of the datum line. Preferably, the detailed measurements include the distance between the transverse frames and the height of the frames. Preferably, all dimensions are to and from the moulded lines and the thickness of each bulkhead are also measured and recorded. These results of the detailed ship survey are preferably used for lofting (laying out) to tell the cutting machine where and how to cut.

Figure 24:
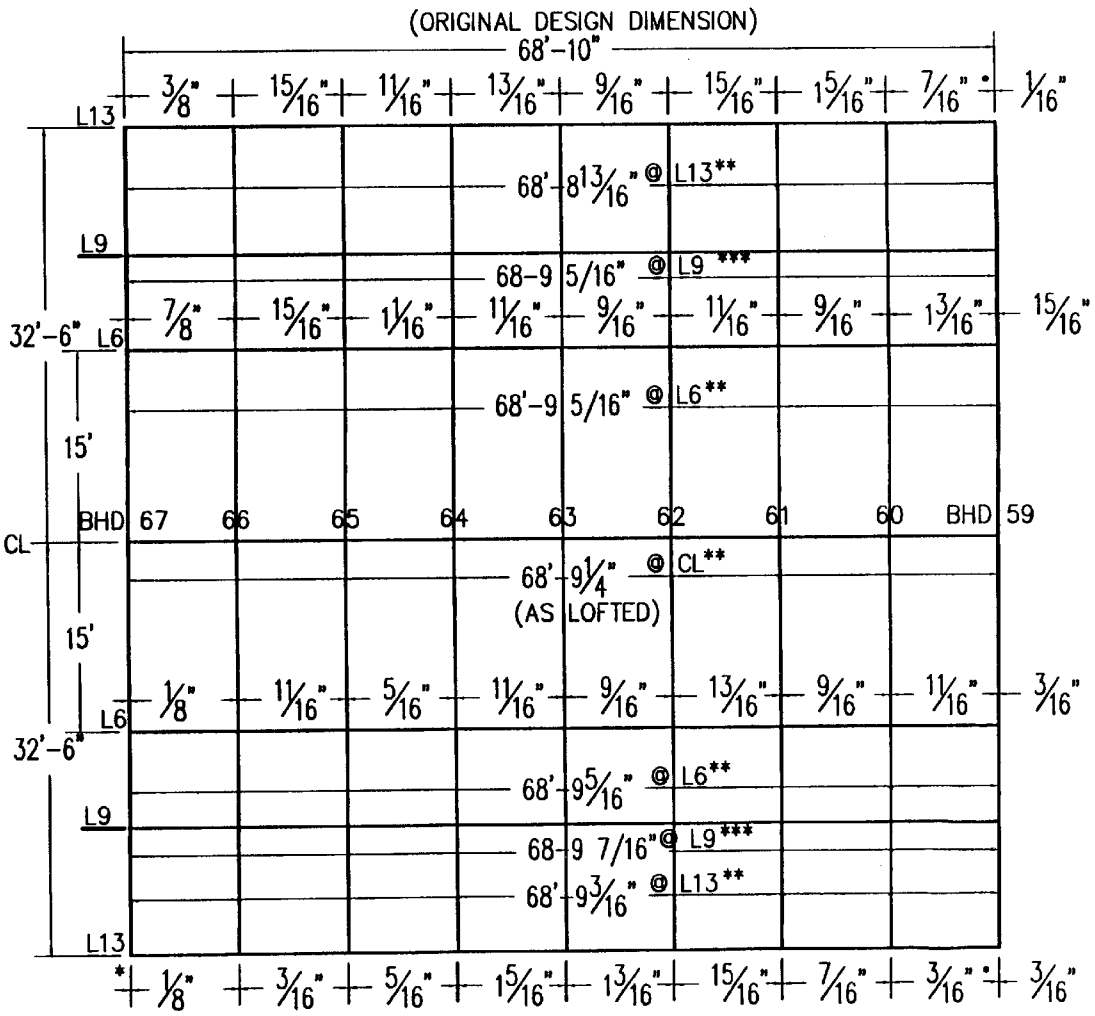
FIG. 24 shows a plan view of an exemplary tank.

FIG. 24 shows a plan view of an exemplary tank. In FIG. 24, tank no. 6 is illustrated. The detailed survey identifies potential deviations between the new and existing structures at the critical junction points for connecting the new inner hull to the existing outer hull (e.g., the longitudinal distance between the double bottom web of the new inner hull and the double bottom web of the existing hull structure). The deviations can be used to facilitate the design and assembly of the new inner hull structure so that it matches and fits up with the existing structure. For example, the dimensions can be used during the lofting process of the new inner hull. Preferably, all dimensions are taken off a common reference point, such as the fwd side of the new and existing structure and the bulkhead dimensions are taken to and from the moulded line of the bulkhead.

Figure 25B:
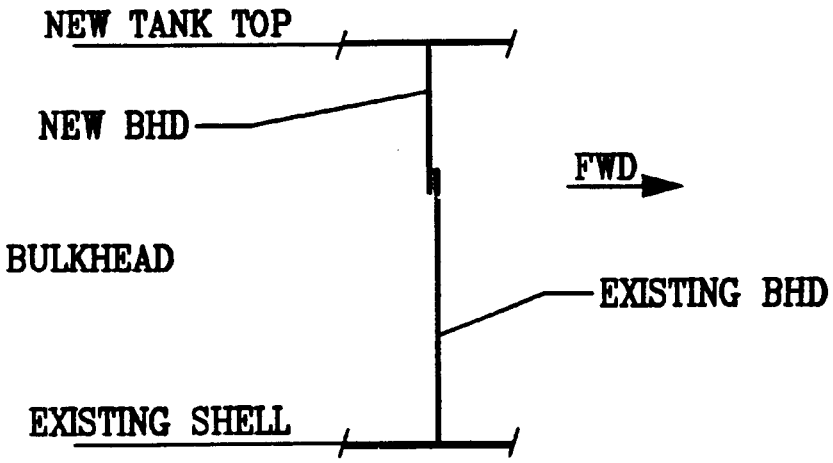
FIGS. 25A and 25B show details of the connection of the new inner hull to the existing outer hull.
Figure 25A:
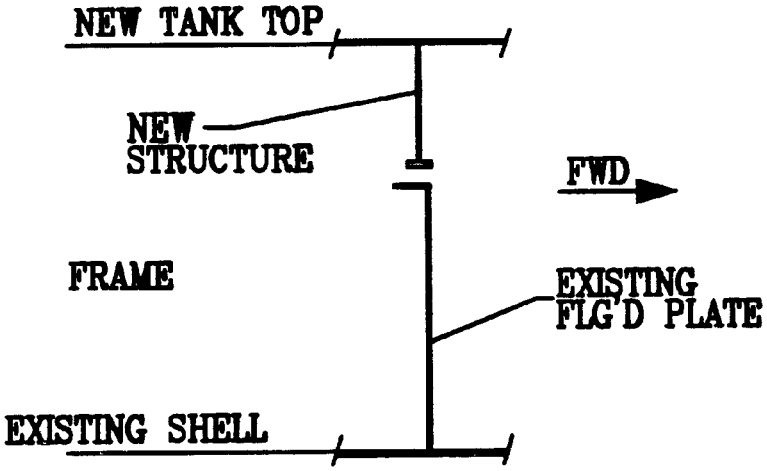

FIGS. 25A and 25B show details of the connection of the new inner hull to the existing outer hull. FIG. 25A is a detail of an exemplary transverse web frame and FIG. 25B is a detail of an exemplary transverse bulkhead.

Figure 26:
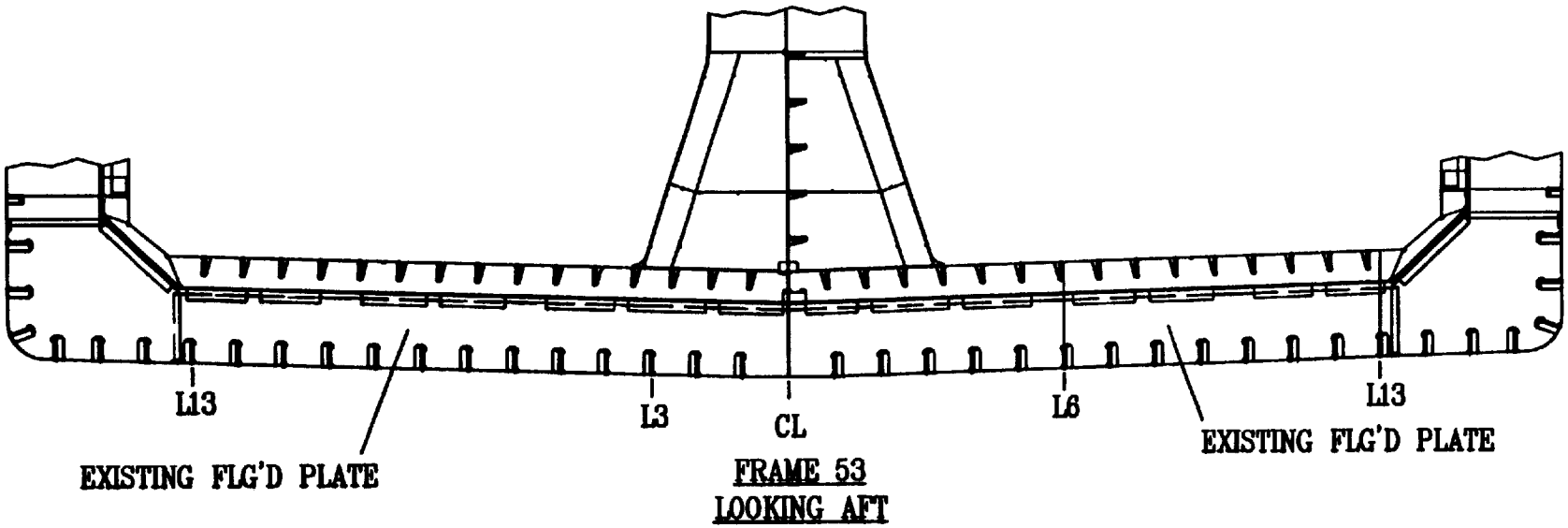
FIG. 26 is an exemplary transverse detail at frame 53.

FIG. 26 is an exemplary transverse detail at frame 53. As shown in FIG. 26, the height of the existing transverse frames is measured and recorded. The vertical gap (measured as an elevation above the baseline) between the new structure and the existing structure can be determined from the measurements of the height of the existing transverse frames. The gap defines the distance between the bottom of the bottom surface of the face bar of the new inner hull and the top or distal end of the transverse flange plate (web) of the existing hull.

Figure 27A:
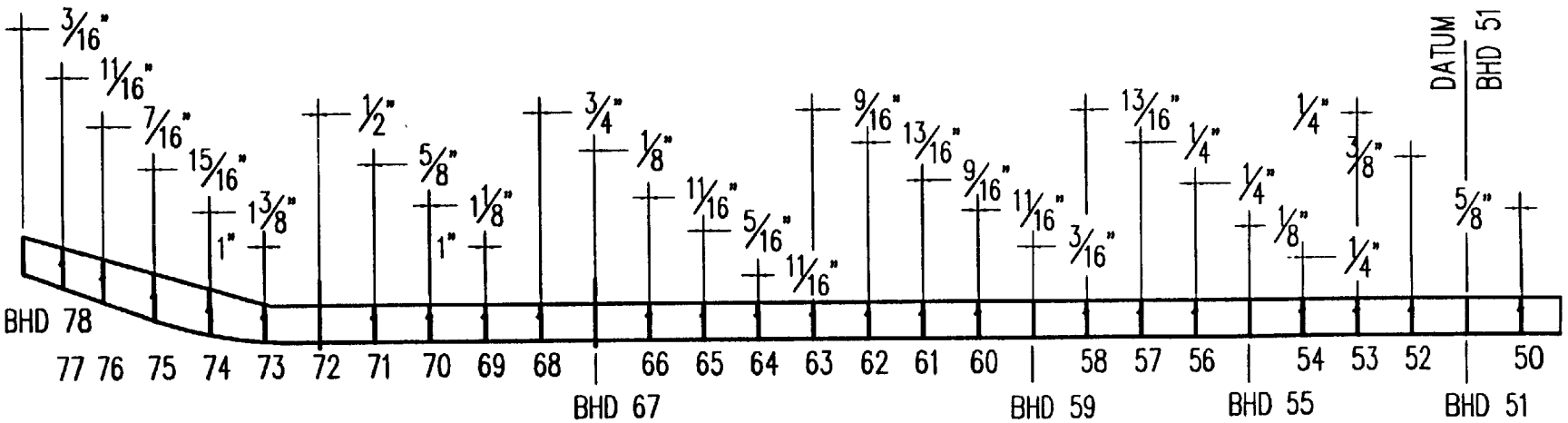
FIGS. 27A and 27B are exemplary elevation details showing measured dimensions of the structure of the vessel.
Figure 27B:
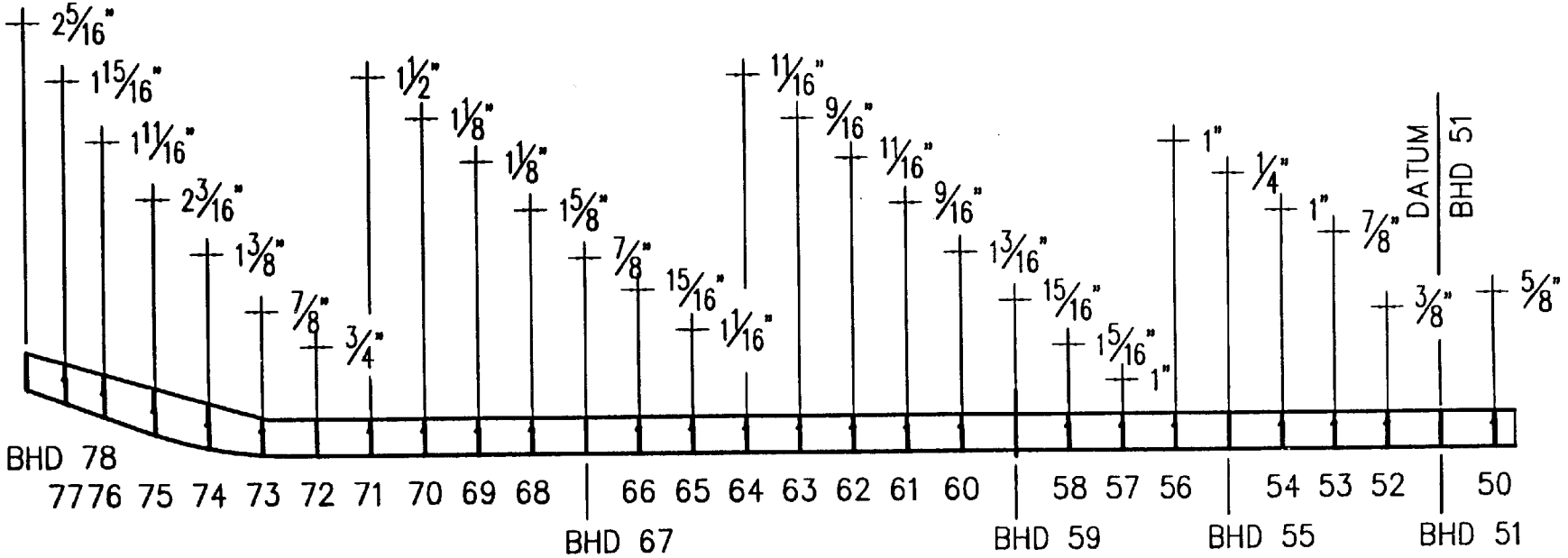

FIGS. 27A and 27B are exemplary elevation details. FIG. 27A shows an elevation at L6 starboard—15'-0" off the centerline CL (looking to port) and FIG. 27B shows an elevation at L13 starboard—32'-6" off the centerline CL (looking to port). Similar measurements can be taken at an elevation at L6 port—15'-0" off the centerline CL (looking to port) and an elevation at L13 port—32'-6" off the centerline CL (looking to port). A longitudinal offset in the distance between transverse frames can be determined at each longitudinal frame off of the centerline CL for the length of the portion of the vessel to be double hulled (e.g., over the cargo carrying length, over a portion of the cargo carrying length, and/or over the entire length of the vessel).

By conducting detailed ship surveys and measuring the actual location of the existing hull structure a vertical offset and a longitudinal offset can be determined and accounted for in the design and construction of the inner hull structure, thereby resulting in an improved fit-up of the new structure to the existing structure.

While the invention has been described with reference to a preferred embodiment, it will be understood by those skilled in the art that various changes may be made and equivalents may be substituted for elements thereof without departing from the scope of the invention. In addition, many modifications can be made to adapt a particular situation or material to the teachings of the invention without departing from the essential scope thereof. Therefore, it is intended that the invention not be limited to the particular embodiment disclosed as the best mode contemplated for carrying out this invention, but that the invention will include all embodiments falling within the scope of the appended claims.

What is claimed is:

1. A double hull vessel rebuilt from an existing single hull vessel comprising:

an outer hull of said existing single hull vessel;

an inner hull disposed within a volume defined by said outer hull so as to define a double hull; and a plurality of framing members disposed between said inner hull and said outer hull, wherein said framing members comprise connecting members that maintain said inner hull in a spaced apart relationship to said outer hull, and stiffening members that stiffen said inner hull and said outer hull;

wherein said connecting members further comprise:

inner transverse framing members;

a plurality of slots in said inner transverse framing members;

an inner hull connecting member extending from an exterior surface of said inner hull toward said outer hull and having a distal end;

an outer hull connecting member extending from an interior surface of said outer hull toward said inner hull and having a top end;

a face bar connected to one of said inner hull connecting member and said outer hull connecting member; and a filler plate connected to said face bar and one of said inner hull connecting member and said outer hull connecting member, to which said face bar is not connected;

wherein said stiffening members comprise inner longitudinal framing that extend from said exterior surface of said inner hull along a longitudinal length of said vessel and pass through said slots in said inner transverse framing members, said inner hull defines an interior cargo carrying volume, and said outer hull defines an exterior of said double hull vessel, such that said inner hull provides a boundary in the event that said outer hull is penetrated.

2. The vessel of claim 1, wherein said face bar is connected to said inner hull connecting member; and said filler plate is connected to said face bar and said outer hull connecting member.

3. The vessel of claim 1, wherein, said inner hull connecting member further comprises a distal end;

said face bar further comprises an upper surface and a lower surface, wherein said upper surface is connected to said distal end of said inner hull connecting member;

said outer hull connecting member further comprises a top portion; and said filler plate further comprises an upper end and a lower end, wherein said upper end is connected to said lower surface of said face bar and said lower end is connected to said top portion of said outer hull connecting member.

4. The vessel of claim 1, wherein said outer hull connecting member comprises at least a portion of an existing outer framing member of said outer hull.

5. The vessel of claim 1, wherein said face bar comprises a substantially flat face bar and said filler plate comprises a substantially straight filler plate.

6. The vessel of claim 1, further comprising a fit-up tolerance that provides for improved fit-up of said inner hull to said outer hull by allowing a misalignment between said inner hull connecting member and said outer hull connecting member.

7. The vessel of claim 6, wherein said fit up tolerances further comprises:

a transverse fit up area defining an acceptable transverse offset between said inner hull connecting member and said outer hull connecting member; and a vertical fit up area defining an acceptable vertical offset between said distal end of said inner hull connecting member and said top end of said outer hull connecting member.

8. The vessel of claim 7, wherein said fit up tolerances for said transverse fit up area is determined based on one or more of a plate thickness of said inner hull connecting member and a plate thickness of said face bar.

9. The vessel of claim 7, further comprising tolerance angles a formed between an imaginary line extending from each corner of said distal end of said inner hull connecting member.

10. The vessel of claim 9, wherein said tolerance angles further comprise tolerance angles of about 45 degrees.

11. The vessel of claim 10, wherein said inner hull connecting member and said outer hull connecting member have a plate thickness of about ½ inch, said face bar has a plate thickness of about 1 inch, and said filler plate has a plate thickness of about ½ inch;

wherein said transverse fit up area comprises a transverse tolerance of about 2 9/16 inch for said transverse offset between said inner hull connecting member and said outer hull connecting member; and wherein said vertical fit up area comprises a vertical tolerance of about 2 3/16 inch for said vertical offset between said inner hull connecting member and said outer hull connecting member.

12. The vessel of claim 1, wherein said inner hull connecting member, said face bar, said filler plate, and said outer hull connecting member are welded together.

13. The vessel of claim 1, wherein said plurality of framing members further comprise a plurality of inner hull connecting members and plurality of outer hull connecting members that are fabricated and fitted together so that they correspond in number to one another and are aligned within a predetermined tolerance when said inner hull is installed within and over said outer hull.

14. The vessel of claim 1, further comprising outer transverse framing extending inward from said outer hull that correspond in number and location to inner transverse framing extending outward from said inner hull, wherein said inner transverse framing extends a greater distance from said exterior surface of said inner hull than said inner longitudinal framing extends therefrom, thereby forming a gap between said inner longitudinal framing and said outer transverse framing.

15. A method of rebuilding an existing single hull vessel having a stern section, a midship cargo section, and a bow section into a double hull vessel, said existing single hull vessel including existing outer hull structure and deck plating, wherein said existing hull structure comprising outer shell plating and framing members, said method comprising the steps of:

cutting an internal structure of said existing single hull vessel proximate an inner perimeter of said outer shell plating and an outer perimeter of said deck plating at least along a length of said cargo section;

removing said cut internal structure from said outer shell plating;

internally installing a new inner hull structure in a spaced apart relationship within a volume defined by said outer shell plating of said existing single hull vessel to form a double hull;

connecting said inner hull structure to said existing outer hull structure using a face bar and a filler plate combination that account for deviations between said inner hull structure and said outer hull structure thereby providing improved fit up of said new inner hull structure to said existing hull structure;

adapting said removed internal structure for reinsertion into said double hull; and reinstalling said adapted internal structure over an interior surface of said inner hull.

16. The method of claim 15, further comprising the steps of:

performing a detailed vessel survey including measuring the actual structural dimensions comprising:

longitudinal distances between transverse frames and transverse bulkheads; and vertical gaps between said new inner hull structure and said existing outer hull structure.

17. The method of claim 15, further comprising the step of:

using Automated Computer-Aided Drafting (AUTOCAD) to ensure that said new inner hull structure and said existing outer hull structure come together smoothly;

using graphical techniques to depict with a very high degree of accuracy said outer hull structure of said existing vessel; and fabricating said new inner hull structure to match said existing outer hull structure.

18. The method of claim 15, further comprising the step of using Finite Element Analysis (FEA) for evaluation of special structural details for best fit of new-to-existing structure ensuring acceptable stresses and long-term trouble-free service.

19. The method of claim 15, further comprising the step of:

providing a transverse fit up area defining an acceptable transverse offset between a new inner hull connecting member extending from said inner hull structure and an existing outer hull connecting member extending from said outer shell plating; and providing a vertical fit up area defining an acceptable vertical offset between a distal end of said inner hull connecting member and a top end of said outer hull connecting member.

* * * * *

UNITED STATES PATENT AND TRADEMARK OFFICE

CERTIFICATE OF CORRECTION

PATENT NO. : 6,637,359 B1
DATED : October 28, 2003
INVENTOR(S) : Thomas Hagner

It is certified that error appears in the above-identified patent and that said Letters Patent is hereby corrected as shown below:

Column 4,
Line 22, "angles a" should read -- angles α --

Column 6,
After line 25, the following paragraph was omitted and should be inserted:
-- Figure 20A shows a detail section view taken along section line 20a-20a of Figure 12 --

Column 26,
Line 41, "angles a formed" should read -- angles α formed --

Signed and Sealed this

Second Day of March, 2004

JON W. DUDAS
*Acting Director of the United States Patent and Trademark Office*

UNITED STATES PATENT AND TRADEMARK OFFICE

CERTIFICATE OF CORRECTION

PATENT NO. : 6,637,359 B1
DATED : October 28, 2003
INVENTOR(S) : Thomas Hagner

It is certified that error appears in the above-identified patent and that said Letters Patent is hereby corrected as shown below:

Column 4,
Line 22, "angles a" should read -- angles α --

Column 6,
After line 25, the following paragraph was omitted and should be inserted:
-- Figure 20A shows a detail section view taken along section line 20a-20a of Figure 12 --

Column 26,
Line 41, "angles a formed" should read -- angles α formed --

Signed and Sealed this

Sixth Day of April, 2004

JON W. DUDAS
*Acting Director of the United States Patent and Trademark Office*